US005202182A

United States Patent [19]

Knox et al.

[11] Patent Number: 5,202,182

[45] Date of Patent: Apr. 13, 1993

[54] MULTIFILAMENT APPAREL YARNS OF NYLON

[75] Inventors: Benjamin H. Knox, West Chester, Pa.; Francis J. Malone, Jr., Hixson, Tenn.; Gary D. Milosovich, Columbia, S.C.; Frank H. Overton, Signal Mountain; Ronald E. Steele, Hixson, both of Tenn.; Paul G. Zmick, Beaumont, Tex.

[73] Assignee: E. I. Du Pont de Nemours and Company, Wilmington, Del.

[21] Appl. No.: 851,461

[22] Filed: Mar. 13, 1992

Related U.S. Application Data

[62] Division of Ser. No. 540,132, Jun. 21, 1990, Pat. No. 5,137,666.

[30] Foreign Application Priority Data

Jul. 10, 1989 [GB] United Kingdom ..... 89015736

[51] Int. Cl.[5] ..... D01F 1/10; D01F 6/60; D02G 1/00; D02G 3/02; D02G 3/04

[52] U.S. Cl. ..... 428/364; 57/243; 57/244; 57/245; 57/246; 428/369; 428/370

[58] Field of Search ..... 57/243, 244, 245, 246; 428/364, 369, 370

[56] References Cited

U.S. PATENT DOCUMENTS

| | | | |
|---|---|---|---|
| 3,418,199 | 12/1968 | Anton et al. . | |
| 3,557,544 | 1/1971 | Simons | 57/140 R |
| 3,583,949 | 6/1971 | Simons . | |
| 3,994,121 | 11/1976 | Adams | 57/140 R |
| 4,542,063 | 9/1985 | Tanji et al. | 428/364 |
| 4,559,196 | 12/1985 | Kobsa et al. | 264/168 |
| 4,583,357 | 4/1986 | Chamberlin et al. | 57/243 |
| 4,601,949 | 7/1986 | Bach et al. | 428/374 |
| 4,619,803 | 10/1986 | Yu | 264/176.2 |
| 4,621,021 | 11/1986 | Kitamura | 428/364 |
| 4,646,514 | 3/1987 | Chamberlin et al. | 57/288 |
| 4,668,453 | 5/1987 | Ebnesajjad et al. | 264/78 |
| 4,721,650 | 1/1988 | Nunning et al. | 428/369 |
| 5,137,666 | 8/1992 | Knox | 264/103 |

FOREIGN PATENT DOCUMENTS

| | | |
|---|---|---|
| 2336509 | 2/1974 | Fed. Rep. of Germany . |
| 2335946 | 1/1975 | Fed. Rep. of Germany . |
| 28012 | 8/1973 | Japan . |
| 1025098 | 4/1966 | United Kingdom . |

OTHER PUBLICATIONS

One Page Advertisement in Chemical and Engineering News, first published in 1986.

Product Description Pages for 2-methylpentamethylenediamine provided upon request by E. I. du Pont de Nemours and Company since Jun. 1988.

*Primary Examiner*—James C. Cannon

[57] ABSTRACT

Incorporating a minor amount of a hydrogen bonding additive such as nylon 6 monomer or 2-methyl-pentamethylene adipamide monomer in a nylon 66 high RV polymer for making nylon 66 POY provides unexpected downstream advantages over homopolymer nylon 66 POY, especially in draw-texturing to make bulky yarns for use in hosiery.

29 Claims, 12 Drawing Sheets

MULTIFILAMENT APPAREL YARNS OF NYLON

This is a division of application Ser. No. 07/540,132, filed Jun. 21, 1990, and now U.S. Pat. No. 5,137,666.

TECHNICAL FIELD

This invention concerns improvements in and relating to multifilament apparel yarns of nylon 66, particularly to textured nylon yarns, e.g. for hosiery, and to the partially-oriented nylon (sometimes referred to as POY or PON) draw-texturing feed yarns (i.e. intermediate yarns from which the apparel yarns are prepared), to processes for the preparation of such apparel yarns, for preparing POY (by polymerization and high-speed melt-spinning), and for using POY, e.g. by draw-texturing and in other processes for using POY, and to products produced from the above yarns.

BACKGROUND

Synthetic linear hexamethylene adipamide polyamide yarns (often referred to as nylon 66) recently celebrated their 50th anniversary. An important use of such yarns is as textured multifilament yarns, e.g. for making apparel, such as hosiery. For many purposes, it is the high bulk that is desired in the textured yarns. For some years now, these bulky textured yarns have been prepared commercially in 2 stages; in a first process, nylon polymer has been melt spun into filaments that have been wound up into a (yarn) package at high speeds (of the order of 3000 meters per minute (mpm), so-called high speed spinning) as partially oriented yarn (sometimes referred to as POY) which is a feed yarn (or intermediate) for draw-texturing (and so sometimes referred to as DTFY for draw-texturing feed yarn); then, in a separate process, the feed yarns have been draw-textured on commercial texturing machines. These processes have been described in several publications, e.g. by Adams, in U.S. Pat. No. 3,994,121, issued 1976. Draw-texturing of various types of POY has been practiced commercially for more than 10 years on a very large scale. This has encouraged improvement of texturing machines. Accordingly, texturing machines have for some time had speed capabilities of well over 1000 mpm. But it has proved too difficult to obtain the desired bulky nylon 66 yarns at such high speeds, mainly because of limitations in the nylon POY that has been commercially available. So, in the U.S.A., for preparing the bulky nylon yarns that have been desired, nylon POY has for some years been textured commercially at speeds well below even 1000 mpm, i.e., well below the capability of the texturing machines, which could have been operated at significantly higher speeds.

Recently, Chamberlin et al in U.S. Pat. Nos. 4,583,357, and 4,646,514 have discussed such yarns, and their production via partially-oriented nylon (referred to by Chamberlin as PON). The disclosures of these "Chamberlin" Patents are incorporated herein by reference as background to aspects of the present invention.

Chamberlin discloses an improved (PON) spinning process and product by increasing the molecular weight of the nylon polymer well above the levels previously customary for apparel end uses. The molecular weight of nylon yarn was measured by relative viscosity (RV) determined by ASTM D789-81, using 90% formic acid. The apparel yarns were of nylon 66 of denier between 15 and 250; this denier range for apparel yarns is in contrast to that used for nylon carpet yarns, that have been made and processed differently, and are of different (higher) deniers, and some such carpet yarns had previously been of higher RV than for nylon apparel; Chamberlin mentions the expense and some difficulties of using higher RVs than conventional when making apparel yarns. Chamberlin's higher RVs were greater than 46, preferably greater than 53, and especially greater than 60, and up to 80 (for nylon 66). Chamberlin compared the advantages of such yarns over yarns having a nominal polymer RV of 38–40. Chamberlin discloses preparing PON by spinning at high speeds greater than 2200 mpm, and as high as 5000 mpm. Chamberlin describes how his high RV high-speed spun PON feed yarns were draw-textured at 750 or 800 mpm on a Barmag FK6-L900 texturing machine using a 2½ meter primary heater at 225° C. and a Barmag disc-aggregate with Kyocera ceramic discs, at a D/Y ratio of about 1.95. (As indicated by its name, the Barmag FK6-L900 texturing machine is itself capable of operation at 900 meters/minute, i.e. at speeds higher than disclosed by Chamberlin; texturing machines that are capable of operating at even higher speeds have been available commercially for several years). Chamberlin obtained crimp development values that were better than for 40 RV conventional yarn without excessive broken filaments (frays), or yarn breaks under these conditions.

Chamberlin explained the operable texturing tension range, within which the draw ratio may be changed (at a given draw roll speed) by adjusting the feed roll speed and so the draw-texturing stress or tension, which should be high enough for stability in the false-twist zone (to avoid "surging") and yet low enough to avoid (excessive) filament breakage. So adjustments were made to get maximum crimp development by operating with "maximum texturing tension" within this operable tension range. So, even if a feed yarn can be textured satisfactorily at a given speed and under other specified conditions, the operable texturing tension range may be quite narrow. A narrow texturing range (or "window") is commercially disadvantageous, as it limits the texturer.

This may be further understood by reference to FIG. 1, in which schematically texturing tensions are plotted against texturing speed. When one operates at a texturing speed $V_L$, the average tension prior to twist-insertion (referred to as pre-disc tension $T_1$) is shown by the large dot, but the actual along-end tension $T_1$ is more accurately represented by a distribution of tensions; i.e., $T_1 \pm -\Delta T_1$, where $\Delta T_1$ represents approximately 3 times the standard deviation of the tension. Therefore, a stable texturing process requires that the minimum tension ($T_1 - \Delta T_1$), rather than the average pre-disc tension ($T_1$), be sufficiently high to prevent surging. To increase the texturing speed from $V_L$ to $V_H$, for example, by just increasing texturing speed (denoted as path A), would result in a condition wherein, although the average texturing tension might seem acceptable, the process would be unstable whenever $T_1$ drops, so surging would occur. So, in practice, an increase in texturing speed is achieved by increasing the average $T_1$ (see path B) by increasing the texturing draw ratio. Although such a higher draw ratio may avoid surging and so provide for a stable texturing process, the texturer may now obtain lower bulk, and may even experience broken filaments because of the increase in texturing tensions across the twist device. The post-disc tensions ($T_2$) are usually greater than the pre-disc tensions ($T_1$); in FIG. 1 this higher value is denoted by 2'. To increase bulk and eliminate broken filaments, the texturer must decrease $T_2$ tensions from 2' to a lower point denoted by 2. This is usually achieved by increasing the relative disc-to-yarn speed ratio (D/Y) which slightly increases the pre-disc tensions ($T_1$), but significantly decreases the post-disc tensions ($T_2$) and, therefore, the $T_2/T_1$ ratio. A concern with higher D/Y-ratios is increased disc wear and abrasion of the yarn. Another option is to increase texturing temperature, as the post-disc tension ($T_2$) usually decreases more than the pre-disc tension ($T_1$) as the temperature increases. This option, also, may be undesirable, as it will reduce the tensile strength of the "hot" yarn during twist insertion and increase the propensity for broken filaments.

This balancing of texturing draw ratio, the disc/yarn speed ratio, and the heater plate temperature is frequently referred to as the "texturing window" which narrows for a given texturing machine configuration with increasing texturing speed, as shown in FIG. 1; there are upper tension limits beyond which broken filaments occur, and even process breaks, and lower tension limits, below which surging occurs and poor along-end textured yarn uniformity.

SUMMARY OF THE INVENTION

According to the present invention, it has been found that incorporating a minor amount of a bifunctional polyamide comonomer with the regular nylon 66 diacid and diamide monomers provides the capability to improve further the texturing performance of the high RV nylon 66 multifilament draw-texturing feed yarns referred to above. Preferred bifunctional comonomers are ε-caprolactam and the monomer unit formed from 2-methyl-pentamethylene diamine and adipic acid, the latter being especially preferred as will be described hereinafter. ε-caprolactam is the monomer for preparing nylon 6 homopolymer, described by Chamberlin as inferior to nylon 66 for his purposes. It is believed that the monomer unit formed from 2-methyl-pentamethylene diamine and adipic acid has not been used for fibers. The behavior of the fibers of the present invention, however, give unexpected advantages over nylon 66 homopolymer fibers, as will be discussed herein. For convenience, sometimes herein, the use of the ε-caprolactam additive may be referred to as incorporating nylon 6, although it will be understood that a small amount of e-aminocaproic monomeric units from the ε-caprolactam, will be randomly distributed along the nylon 66 polymer chain (containing monomer units from the 6 diacid and from the 6 diamine monomers). Other monomer units will be also be randomly distributed. Also, for convenience, in comparing the performance of the fibers, especially in the Examples and Figures, the fibers of the invention incorporating ε-aminocaproic monomeric units may be referred to as N6,66, to distinguish from the homopolymer, referred to as N66. Similarly, fibers of the invention incorporating the monomer unit from 2-methyl-pentamethylene diamine (MPMD) and adipic acid may be referred to as Me5-6,66 and the monomer unit formed from the diamine and adipic acid (2-methyl-pentamethylene adipamide) may be referred to as Me5-6. Although this invention is not intended to be limited by any theory, we speculate that the minor amount of the monomer additive such as nylon 6 or Me5-6 provides this improvement because it is slightly different from the nylon 66 monomers, but is similar to the extent of being capable of hydrogen bonding; so it is believed that an improvement over homopolymer N66 may be obtained by using a minor amount of other comonomers similarly capable of hydrogen bonding, i.e. bifunctional polyamide comonomers, such as other diacid comonomers, diamine comonomers, aminoacid comonomers or lactam comonomers, or even by using a non-reactive additive capable of hydrogen bonding with the nylon 66 polymer, such as 7-naphthotriazinyl-3-phenylcoumarin, for example.

According to one aspect of the present invention, therefore, there is provided a process for preparing a textured nylon 66 multifilament yarn having a relative viscosity of about 50 to about 80, involving draw-texturing a feed yarn of denier about 15 to about 250 and of elongation ($E_b$) about 70 to about 100% at a temperature of about 200° to about 240° C., to provide a textured yarn of elongation of less than about 35%, preferably less than 30%, characterized in that the texturing speed is at least about 900 mpm, preferably at least about 1000 mpm, and the feed yarn is a polymer of nylon 66 containing a minor amount of such bifunctional polyamide comonomer or of a non-reactive additive capable of hydrogen bonding with the nylon 66 polymer, and preferably as indicated herein.

According to another aspect of the present invention, there is provided a partially-oriented nylon 66 polymer multifilament yarn of denier about 15 to about 250 and of elongation ($E_b$) about 70 to about 100%, preferably about 75 to about 95%, the polymer being of relative viscosity about 50 to about 80, characterized in that the polymer contains a minor amount, preferably, by weight, about 2 to about 8%, of a bifunctional polyamide comonomer or a non-reactive additive capable of hydrogen bonding with the nylon 66 polymer, and that the yarn has a draw-tension (DT) in g/d of between about 0.8 and about 1.2, preferably between about ($140/E_b - 0.8$) and about 1.2. Preferred such yarns are characterized by a draw modulus ($M_D$) of about 3.5 to about 6.5 g/d and by a draw stress ($\sigma_D$) of about 1.0 to about 1.9 g/d, measured at 75° C. and a draw ratio of 1.35X, with apparent draw energy $(E_D)_a$ of about 0.2 to about 0.5. Preferred such yarns are also characterized by a TMA maximum dynamic extension rate $(\Delta L/\Delta T_1)_{max}$ between about 100°-150° C. under 300 mg/pre-tension, of about 0.05 to about 0.15%/°C., and a sensitivity of $(\Delta L/\Delta T_1)_{max}$ to stress ($\sigma$), $d(\Delta L/\Delta T_1)_{max}/d\sigma$, as measured at 300 mg/d of about $3\times10^{-4}$ to $7\times10^{-4}$ (%/°C.)/(mg/d).

In preferred partially-oriented nylon 66 polymer multifilament yarn in accordance with the invention employing N6,66 polymer, an RV of 60-70 is especially preferred. When Me5-6,66 polymer is employed, an RV of 50-60 is preferred.

According to another aspect of the present invention, there is provided a process for preparing a multifilament spin-oriented yarn of nylon 66 polymer of denier about 15 to about 250, by melt-spinning nylon 66 polymer of relative viscosity at least about 50 to about 80 at a spinning withdrawal speed of at least about 4500 meters/minute, preferably more than 5000 mpm, and preferably not more than about 6500 mpm characterized in that the nylon 66 polymer contains a minor amount of such bifunctional polyamide comonomer or of non-reactive additive capable of hydrogen bonding with the nylon 66 polymer. Preferred spinning conditions are a polymer extrusion temperature ($T_p$) 20° to 60° C. above the polymer melting point ($T_m$), preferably to 20° to 40° C. above $T_m$. A spinneret capillary of dimensions such that the diameter (D) is about 0.15 to about 0.30 mm, preferably is about 0.15 to about 0.23 mm, and the length-/diameter (L/D) ratio is at least about 1.75, preferably is at least about 2, especially is at least about 3, such that the value of the expression, $L/D^4$, is at least about 100 $mm^{-3}$, preferably at least about 150 $mm^{-3}$, especially at least about 200 $mm^{-3}$, providing an extent of melt attenuation, as given by the ratio, $D^2/dpf$, between about 0.010 to 0.045, quenching of the freshly-melt-spun filaments with a flow of air of more than about 50% RH, especially at least about 70% RH, at a temperature of about 10° C. to about 30° C. and at a velocity of about 10 to about 50 mpm, preferably of about 10 to 30 mpm, and convergence of the filaments between about 75 to 150 cm, preferably between about 75 to 125 cm, from the face of the spinneret.

According to a further aspect of the invention, there is provided a textured nylon 66 multifilament yarn having an elongation ($E_b$) less than about 35%, preferably less than about 30%, and a relative viscosity of about 50 to about 80, characterized by the yarn consisting essentially of nylon 66 polymer containing a minor amount, preferably by weight about 2 to about 8%, of such bifunctional polyamide comonomer or of non-reactive additive capable of hydrogen bonding with the nylon 66 polymer.

In preferred textured nylon 66 polymer multifilament yarn in accordance with the invention employing N6,66 polymer, an RV of 60–70 is especially preferred. When Me5-6,66 polymer is employed, an RV of 50–60 is preferred.

Further aspects of the invention will appear, e.g., further processes for using the new yarns and products produced.

DETAILED DESCRIPTION OF INVENTION

Figure 2:
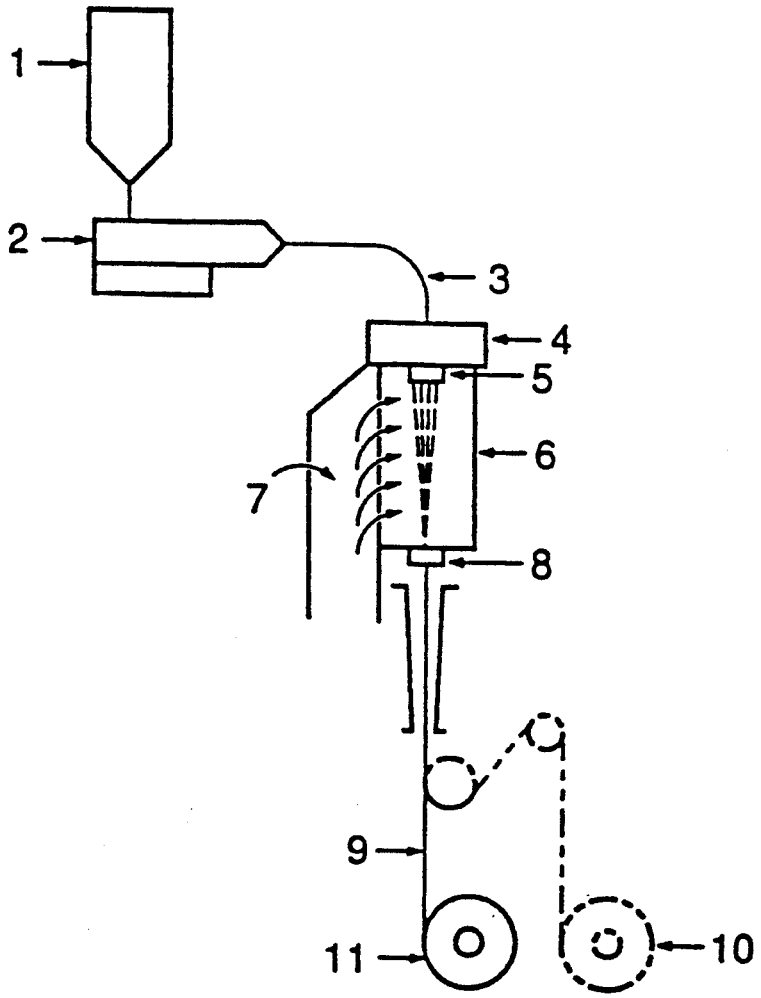
FIG. 2 is a schematic illustration of a process for preparing nylon POY according to the invention.

The draw-texturing feed yarns were made by the following process, which is described with reference to FIGS. 2 and 3, it being understood that the precise conditions and variations thereof have important effects on the resulting filaments, and their properties, as can be seen in the Examples; such provide opportunities for control and some of the findings were quite unexpected.

Nylon 66 with a bifunctional copolyamide comonomer capable of hydrogen bonding with the 66 nylon polymer can be prepared by condensation polymerization in an aqueous "salt" solution containing the monomers in appropriate proportions. Procedures useful for the production of homopolymer nylon 66 can be applied to the production of the N6,66 with ε-caprolactam added to the salt solution. To make Me5-6,66, adipic acid with hexamethylene diamine (HMD) and 2-methyl-pentamethylene diamine (MPMD) in the molar proportions necessary to produce the copolymer with the desired weight percent 2-methyl-pentamethylene adipamide (% Me5-6) are used to make the salt solution. For Me5-6,66, it is generally necessary, however, to modify the usual 66 nylon 66 procedures to make sure that the MPMD, which is more volatile, stays in solution sufficiently long to react. 2-methyl-pentamethylene diamine is commercially available and is sold by E.I. du Pont de Nemours & Co., Wilmington, Del., under the trademark DYTEK $A^R$.

Starting polymer, conveniently in the form of flake of 25 to 50 RV (relative viscosity), was introduced into a vessel 1, and subjected to conventional solid phase polymerization to increase its RV (by removing water under controlled temperature and inert gaseous conditions). The resulting polymer was transferred to an extruder 2, where it was melted so the melt was pushed through a heated delivery system 3 to a plurality of individual spinning units 4 (only one being shown, for convenience); if desired, by venting off more water or by introducing flake from solid phase polymerization which has less than the equilibrium moisture at the given melt temperature, the polymer RV can be further increased by 5 to 15 RV units prior to extrusion, and this has provided good results. The polymer melt was filtered in an extrusion pack 5, providing, typically, a total pressure ($\Delta P_T$) of 200 to 600 $Kg/cm^2$ with a filtration pressure ($\Delta P_F$) of 100 to 300 $kg/cm^2$, at a flux rate of 0.6 to 2.2 $g/cm^2/min$, and a polymer extrusion temperature ($T_P$) of about 20 to about 60° C., preferably about 20 to about 40° C., higher than the polymer melting point ($T_m$). For the N6,66 copolymer, a polymer extrusion temperature ($T_P$) of about 280° to 300° C., especially about 285° to 295° C. gave good results. For Me5-6,66 copolymer, a polymer extrusion temperature ($T_P$) of about 275° to 295° C., especially about 275° to 285° C. gave good results.

Figure 1:
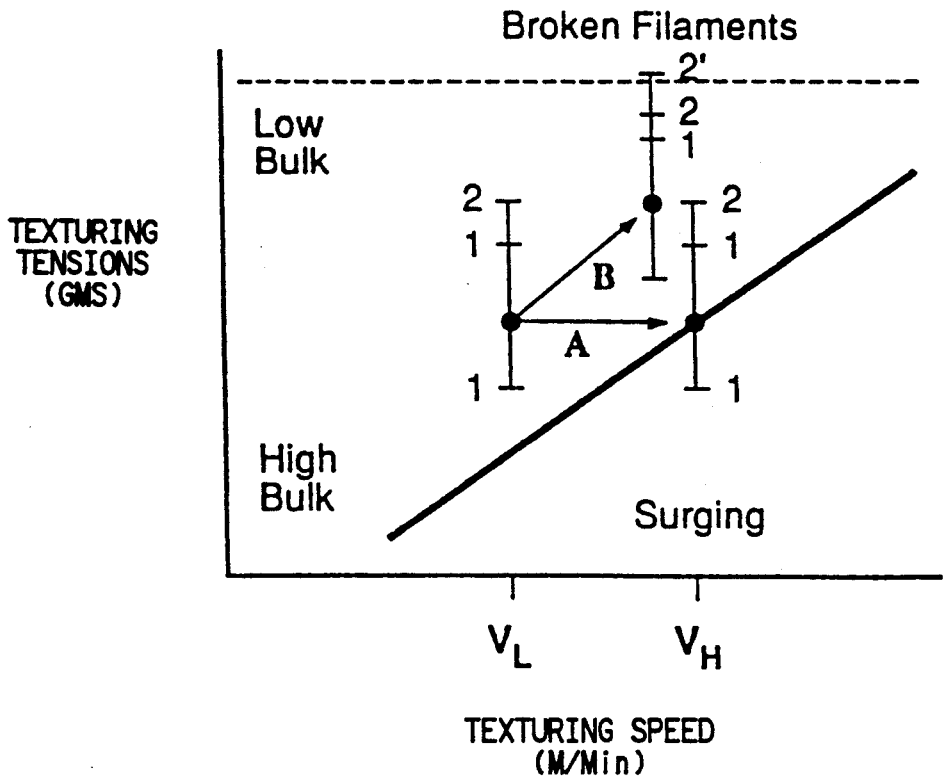
FIG. 1 (referred to already) is a graph plotting texturing tensions against texturing speed.
Figure 3:
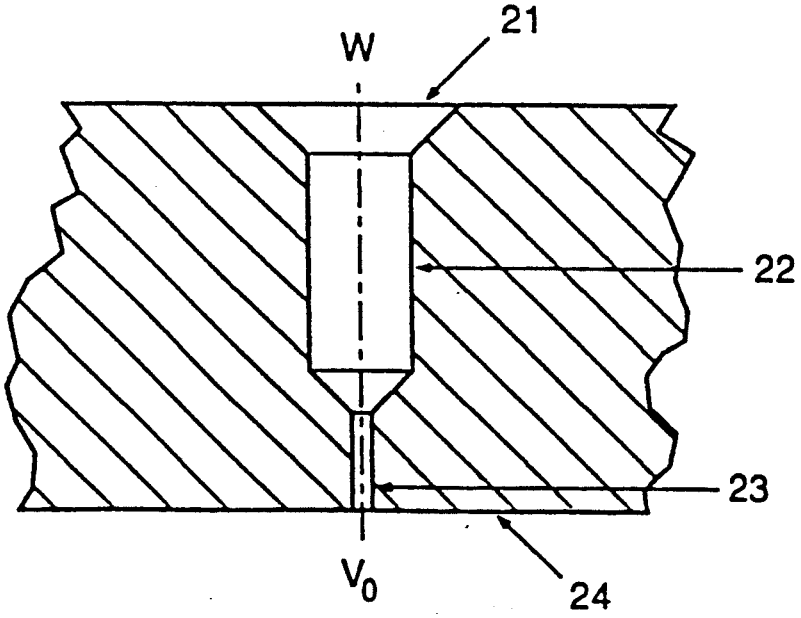
FIG. 3 is a magnified section through a spinneret face to illustrate a spinning capillary for spinning a POY filament.

Referring to FIG. 3, the freshly-filtered polymer is then extruded through small spinneret capillaries, one being schematically shown in FIG. 3, wherein the polymer is metered into the entrance of the capillary 21 at a mass flow rate, W (gms/minute) [=(denier per filament/9000 meters)×spin speed, mpm, i.e., is proportional to dpf×V] through a large capillary counter bore 22, and then through the spinneret capillary 23 of length (L, mm) and diameter (D, mm). Such dimensions of the spinneret capillary affect the extrusion velocity ($V_o$ mpm) [$V_o$ is proportional to $(dpf \times V)/D^2$], the rate of melt attenuation ($V/V_o$) [$V/V_o$ is proportional to $D^2/dpf$], the melt shear rate ($\gamma$) [$\gamma$ is proportional to $(dpf \times V)/D^3$], and the capillary pressure drop ($\Delta P_c$) $\Delta P_c$ is proportional to the $(dpf \times V)$ $(L/D^4)(\eta_m)$], so have pronounced effect on the spinning performance, along-end uniformity, and final fiber structure and physical properties of the spun filaments and must be selected carefully along with the spin speed (V), filament denier, and rate of cooling of the freshly-extruded filaments.

The external face of the spinneret 24 is protected from monomer deposits and oxygen by a low flow rate of superheated steam which passes readily down and around the extrusion pack and is then removed by an exhaust system. To maintain stability of the freshly-extruded filaments during removal of monomer vapors, the transverse quench air is especially controlled to balance the exhaust rate so there is no significant net movement of the filaments during the first 5 to 15 cm. If desired, the freshly-extruded filaments may be further protected from turbulence by a solid or porous delay tube.

The filaments are cooled to below their glass transition temperature ($T_g$) over a distance of about 75 to 150 cm, preferably 75 to 125 cm, by transverse gaseous media, usually humidified chilled air 7 of at least about 50% and more typically about 70% relative humidity (RH) at 10°-30° C., more typically about 20° C., with a transverse velocity of typically 10 to 50 mpm, preferably 10 to 30 mpm, and then protected from stray room air currents by a screen 6. The filaments may alternatively be cooled by a radial quench unit, wherein the quench air flow rates will have to selected to achieve the desired along-end uniformity and yarn physical properties as are achieved by transverse quenching.

The cooled filaments are converged, typically at the bottom of the quench chamber, 8 that is, at about 75 to 150 cm, preferably 75 to 125 cm, from the face of the spinneret by a metered finish tip applicator; although other means of convergence may be used, if desired, such as a ceramic or metal guide or an air jet. The along-end uniformity and yarn properties are affected by the length of the convergence (Lc) over distances typically 75 to 150 cm, which are selected along with quench air temperature and flow rates to achieve the desired balance of properties.

A spin finish is applied to the converged filament bundle (now referred to as a yarn) preferably by a metered finish tip applicator, although roll applicators may also be used. The spin finish (of usually about 0.2-1%, and more typically of about 0.4-0.7%, by weight on yarn) is selected to provide the necessary yarn-to-yarn friction required for winding spin packages at high spin speeds (V) of 4500 to 6500 mpm and then to permit uniform yarn take-off from the spin package in high speed texturing and finally to provide the necessary interfilament friction for proper twist insertion during high speed texturing. The yarn bundle is then transferred directly to a winder 11 at 4500 to 6500 meters/-minute (this is referred to as godetless spinning). The yarn bundle may also be transferred to the winder via a set of driven godets 10. Filament interlace is applied prior to winding, as illustrated at 9, to obtain sufficient interfilament entanglement and overall yarn cohesiveness for improved winding and yarn take-off; however, the level of interlace must not be so high as to prevent uniform twist insertion during texturing. A filament interlace level of about 10-15 cm was found to be adequate for high speed texturing for 25-55 denier feed yarns. The level of interlace required to achieve the necessary balance of yarn cohesiveness and interfilament migration for proper twist insertion will also be affected by the type and level of spin finish used and the type of twist insertion, such as soft or hard friction twist discs.

The yarns of this invention are wound at tensions of about 0.2-0.6 gms/denier and do not require any intermediate or post heat treatment for stability. The yarns may be heat-treated, e.g. with steam as disclosed in Adams U.S. Pat. No. 3,994,121, or by other methods disclosed in the art, before winding, for modifications of physical properties; such treatments are not required for package stability or high speed yarn take-off as has been required for lower speed spun-oriented (POY or PON) yarns. The winding tension required for acceptable package formation and yarn take-off is achieved by known means.

At high spin speeds, such as 4500 to 6500 meters/minute used in this invention, there is a narrow region in the quench chamber where the filament diameter is reduced dramatically over a small distance and is associated with a rapid rise in the filament attenuating velocity. The phenomenon is frequently referred to as the "neck-down" region. Orientation and crystallization of the polymer chains occurs during and immediately after the neck-down. The distance from the point of extrusion to the neck-down (Ln) is usually 75 to 150 cm and depends on the process parameters, such as spin speed filament denier, polymer viscosity, polymer temperature, extrusion velocity, quench air temperature, quench air velocity, as a partial listing.

The convergence length (Lc) is desirably slightly greater than the Ln, and preferably less than $1.25 \times Ln$. The average rate of attenuation over the distance Ln may be approximated by the expression $[(V-V_o)/Ln]$. In general, higher rates of attenuation increase polymer chain orientation as indicated by higher draw tensions (DT) and lower elongations-to-break ($E_b$). The extent of melt attenuation may be given by the ratio of the final spin speed (V) and the initial extrusion velocity ($V_o$) and is proportional to $D^2/dpf$. The proper selection of the average extent and rate of attenuation must be considered to obtain the desired balance of along-end uniformity and yarn physicals of this invention.

The melt viscosity ($\eta m$) of the polymer of this invention is determined in part by the polymer's relative viscosity (RV) which is approximately proportional to the $MW^{3.4}$, wherein MW is the polymer weight-average molecular weight, and inversely proportional to the polymer temperature ($T_p$) wherein $\eta m$ is proportional to the Arrhenius expression exp(A/T) and A is a constant for a given polymer type, and the shearing rate ($\gamma$) of the polymer melt through the spinneret capillary. At high spin speeds of V greater than about 4000-4500 meters/minute and polymer RV of about 40-45, increase in melt viscosity $\eta m$ by increasing RV increases crystallization and decreases the orientation of the non-crystalline regions to an extent that is surprising and, surprisingly, only over a selected range of spin speed V and RV. However, it is found that an increase in the melt viscosity ($\eta m$) by other means, such as by lower polymer temperatures and shear rates, increases polymer chain orientation, as indicated by higher draw tensions (DT) and lower elongation-to-break ($E_b$). It is therefore desirable to make a proper selection not only of polymer RV, but also of polymer temperature and shear rates to achieve the balance of polymer chain orientation and crystallization desired; that is, of draw tension and elongation-to-break for the yarns of this invention.

An important advantage of this invention is that it provides a commercially viable way to maximize overall productivity, i.e., not only the spinning productivity (Ps) [$Ps = V \times RDR$, wherein $RDR = 1 + \% E_b/100$] of the fiber producer, but also the texturing productivity (Pt) [Pt is proportional to Vt] of the throwsters by an improved spinning process which provides an improved feed yarn that improves a throwster's productivity. Increasing spinning speed has always been a key element to increasing spinning productivity; this usually reduces the elongation of the resulting feed yarn, which often reduces the texturer's productivity, as will be explained.

For the manufacture of a feed yarn which will subsequently be drawn to a lower denier, such as in high speed draw-texturing, the feed yarn denier (Denier)f, is dependent on the desired final draw textured denier, (Denier)t, and the residual elongation-to-break left in the drawn yarn. The textured yarn denier (Denier)t is determined by the throwsters' customers and may vary for fashion and function reasons. Also, the final yarn properties of the textured yarn, such as modulus, breaking strength, and to some extent bulk, are determined by the textured yarn elongation-to-break ($E_b$)t which is usually on the order of 25–35%, preferably 28–32%, and is considered as a product specification that the fiber producer needs to provide a feed yarn to meet. Therefore, it will be understood why an increase in the elongation-to-break of the feed yarns ($E_b$)f of the invention is advantageous from a throwster's productivity standpoint.

As will be shown in Example I, including amounts of nylon 6 comonomer (capable of hydrogen-bonding with the nylon 66 polymer, i.e. caprolactam) in the polymer has the surprising advantages that this can not only increase the elongation-to-break of the nylon 66 feed yarn, but, for a given elongation-to-break ($E_b$)f, also decrease the draw tension (DT), thus making it easier to fully draw the feed yarn at high texturing speeds to the desired final elongations of 25–35% before losing bulk or incurring broken filaments. These results are unexpected, based on the individual behaviors of the corresponding nylon 6 and nylon 66 homopolymers. It is conjectured that the nylon 6 caprolactam incorporated randomly into the high molecular weight nylon 66 polymer chain behaves as a source of metastable hydrogen-bond sites which differ from those of the nylon 66 homopolymer and alter the intercrystalline polymer chain network in such a manner as to increase the network extensionability and decrease the force required for extension.

Figure 14:
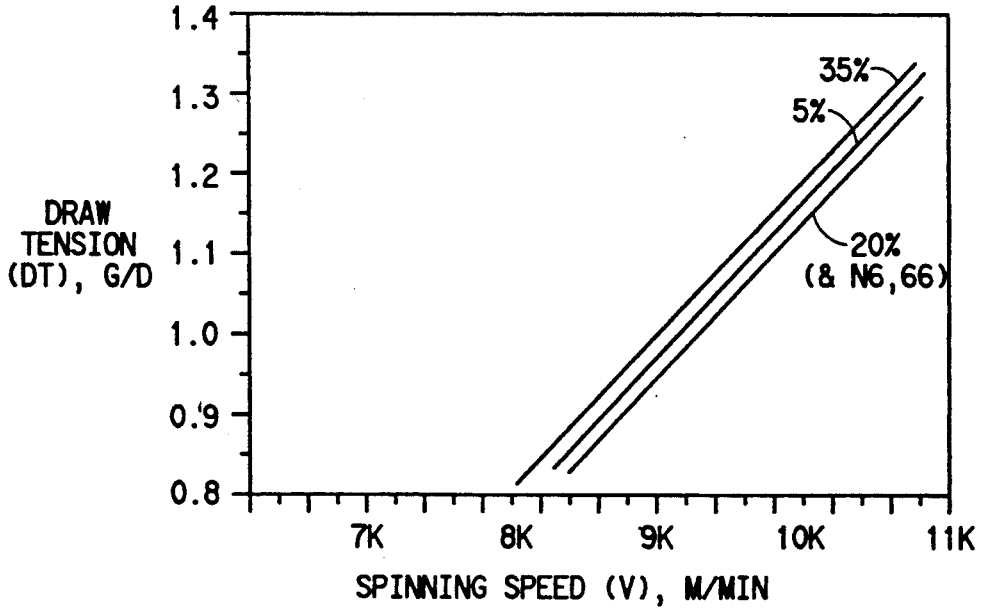

Draw-texturing feed yarns prepared from nylon 66 polymer modified with 2-methylpentamethylene diamine (MPMD) to give Me5–6,66 copolyamide fibers reduce draw tension (DT) at a given spin speed versus that obtainable with nylon 66 homopolymer alone and reduce draw tension (DT) versus N6,66 copolyamides, especially at % concentrations of Me5–6 of about 10% and at lower polymer RV of about 50–60, which is preferred if it is desirable to spin from lower RV to reduce the propensity of oligomer deposition rate with storage time. Since it has been discovered that there is less low molecular polymer (oligomer) in the polymer which is believed to be because MPMD more completely polymerizes with the adipic acid, there are no monomer exhaust difficulties during spinning, as is the case with nylon 6, which permits greater than 10% Me5–6, up to about 20%, when low shrinking textured yarns are desired, or up to about 35–40% when higher shrinking textured yarns are desired, versus the preferred limit of 2–8% for N6 modified nylon 66 yarns. Unlike N6,66, Me5–6,66 yarns do not show an appreciable increase in elongation ($E_b$) for a given draw tension and have a spinning productivity between that obtained for N6,66 and N66 (compare FIGS. 6 and 14). It is believed that, like nylon 6, the incorporation of Me5–6 into the N66 polymer, disrupts the hydrogen-bond sites and reduces the draw tension under equivalent spinning conditions versus nylon 66 and nylon 6 homopolymers. Both N6 and Me5–6 modified N66 yarns have enhanced dyeability which is believed to be associated with a more accessible intercrystalline region having enhanced extensionability permitting improved texturability at speeds greater than 1000 mpm.

This new structure is a preferred structure for high speed draw-texturing. For its formation, it is also preferred to control the spinning process conditions, that is, control and provide proper balance of the extent and rate of attenuation and the rate of quenching during reduction of the filament's denier during spinning prior to neckdown.

Further, increasing the feed yarn elongation ($E_b$)f is not alone sufficient to increase productivity. If the texturer is unable to fully draw the feed yarn because of high draw tensions, then the higher elongation of the feed yarn can not be fully utilized as the texturer will require a lower feed yarn denier to obtain the desired final textured yarn denier since the feed yarn must be drawn with a higher residual elongation ($E_b$)t.

A further advantage of the new feed yarns is the capability to increase the productivity of the texturer by providing a feed yarn that can be drawn to the required final denier at higher texturing speeds and provide bulky yarns.

Such advantages can flow from the data in the following Examples, and it will be apparent that advantages will be obtained in drawing processes other than draw-texturing, such as warp-drawing. Draw air-jet texturing can also be advantageously performed using feed yarns in accordance with the invention.

The invention is further illustrated in the following Examples; all parts and percentages are by weight.

EXAMPLE 1

Several draw-texturing feed yarns were prepared using the process and apparatus that is schematically illustrated and has been described hereinbefore under the conditions indicated in Table I to give the indicated yarn properties, i.e., draw tensions (DT) and elongations ($E_b$). Examples I-1 through I-24 and I-47 through I-92 shows feed yarns that are nominally of 53 denier (13 filaments) for texturing to provide hosiery welt yarns (with 0.3% $TiO_2$), while examples I-25 through I-46 shows feed yarns that are nominally of 25 denier (7 filaments) for texturing to provide hosiery leg yarns (with 0.08% $TiO_2$). The measured deniers are given in the second column and the spinning speeds (referred to herein as V) in the third column. The fourth column gives the "N6%", i.e. the weight content of N6 monomer.

Comparison yarns I-1C to I-12C, I-39C to I-46C, and I-63C to I-92C of N66 homopolymer are not according to the invention; this is indicated by their letter C in the first column to distinguish from the feed yarns according to the invention, namely I-13 to I-38 and I-47 to I-62, mostly containing 5% N6 whereas, I-25 to I-28 contain only 2.5%. Items I-52C-54C and I-59C-60C which contain 5% N6 are not according to the preferred invention since their draw tension (DT) and elongations ($E_b$) are not suitable for high speed texturing, but are suitable for slow speed draw texturing, air-jet texturing, and other drawing textile processes, e.g., draw beaming. The next three columns show RV values for the starting polymer flake, for the yarn, and for the increase between these RV values (Δ RV), while decreases are given in parentheses. The final two columns show the draw tensions (DT in grams/denier) and the elongations ($E_b$ %), and will be discussed as the results were not expected. All the filaments were of round cross-sections, using spinneret capillaries of 10 mils diameter D (=0.254 mm) and of L/D ratio=1.9 (i.e., length 19 mils), except for I-20 and I-21 where the diameter was 9 mils (=0.229 mm). The quench air was provided at 21° C., 75% RH by cross-flow at a transverse velocity of 18 mpm over a distance of about 100 cm. The filaments were converged by using a metered finish tip applicator at a convergence length $L_c$=135 cm, except that I-18, I-20, I-21, I-52, I-53, I-59, I-71, and I-77 used 122 cm, and I-11C, I-19 and I-38 used 140 cm. The spin finish level (FOY) was nominally 0.45%. The nominal interlace was about 12.5 cm.

Comparative draw-texturing welt feed yarns of 100% nylon 6 (N6) homopolymer were spun from a starting polymer of nominal 36.4 RV (containing 0.3% TiO2) with the RV raised prior to extrusion via a SPP to a range of RV of 47.7 to 72.2, extruded through 0.254 mm capillary spinnerets of a 1.9 L/D-ratio at a polymer temperature of 275° C., quenched with 75% RH room temperature air at a flow rate of 18 mpm and converged via a metered finish tip applicator at 135 cm, and spun over a spin speed range of 4300 to 5800 mpm to give 13-filament yarns of nominal 52 denier. The denier, spin speed, yarn RV, draw tension (DT), and elongations ($E_b$) for the N6 homopolymer comparative yarns are summarized in Table VII.

EXAMPLE 2

Following an essentially similar technique as in Example 1, welt yarns of this invention were made with varying spinning process conditions summarized in Table II to illustrate the unexpected effects on the yarn draw tension (DT) of melt rheology and heat transfer during the attenuation. This shows how to achieve the desired lower draw tension (with the desired elongation) during formation of the fiber structure, that is, controlling polymer chain orientation, extension, and crystallization to take full advantage of the unexpected capabilities of the invention. Nominal 53 denier yarns (13-filament, round cross-section, containing 0.3% $TiO_2$) were spun at 5300 meters per minute. It is observed that decreasing the melt viscosity ($\eta$m) by increasing the polymer temperature (Tp), increasing the spinneret capillary extrusion velocity (Vo) by going to small spinneret capillary diameters (D), and increasing the capillary pressure drop ($\Delta P_c$) by increasing the spinneret capillary L/D4 ratio, decreases draw tension (DT) which is the opposite response by decreasing the melt viscosity ($\eta$m) by decreasing the polymer relative viscosity (RV). In contrast, decreasing the extensional viscosity ($\eta$E) of the freshly extruded filaments by decreasing quench air flow rate, increasing quench air temperature, and use of delay quench, for example, increases draw tension (DT). Further, it is shown by Ex. II-20 and II-21 that by increasing the polymer RV partially in the melt extrusion system following the SPP, decreases the draw tension (DT) for a given final yarn RV (wherein in II-20 the increase in the polymer RV was achieved fully via the SPP; i.e., supply flake RV of 39.0—>SPP flake RV, and in II-21 the increase in the yarn RV was achieved only partially via the SPP and completed in the melt transfer system; i.e., supply flake RV of 39.0—>SPP flake RV of 62.3—>extruded melt/yarn RV of 67.3). Coupling these different draw tension process responses permits reducing draw tension independently of polymer RV and spin speeds (V) which is not taught by Chamberlin et al in U.S. Pat. No. 4,583,357.

EXAMPLE 3

Using the process of Example 1, yarns of this invention having a dpf range of 1 to 7 were made as shown in Table III. Higher dpfs can be made with equipment having a larger polymer supply rate than used in this Example. There appears to be a change in yarn properties for yarns of dpf greater than 2, wherein DT is less and elongation is greater than for yarns of dpf of less than 2.

These yarns were spun from a 41.6 RV supply flake containing 0.3% $TiO_2$. Flake RV was raised via an SPP to yarn RV of 63.9 and extruded at 293° C. from 13 hole capillary spinnerets with L/D-ratios of 1.9 and rapidly quenched with cross flow air at 21° C./75% RH/18.3 meters/minute over a distance of 113.7 cm and converged at 122 cm via a metered finish tip applicator and wound up at 5300 meters/minute.

For this Example, the draw tensions were not measured at 185° C., but at room temperature, which is why the * is shown at the top of the DT* column in Table III.

EXAMPLE 4

Figure 7:
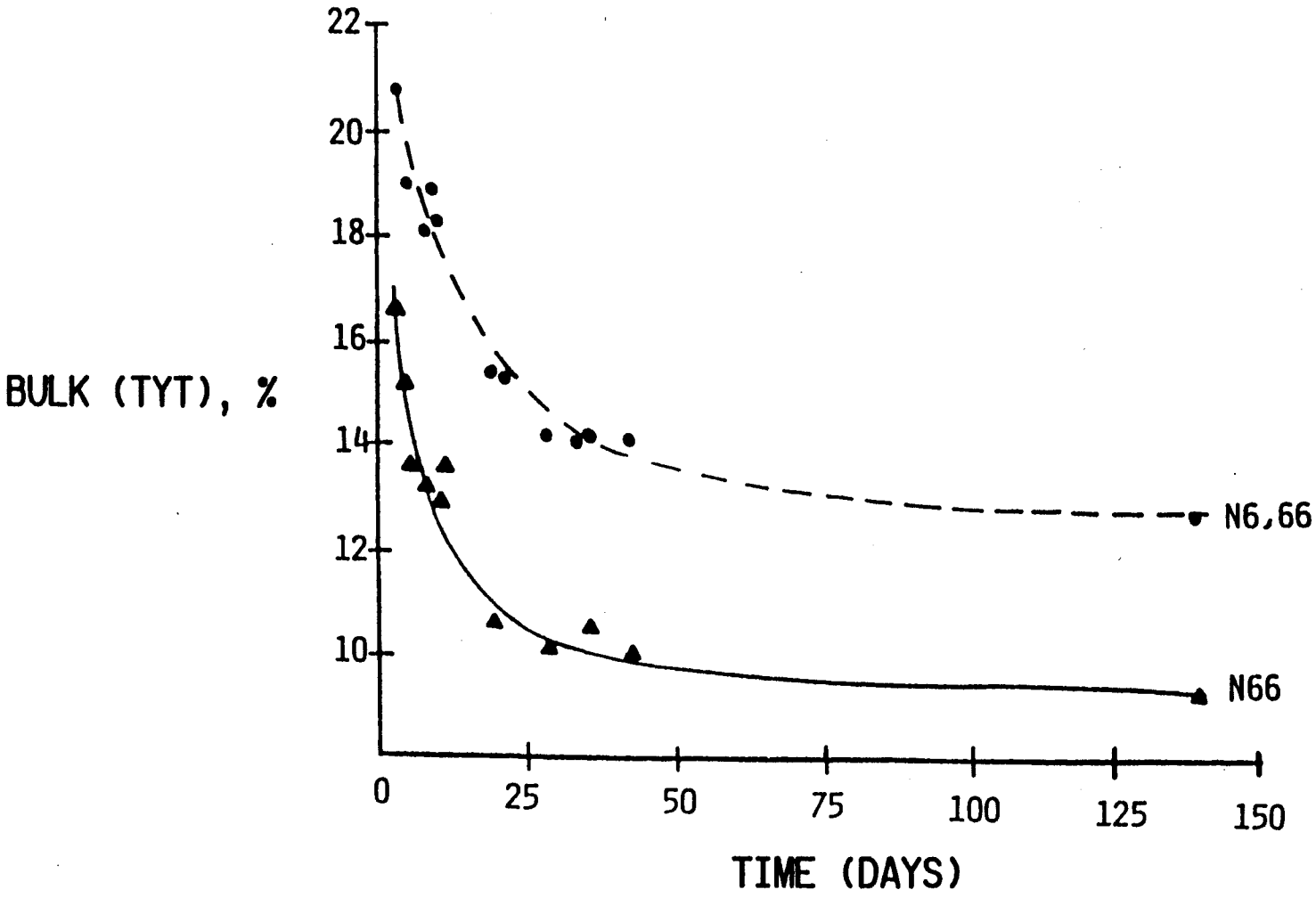

This example compares commercial slow speed spun hosiery leg feed yarns of nominal 45 RV nylon 66 (N66) homopolymer and leg feed yarns of the invention (I-38) spun at 5300 meters per minute from nominal 68 RV nylon 6,66 (N6,66) copolymer that were textured at 800 meters per minute on a Barmag FK6-L10 (bent configuration) with a 1-4-1 P101 disc stack arrangement, a heater plate temperature of 210° C., a texturing draw ratio (TDR) of 1.3287 and a D/Y-ratio of 2.04. The textured yarn bulk measured by the Lawson-Hemphill TYT was found to decrease, as expected, for both the textured control yarns and the textured yarns of the invention with storage time after texturing reaching a stable bulk level after about 30–45 days (see FIG. 7). The textured yarns of the invention had higher bulk levels than that of the textured control yarns permitting the yarns of the invention to be textured at higher texturing speeds ($V_T$) and provide acceptable bulk levels which was not possible with the control homopolymer yarns.

EXAMPLE 5

Figure 9:
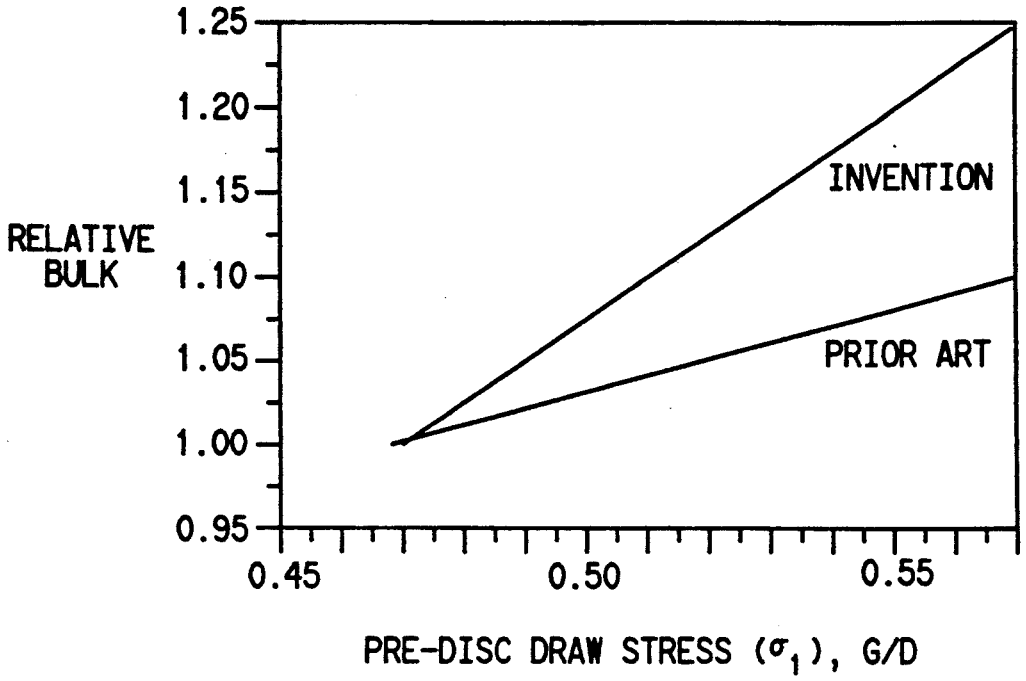

This example compares commercial slow speed spun hosiery welt feed yarns of nominal 45 RV nylon 66 (N66) homopolymer and welt feed yarns of the invention (II-9) spun at 5300 meters per minute from nominal 68 RV nylon 6,66 (N6,66) copolymer that were textured at 900 meters per minute on a Barmag FK6-L10 (bent configuration) with a 3-4-1 CPU disc stack arrangement and a heater plate temperature of 210°, 220°, and 230° C. The texturing draw ratio (TDR) was varied from from 1.3287 to 1.4228 and the D/Y-ratio was varied from 1.87 to 2.62. The yarns of this invention (II-9) had similar pre-disc stress ($\sigma_1$) [$\sigma_1$=($T_1$, g/d)×TDR] and slightly lower texturing draw modulus ($M_{D,T}$) [$M_{D,T=\Delta T1}/\Delta T_1 \Delta TDR$] than the control homopolymer yarn over the entire range of D/Y-ratios (see FIG. 9, wherein texturing draw stress $\Gamma_1$ at 220° C. is plotted versus TDR for 1.87, 2.04, 2.45 and 2.62 D/Y-ratio). The textured yarn bulk was found to increase with texturing draw stress ($\sigma_1$), texturing temperature, and D/Y-ratio for both the control yarn and for the yarn of the invention; however, the bulk of the textured yarn of the invention (II-9) was greater than that of the control yarn for a given. texturing draw stress ($\sigma_1$) for $\sigma_1$-values greater than about 0.475 G/D (see FIG. 7, wherein the textured yarn bulk measured by the Lawson-Hemphill TYT, is expressed as ratio of the measured TYT bulk of the given textured yarn to that of the textured control yarn at a nominal $\sigma_1$-level of 0.475 G/D). The higher bulk for the yarn of the invention permits the throwster to increase the texturing speed to greater than 1000 mpm and obtain the same bulk levels at the slower texturing speeds of 800–900 mpm. This cannot be done with the conventional slow speed spun homopolymer feed yarns.

EXAMPLE 6

This example compares the texturing performances of hosiery leg feed yarns spun at 5300 meters/minute from polymers of nominal 64 RV when textured at 900 mpm with a heater at 210° C. on a Barmag FK6L10 machine with 1-4-1 P101 Friction disc stack arrangement using 2 different D/Y ratios of 2.04 and 2.62, and 6 different Texturing Draw Ratios (TDR) from 1.2727 to 1.3962. The feed yarns of the invention were I-37 and were compared with comparison homopolymer N66 feed yarns I-46C from Table 1. Each pre-disc draw stress ($\sigma_1$) given in Table IV was calculated as the pre-disc tension ($T_1$) in grams, divided by the original feed yarn denier, and multiplied by the Texturing Draw Ratio (TDR). It will be noted from Table IV that the feed yarns of the invention were textured with significantly lower pre-disc draw stresses. The texturing draw modulus ($M_{D,T}$) change in $\sigma_1$ with change in TDR) is also typically lower.

EXAMPLE 7

Figure 10:
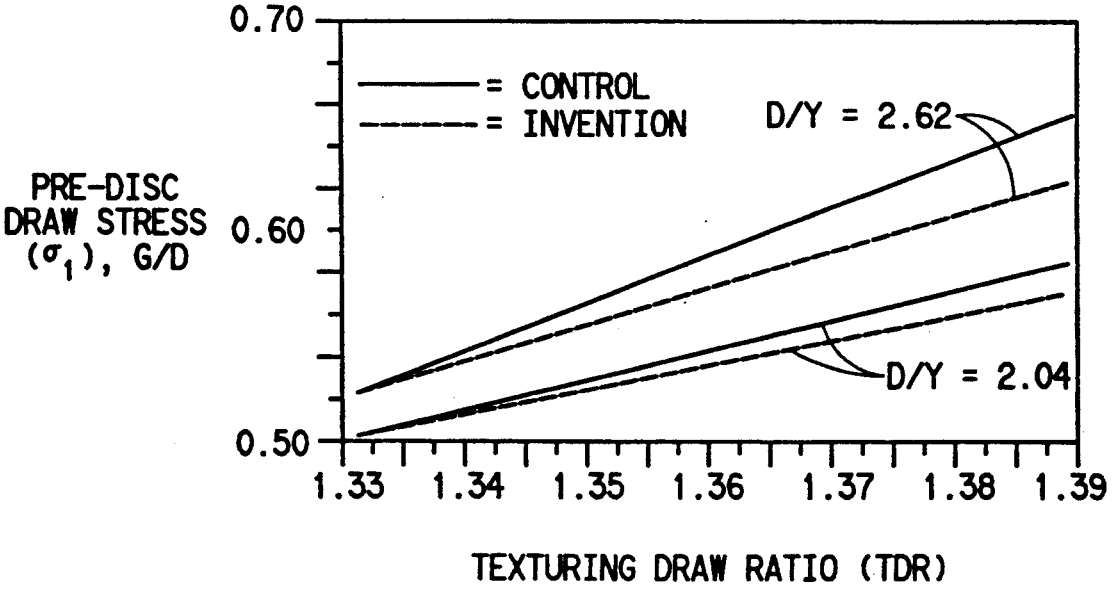

This example compares hosiery welt feed yarns spun at 5300 meters per minute from nominal 66 RV nylon 66 (N66) homopolymer (I-11C) and welt feed yarns of the invention (II-9) spun from nominal 68 RV nylon 6,66 (N6,66) copolymer that were textured at 900 meters per minute on a Barmag FK6-L10 (bent configuration) with a 3-4-1 CPU disc stack arrangement, a heater plate temperature of 220° C. The texturing draw ratio (TDR) was varied from 1.333 to 1.3962 and the D/Y-ratio was varied from 2.04 to 2.62. The yarns of this invention (II-9) has lower pre-disc stress ($\sigma_1$) and typically lower texturing draw modulus ($M_{D,T}$) than the control homopolymer yarn (I-11C) at both low (2.04) and high (2.62) D/Y-ratios, and provided a larger reduction in the T2/T1-ratio for a change in D/Y-ratio, as expressed by: $\Delta$(T2/T1)/$\Delta$(D/Y-ratio), (see FIG. 10, wherein $\sigma_1$ is plotted versus TDR for 2.04 and for 2.62 D/Y-ratio for yarns I-11C and II-9).

EXAMPLE 8

Various hosiery feed yarns spun at 5300 mpm were processed at 1100 mpm and 220° C. on a Barmag FK6L10 texturing machine using a bent configuration to compare the performances of yarns of this invention with comparison homopolymer nylon 66 yarns. The yarns of this invention could be textured over a wider range of draw ratios and D/Y ratios than was possible for the homopolymer comparisons.

Leg - for the leg yarns, the feed yarns were of 66 RV and a Bent configuration with a 1-4-1 P101 disc stack arrangement was used with 2 different D/Y ratios (of 2.45 and 2.04) at 220° C. (and 1100 mpm). The feed yarns of the invention ran well under all the conditions mentioned at a 1.328X draw ratio; the comparison homopolymer also ran at the D/Y ratio of 2.45, but was unstable at the D/Y ratio of 2.04. At a 1.378X draw ratio, the feed yarns of the invention ran better than the comparison homopolymer at both D/Y ratios. At the higher draw ratio of 1.396X, only the feed yarns of the invention ran, whereas the homopolymer comparison could not be processed satisfactorily.

Welt - for the welt yarns, the homopolymer comparison was of higher RV (66) then the yarn of the invention (only 63 RV). The yarns were textured (at 1100 mpm) using a Bent configuration and at 3-4-1 CPU disc stack arrangement. Using a 2.24 D/Y ratio, both yarns ran at draw ratios of 1.298 X and 1.3475X; as the draw ratio was increased to a higher draw ratio of 1.359 X, the feed yarn of the invention ran better than the homopolymer comparison, while at still higher ratios (1.378X and 1.396X) only the feed yarns of the invention could be processed, but the homopolymer comparison did not run. At a D/Y ratio of 2.45, both yarns again ran at a 1.298X draw ratio, then at 1.359X the feed yarn of the invention ran better, and at 1.396X only the feed yarn of the invention could be processed (not the homopolymer). At a D/Y ratio of 2.04, the yarn of the invention ran better than the homopolymer comparison at a draw ratio of 1.298X.

EXAMPLE 9

In this example the leg feed yarn of the invention (I-37) was successfully textured on a full commercial scale texturing machine at a nominal break level of 0.06 per pound at 1000 meters per minute on a Barmag FK6-S12 (inline configuration) with a 1-5-1 P101 disc stack arrangement, a heater plate temperature of 215° C., a texturing draw ratio (TDR) of 1.30 and a D/Y-ratio of 2.42 with a $\sigma_1$ of 0.42 g/d. The textured yarns were knitted into hosiery at a speed of 1500 RPM, the speed limit of current commercial knitting machines. This texturing and knitting performance has not been achieved by prior art homopolymer or copolymer yarns.

To summarize the foregoing, Examples 1–3 describe the preparation of draw-texturing feed yarns from comparison homopolymer nylon 66 (N66), comparison homopolymer nylon 6 (N6), and yarns of the invention (N6,66 from nylon 66 modified by contents of nylon 6 monomer), while Examples 4–9 illustrate the improved draw-texturing performance of some of these feed yarns of the invention at 900 and 1100 mpm, and demonstrate the wider range of texturing conditions, i.e. the larger texturing window that is opened by use of these new feed yarns; this provides the commercial texturer (who realistically cannot in practice operate within too restricted a window) with an opportunity to use higher speeds for texturing to provide the desired bulky yarns. The behavior of the new (N6,66) yarns and the differences from N66 yarns are significant and unexpected as will be discussed.

Chamberlin says (his Example 6) that high RV nylon 6 is not as improved as nylon 66, and provides data for nylon 6 even up to an RV of 100+.

Our researches have shown that the properties of N6,66 feed yarns are significantly different from N66 in unexpected ways that could account for the significant improvements in performance (as draw-texturing feed yarns, and these improvement are expected to be reflected also in better performance for other purposes, e.g. other drawing processes, especially warp-drawing, sometimes referred to as draw-beaming or draw-warping).

As can be seen from Table I, the elongation ($E_b$) of N66 fibers increases with increasing yarn RV at high spinning speeds, and similarly from Table VII, the elongation ($E_b$) of N6 fibers increases with increasing yarn RV at high spinning speeds. Combining the data from Table I for N66 homopolymer and from Table VII for N6 homopolymer did not indicate that incorporating small amounts of nylon 6 monomer would further increase the $E_b$ of N66 at a given spin speed and RV. The properties might have been expected to have shifted towards those of nylon 6 homopolymer, that is to lower $E_b$ and to higher DT (see FIG. 4 wherein draw tension, DT, is plotted versus yarn RV for N6, N66, and N6,66 containing 5% N6 monomer spun at 5300 meters per minute; and see FIG. 5 wherein minimum draw tension, (DT)min, for a given spin speed and the corresponding $E_b$ are plotted versus spin speed for N6, N66, and N6,66 containing 5% nylon 6 monomer).

Figure 4:
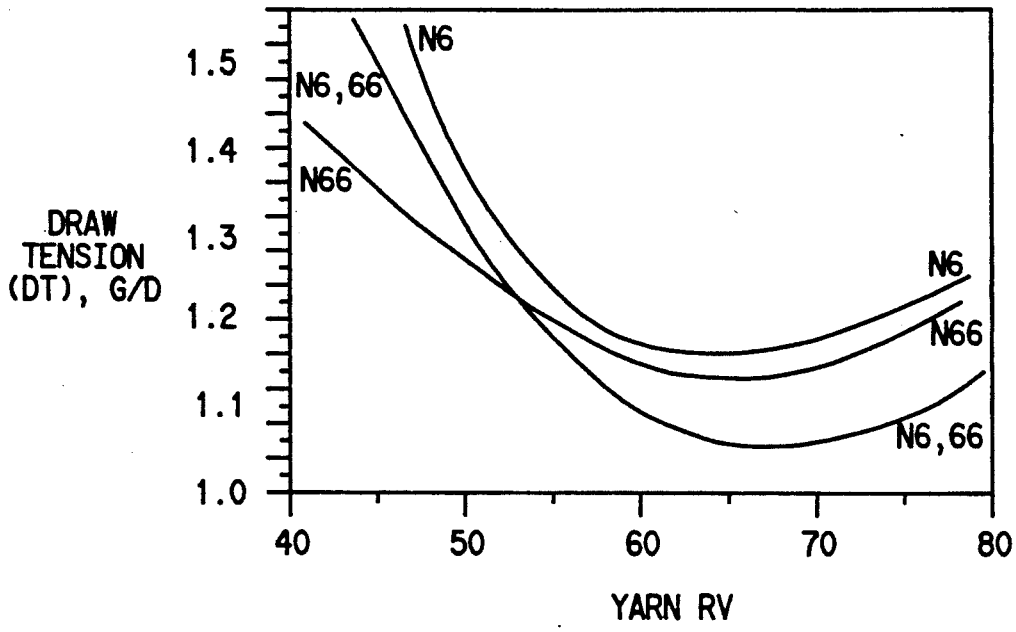
FIGS. 4 through 22 are graphs to illustrate differences between properties of yarns according to the invention (N6,66 and Me5-6,66), homopolymer nylon 66 yarns (N66), and homopolymer nylon 6 yarns (N6), as described more particularly hereinafter.

The draw tensions (DT) are shown in FIG. 4 versus yarn RV for N6, N66, and N6,66 yarns spun at 5300 mpm. Several things will be noted from FIG. 4. First, these draw tensions (DT) decrease with increasing polymer RV; this much is consistent with increasing elongations. Secondly, the draw tensions of N6 are higher than those of N66. Thirdly, however, although at lower polymer RVs (of less than about 50) the N6,66 yarns had higher draw tensions than N66, the draw tension for N6,66 becomes lower than both N6 and N66 when the RVs are increased to more than about 50 (for yarn spun at speeds greater than about 4500 mpm). Although these copolymer yarns made at RVs between about 40 and 50 have high draw tensions, making them less desirable for draw texturing, these high draw tension copolymer yarns are found suitable as direct-use yarns especially critical dye end uses, such as warp knits for swimwear. Low RV copolymer yarns having draw tensions greater than about 1.4 g/d with elongations ($E_B$) between about 45% and 65% are preferred for direct-use, i.e. are useful without need for additional drawing or heat setting.

In other words, there is a surprising reversal in behavior at an RV of about 50, when an advantageously lower draw tension for the N6,66 versus that of N66 starts to appear in these high speed spun yarns. The extent of this reduction in draw tension at a given spin speed and polymer RV increases with the amount of nylon 6 monomer that is incorporated. More than about 8-10% by weight is not considered a practical route to further reductions in draw tension (unless one could solve the manufacturing problems of removing nylon 6 vapor on extrusion).

Figure 5:
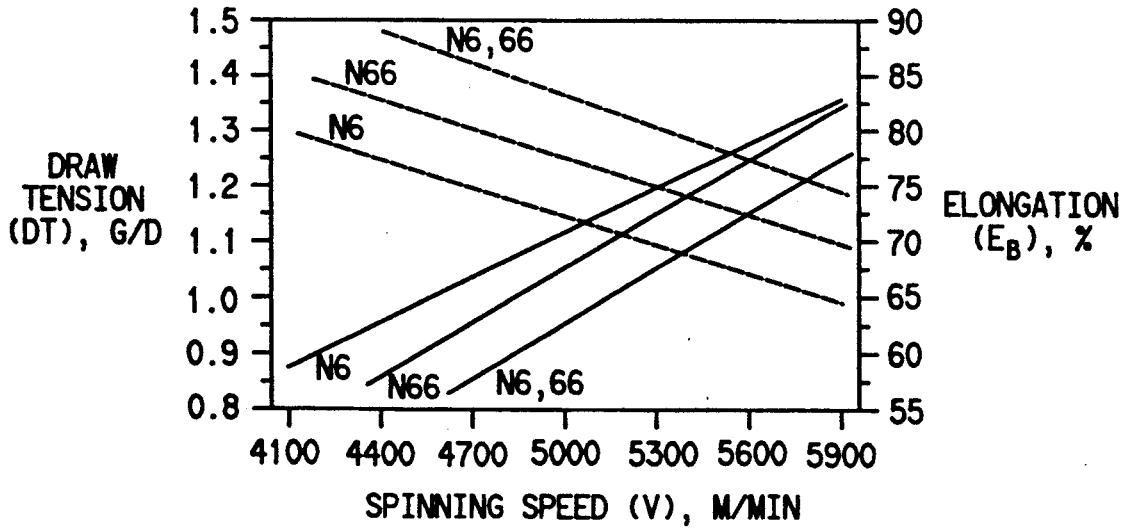

The different combinations of lower draw tension with higher elongations at various spin speeds are plotted in FIG. 5. For a given spin speed, the elongations increase from N6 to N66 to N6,66; and correspondingly, the draw tensions for a given spin speed decrease from N6 to N66 to N6,66 over the RV range of 50 to 80. The combination of higher elongation and lower draw tension for a given spin speed for the N6,66 yarns of the invention provide improved spinning productivity ($P_s$), expressed by the product of the spin speed (V) and the residual draw ratio (RDR) of the feed yarn, wherein the RDR is defined by the expression $[(100+E_b)/100]$; i.e., $P_s = V \times RDR$. The addition of the minor amounts of nylon 6 provides for improved spinning productivity ($P_s$) as expressed by $P_s > 8000$ with a DT in g/d of about 0.8 to about 1.2 g/d and less than about the expression $[(V \times RDR)/5000 - 0.8]$, (shown as the dashed line ABC in FIG. 6).

Figure 6:
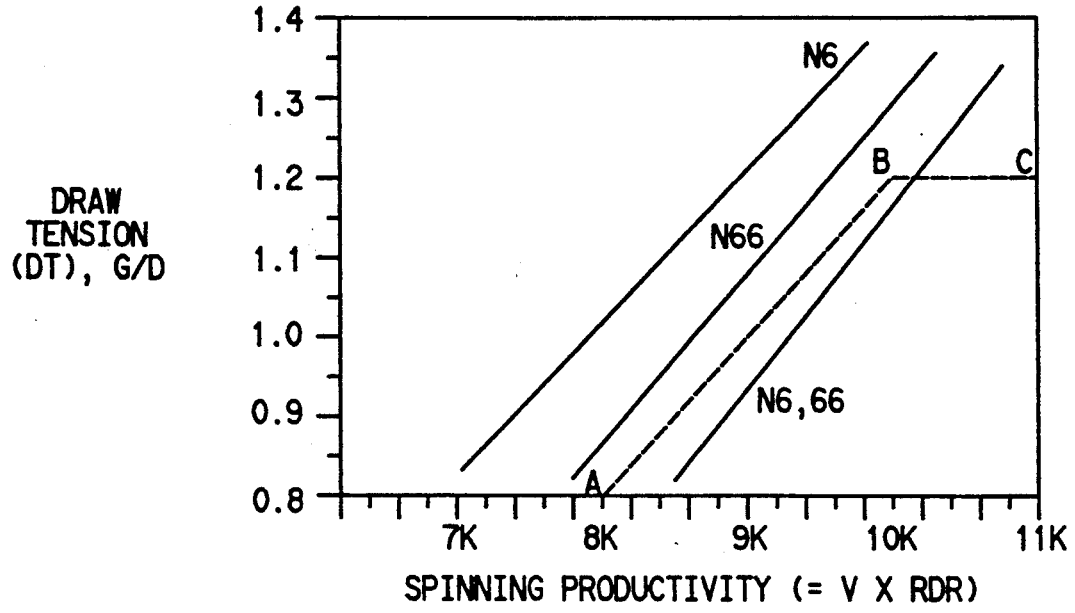
Figure 8:
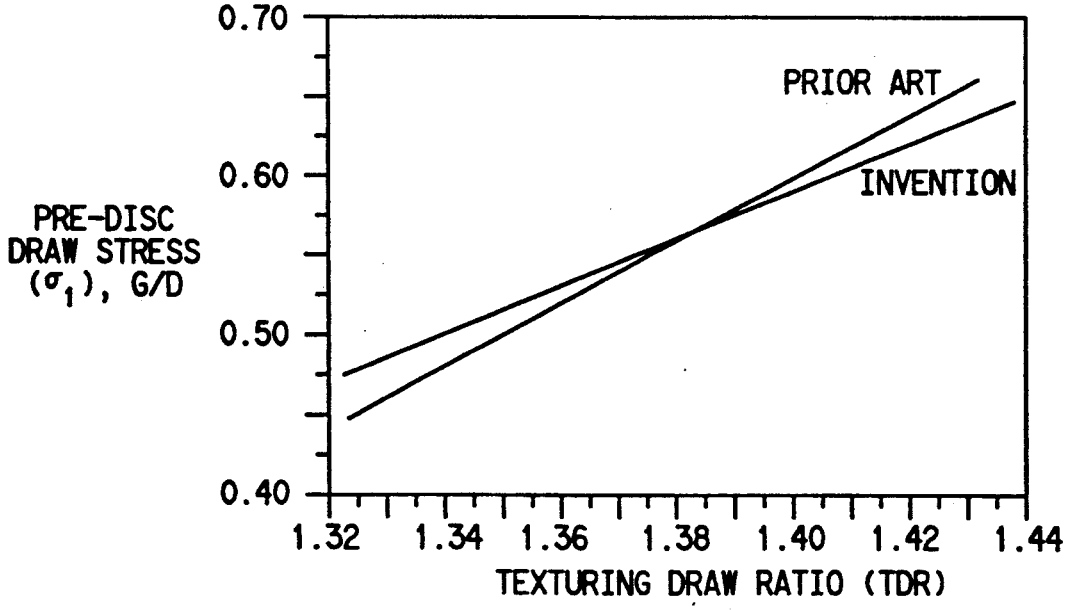
Figure 22:
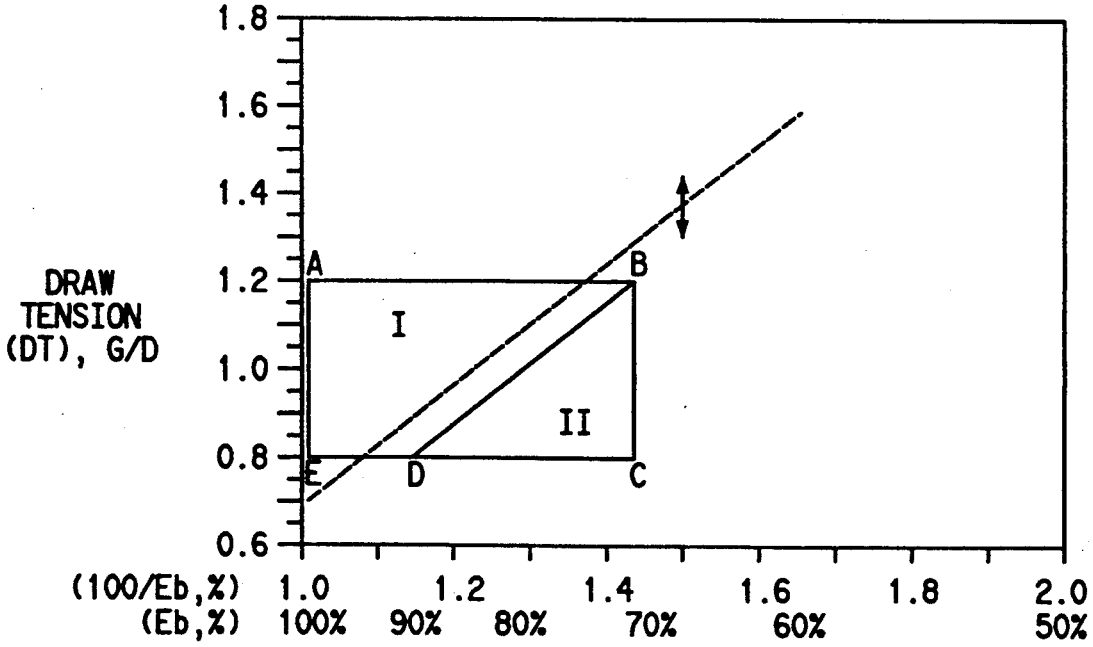

When FIGS. 4-6 are considered together, it seems clear that the N6,66 polymer has provided novel yarns with improved balance of properties of a draw tension (DT) less than about 1.2 g/d and an elongation ($E_b$) of greater than about 70%, preferably, in addition the lower limit of DT, $g/d > (140/E_B) - 0.8$ as represented by Area I (ABDE) in FIG. 22, by spinning at speeds greater than 4500 mpm, such polymers having an RV of at least about 50 and containing minor amounts of about 2-8% by weight of nylon 6 monomer. Example 2 has shown that the effect of carefully selected process conditions, such as Tp, spinneret capillary D, L/D, and $L/D^4$ and quenching. When the downstream effect of the higher draw tensions for the N6 and N66 homopolymer feed yarns is considered, the higher draw tensions prevent the complete drawing of the N6 and N66 homopolymer feed yarns to the desired residual elongation of less than about 35%, preferably about 30% or less.

As indicated in the texturing comparisons (Examples 4 to 9), the N6,66 feed yarns of this invention in general provided a lower pre-disc texturing draw stress ($\sigma_1$) which was less sensitive to small changes in texturing draw ratio, i.e., lower texturing draw modulus ($M_{D,T}$). The feed yarns have an analogous thermomechanical behavior as discussed further in Example 16.

EXAMPLE 10

In this example draw-texturing feed yarns were prepared from nylon 66 polymer modified with 2-methylpentamethylene diamine (MPMD) to give copolyamide fibers herein referred to as Me5-6,66 with the 2-methylpentamethylene adipamide (the unit formed by MPMD and adipic acid hereinafter referred to as Me5-6) concentration ranging from 5 to 35% by weight. Like nylon 6 monomer, Me5-6 in the polymer is capable of hydrogen bonding with the nylon 66 polymer to form a nylon 66 copolyamide with a modified hydrogen-bonded structure which provides lower draw tension (DT) yarns spun at speeds greater than about 4500 mpm from 50 to 80 RV copolymer. The Me5-6 depresses the melting point (Tm) of the copolymer by approximately 1 degree centigrade per 1 weight % of Me5-6; e.g., nylon 66 homopolymer has a Tm of about 262° C. while a 10/90 Me5-6,66 copolymer has a Tm of about 253° C. and a 40/60 Me5-6,66 copolymer has a Tm of about 221° C.; hence, it is desirable to lower the spin temperature (Tp) to maintain a spin temperature (Tp) from about 20° C. to about 60° C. higher than the Tm of the copolymer; i.e., $(Tp - Tm) = 20°$ to 60° C. For example, when spinning 5/95 Me5-6,66 a Tp of 290° C. was used and when spinning a 35/65 Me5-6,66 a Tp of 275° C. was used.

Figure 11:
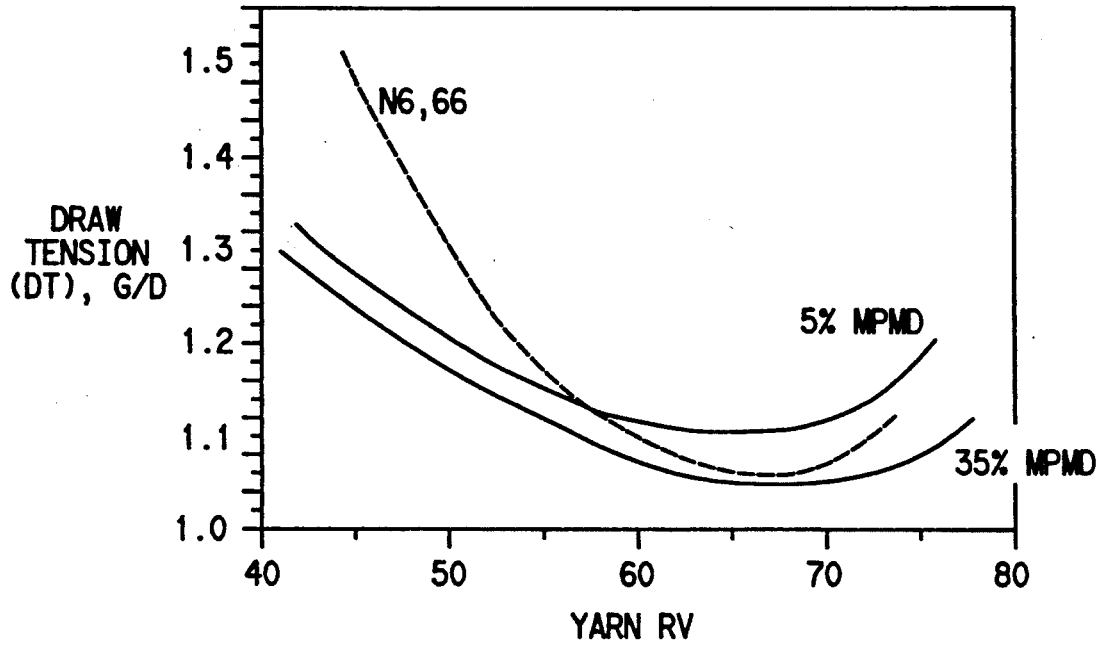
Figure 13:
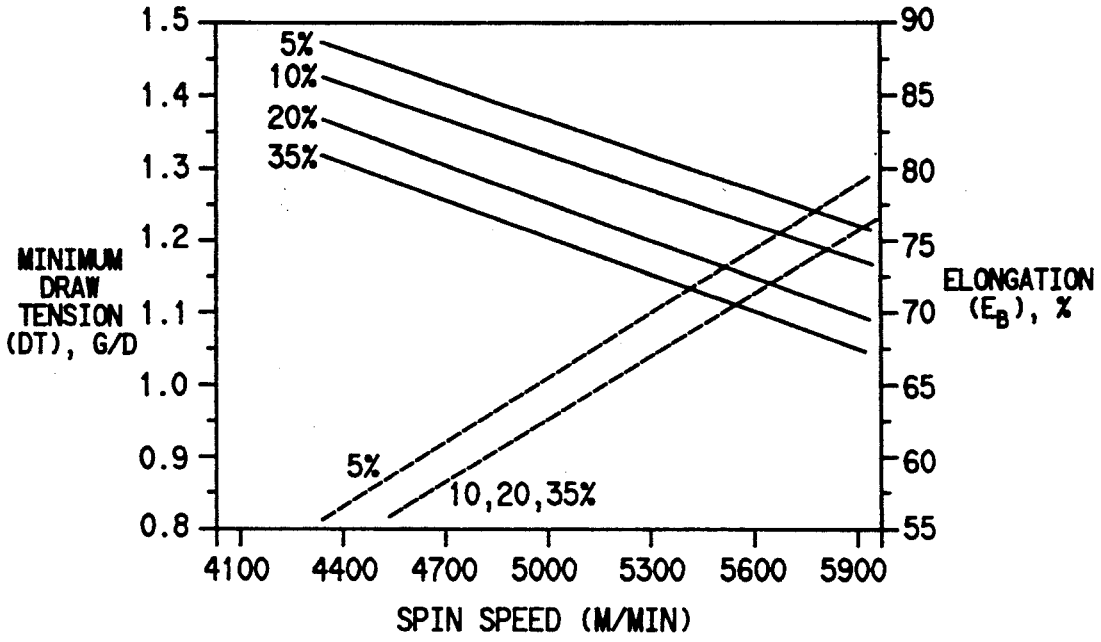

In Table VIII the spinning and property data are summarized for yarns spun with 5%, 10%, 20%, and 35% Me5-6 over a spin speed range of 4500 to 5900 mpm and from copolymer of about 40 to about 70 RV with 0.3% Ti02. The starting polymer RV was about 46.5, 39.3, 33.1, and 35.0 for copolymers containing 5%, 10%, 20%, and 35% Me5-6, respectively. Nominal 53 denier 13-filament yarns were spun with about 0.45% FOY and 12.5 cm interlace for high speed draw-texturing. Higher FOY and interlace levels would be used if these MPMD POY were spun for evaluation as a draw beaming feed yarn. The filaments were extruded through spinneret capillaries of 0.254 mm diameter with a 1.9 L/D-ratio and quenched with 75% RH room temperature air at 18 mpm crossflow and converged by a metered finish tip applicator at 135 cm. Similarly to 6,66 copolymer, Me5-6,66 copolymer gave lower draw tension for a given polymer RV and spin speed than 66 homopolymer (compare FIGS. 4 and 5 to FIGS. 11 and 13). Also, in a similar manner, the draw tension for Me5-6 modified 66 decreased with increasing polymer RV up to about 70 RV and the draw tension decreased further with added Me5-6 (see FIGS. 11 and 13). However, unlike nylon 6 modified 66, Me5-6 modified 66 provided for lower draw tensions than 66 homopolymer even at polymer RVs of less than 50 (compare FIGS. 4 and 11). From FIG. 11 it is found that nylon 6 modified 66 gives lower draw tensions than 5% Me5-6 modified 66 over the RV range of about 60 to 80, while being less than 6,66 at RV less than about 60. If the amount of Me5-6 is increased to about 10%, then the draw tension is reduced to less than those obtained with nylon 6 modified 66 over the entire RV range investigated of about 40 to about 70.

Even though the draw tension for Me5-6 copolymers at say 55 RV is higher than at 65 RV, it may be advantageous to texture with the combination of higher draw tension and lower yarn RV. It is found that the high RV homopolymer and copolymer yarns may exhibit an oligomer type deposition problem after 120 and 90 days storage, respectively. The deposition of oligomers occurs on the creel guide surfaces causing an increase in creel-induced texturing tensions and eventually a deterioration in texturing performance. The onset of deposition increases with yarn RV and with copolymer content. In normal feed yarn to textured yarn production time spans, this deposit problem may not be observed. However, if storage of longer than about 60 days is required prior to texturing, than it is advantageous to spin slightly lower RV yarns of about 50 to 60 RV versus 60 to 70 RV and adjust process variables as discussed in Example II to minimize draw tension at these lower RV values. The Me5-6 modified 66 copolymers offer the advantage over the nylon 6 modified 66 copolymers by providing lower draw tensions at the lower RV range of 50 to 60 and hence are preferred when lower yarn RV is desirable.

Figure 12:
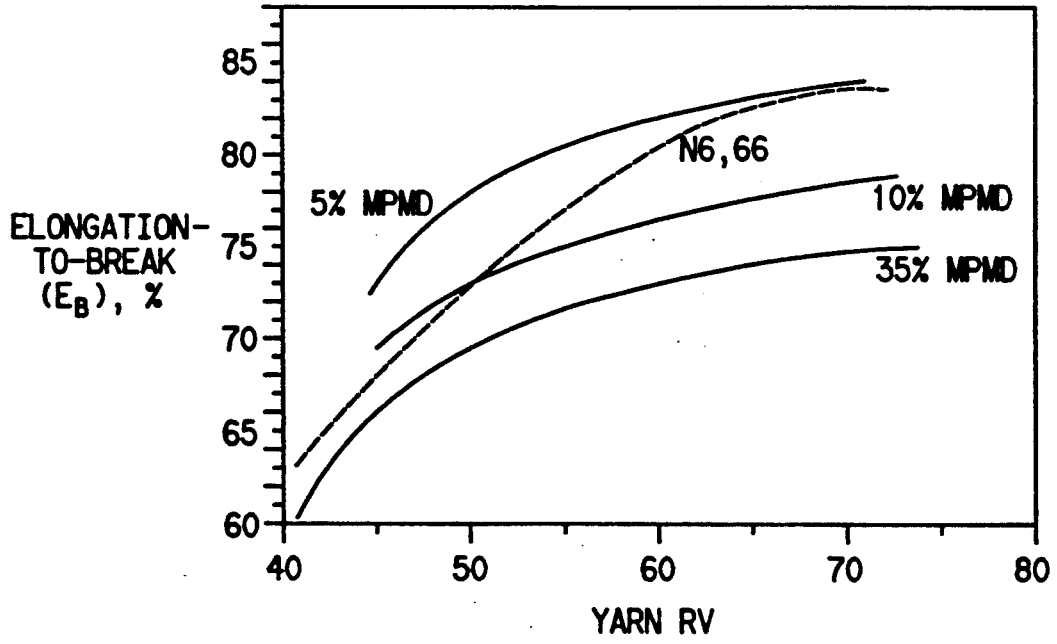

In FIG. 12 the elongation ($E_b$) is plotted versus yarn RV for 5%, 10%, and 35% Me5-6 copolymers and 6,66 for comparison. The 5% Me5-6 copolymers have higher elongation then 6,66 over the RV range of 45 to 70, while the copolymers containing greater than 5% Me5-6 gave lower elongations then 6,66. The minimum draw tension (DT)min and corresponding elongation ($E_b$) are plotted in FIG. 13 versus spin speed for the Me5-6 copolymers. From FIG. 13 it is observed that the elongation ($E_b$) decreases with increasing Me5-6 and the corresponding $(DT)_{min}$ also decrease with the $(DT)_{min}$ of copolymers containing more than about 10% being very similar. The combination of lower draw tension and lower elongation for the Me5-6 copolymers provides for spinning productivities greater than for N6 and N66 homopolymers, but equal to or slightly less than the N6,66 copolymer (compare FIGS. 6 and 14). Even less productivity would be provided if RVs less than those giving the minimum draw tension $(DT)_{min}$ were used to take advantage of the combination of low draw tension and low yarn RVs for reduced propensity for oligomer deposition. In selecting a preferred feed yarn for high speed texturing it is the combination of low draw tension, high elongation, spin productivity, and oligomer deposition that must be considered. The preferred combination will depend, for example, on the type of texturing machine guide and disk surfaces and feed yarn storage time prior to texturing. Also, use of spin finishes which act as moisture barriers to inhibit the onset of oligomer deposition may be used so that higher polymer RV may be used to optimize spin productivity.

EXAMPLE 11

In this example a Me5-6,66 copolymer of 66.4 RV containing 5% Me5-6 and 0.3% TiO2 spun at 5300 mpm to give a nominal 51 denier, 13-filament hosiery welt feed yarn with a 1.10 g/d draw tension and a boil-off shrinkage (BOS) of about 4% (Ex. VIII-9) was comparatively textured versus a nominal 50 denier 13-filament hosiery welt feed yarn of 65 RV N66 homopolymer containing 0.3% TiO2 spun at 5300 mpm to give a 1.28 g/d draw tension. The feed yarns were textured on a Barmag FK6-L10 (bent configuration) with a 3-4-1 CPU disk stack arrangement over a range of speeds (800-1000 mpm), temperatures (200°-240° C.), D/Y-ratios (2.290-2.620), and TDRs (1.318-1.378). The predisc texturing stress ($\sigma_1$) is measured in grams per drawn denier [$T_1$/original undrawn denier×TDR] and bulk was measured after equilibration to constant bulk versus time using a Lawson-Hemphill TYT.

The process and product data are summarized in Table VIA for the yarn of the invention and in Table VIB for the control feed yarn wherein the examples are denoted with the letter C for control yarns. The Me-5-6,66 feed yarns provided for lower $\sigma_1$-values at all texturing conditions permitting drawing to higher draw ratios and greater texturing productivity. Under the same texturing speeds and temperatures and comparable $\sigma_1$-values the copolymer and homopolymer textured yarns had essentially the same TYT bulk; and the TYT bulk increased, as expected, with higher $\sigma_1$-values, temperature and decreased with increasing speed; however, the bulk of the Me5-6,N66 yarns did not change significantly with increasing D/Y-ratio (i.e, with decreasing $T_2$/T -ratio), while the bulk of the N66 homopolymer yarns decreased with increasing D/Y-ratio which limits the use of the N66 homopolymer feed yarns in higher speed texturing. Both feed and textured yarns had boil-off and total dry heat set shrinkages after boil-off (HSS/ABO) of less than 8%. The copolymer textured yarns had slightly higher BOS than and similar DHS to than the homopolymer textured yarns.

EXAMPLE 12

In this example a Me5-6,N66 feed yarn of nominal 61 RV containing 35% Me5-6 spun at 5300 mpm with a 12.3% boil-off shrinkage (EX. VIII-58) was textured on a Barmag FK6-L10 (bent configuration) with a 3-4-1 CPU disk stack having a 2.39 D/Y-ratio at 900 mpm, 210° C. and 1.328X TDR with a 7.5% overfeed. The textured Me5-6,N66 yarns had a 15% BOS and a 12.8% total dry heat set shrinkage after boil-off (HSS/ABO) which is significantly greater than for N66 homopolymer feed yarns (I-11C) textured under equivalent conditions giving 4.7% boil-off shrinkage and a 5.7% total dry heat shrinkage after boil-off. Interestingly, these high BOS textured Me5-6, 66 yarns have equivalent DHS, of almost 4%, as measured by the Lawson-Hemphill TYT to that of the textured nylon 66 yarns The higher shrinkage of the textured Me5-6,N66 yarns makes these bulky yarns especially suitable for covering yarns of elastomeric yarns. Also, comingling of low and high shrinkage Me5-6,66 yarns (i.e. as exemplified by low shrinkage Ex. VIII-9 & a high shrinking Ex. VIII-58) prior to texturing would provide a mixed shrinkage potential textured yarn.

EXAMPLE 13

In this example the effect of tension before and after boil-off (i.e., on crimp development and crimp retention) is determined for N6,66 copolymer textured yarns of this invention and for N66 homopolymer textured control yarns. The copolymer and homopolymer feed yarns of Examples II-9 and I-11C were textured on a Barmag FK6-L10 with 3-4-1 CPU disk stack arrangement at 900 mpm and 21° C. using a 1.333X TDR with a 2.24 D/Y-ratio. The textured yarns were permitted to stabilize on the textured yarn package until bulk level did not change with conditioning time, as described in Example IV. The textured yarns were then wound into loops and permitted to relax without tension for 24 hours under controlled 50% RH and 21° C. conditions and divided into three sets (A,B,C); wherein, set A was boiled off per the procedure described herein for BOS; set B was pretensioned under a 0.5 g/d load for 24 hours prior to boil-off; and set C was post treated after boil-off with a 0.5 g/d load for 12 hours. Sets B and C simulate the effects of tension during bulk development in the dyeing and finishing of a textured yarn garment and the effects of tension after bulk development on bulk retention, respectively. The final length changes (shrinkages) for the test and control yarns are: test yarn; Set A -4.0%, Set B - 4.4%, and Set C - 1.5%; control yarn; Set A - 3.0%, Set B - 1.9%, and Set C - 1.0%. The textured yarns of the invention had essentially no loss in bulk development due to pretensioning and less bulk loss due to post treatment than the control N66 homopolymer yarns which is unexpected for nylon 6,66 copolymer yarns based on the greater crimp loss of textured nylon 6 yarns as disclosed by Chamberlin in U.S. Pat. No. 4,583,357.

EXAMPLE 14

In Example I it was shown that the draw tension increases rapidly with decreasing polymer RV below about 50-55 for N6,66 copolymer In this example it is shown that a minor amount of a tri-functional amine (0.037% by weight of tris 2-aminoethylamine) (TREN) reduced the draw tension at high RV, but more significantly, reduced the draw tension at the lower RV range of 40-55 making it possible to achieve an improved balance of low draw tension at lower polymer RV for reduced oligomer deposits. N6,66 copolymer modified with 0.037% tris 2-aminoethylamine of 48.8 and 60.3 RV spun at 5300 mpm using a 0.254 mm spinneret capillary with an L/D-ratio of 1.9 at 290 C and quenched with 75% RH 21 C air at an 18 mpm flow rate and converged at 135 cm using a metered finish tip applicator gave nominal 50 denier 13-filament hosiery welt feed yarns having 0.94 and 0.98 g/d draw tension and 85.1 and 87.6% elongation, respectively.

EXAMPLE 15

In this example the effect of filament spin density, FSD (number of freshly extruded filaments per unit extrusion area), was compared for the N6,66 copolymer and for N66 homopolymer (see Table IX for summary of process and property data). The filament spin density was varied over the range of 0.18/mm$^2$ to 0.91/mm$^2$ corresponding to 7 to 34 filaments per extrusion pack. The draw tensions increased with increasing filament spin density (FSD). This behavior is consistent with the finding that rapid quenching increases the elongation viscosity ($\eta$E) and decreases draw tension for these yarns (see Tables II and X). To minimize draw tension it is preferred to have a filament spin density (FSD) less than about 0.5/mm$^2$. If this is not possible because of hardware restrictions, then it is preferred to increase the rate of quenching by combination of higher air flow rates, lower quench air temperature, and introduction, in a controlled manner, quench air just below the freshly extruded filaments (i.e., less than 10 cm from the spinneret surface).

EXAMPLE 16

In Example 16 the thermalmechanical behavior of feed yarns are characterized by their "hot" stress-strain behavior as expressed by draw stress, $\sigma_D$ (herein defined as draw tension in grams divided by original denier and times the draw ratio; i.e., as grams per drawn denier), versus draw ratio (DR) from room temperature to 175° C. As indicated in the texturing comparisons (Examples 4-9,11), the N6,66 feed yarns of this invention in general provided a lower pre-disc texturing draw stress ($\sigma_1$) which was less sensitive to small changes in texturing draw-ratio, i.e., had a lower texturing draw modulus.. The feed yarns have an analogous thermomechanical behavior and is illustrated in FIGS. 15 through 18 and data for three feed yarns (Ex. 11C, II-9, and a commercial 45 RV POY spun at about 3300 mpm) are summarized in Table V as Items V-1, V-2, and V-3, respectively.

Figure 15:
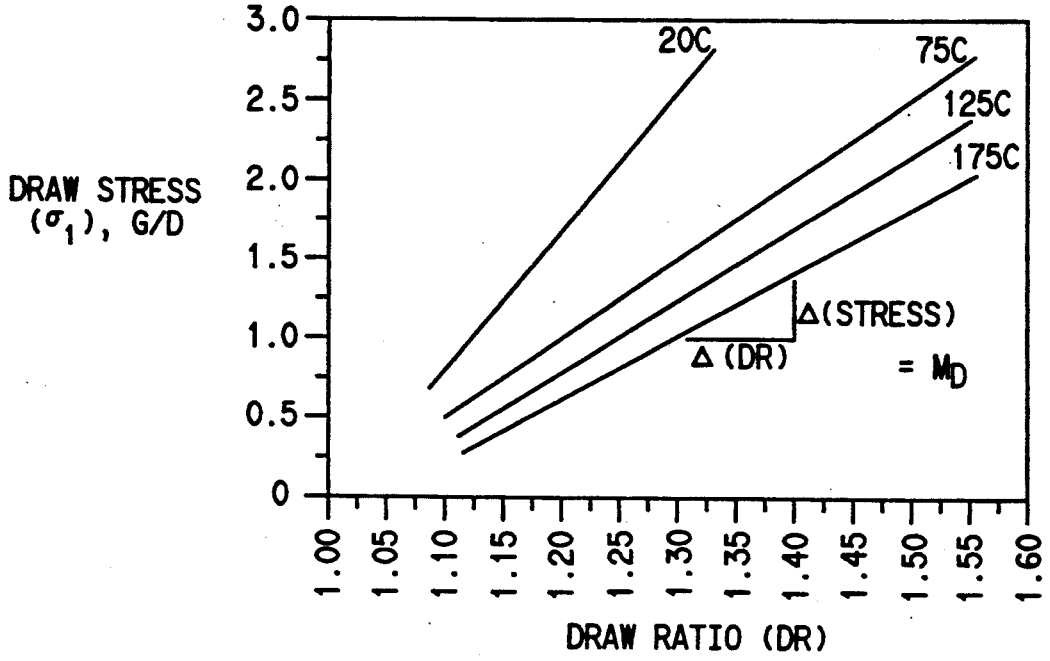

FIG. 15 is a representative plot of draw stress ($\sigma_1$), expressed as a grams per drawn denier, versus draw ratio at 20° C., 75° C., 125° C., and 175° C. The draw stress ($\sigma_D$) increases linearly with draw ratio above the yield point and the slope is called herein as the draw modulus ($M_D$) and is defined by ($\Delta M_D/\Delta DR$). The values of draw stress ($\sigma_D$) and draw modulus ($M_D$) decrease with increasing draw temperature (TD).

Figure 16:
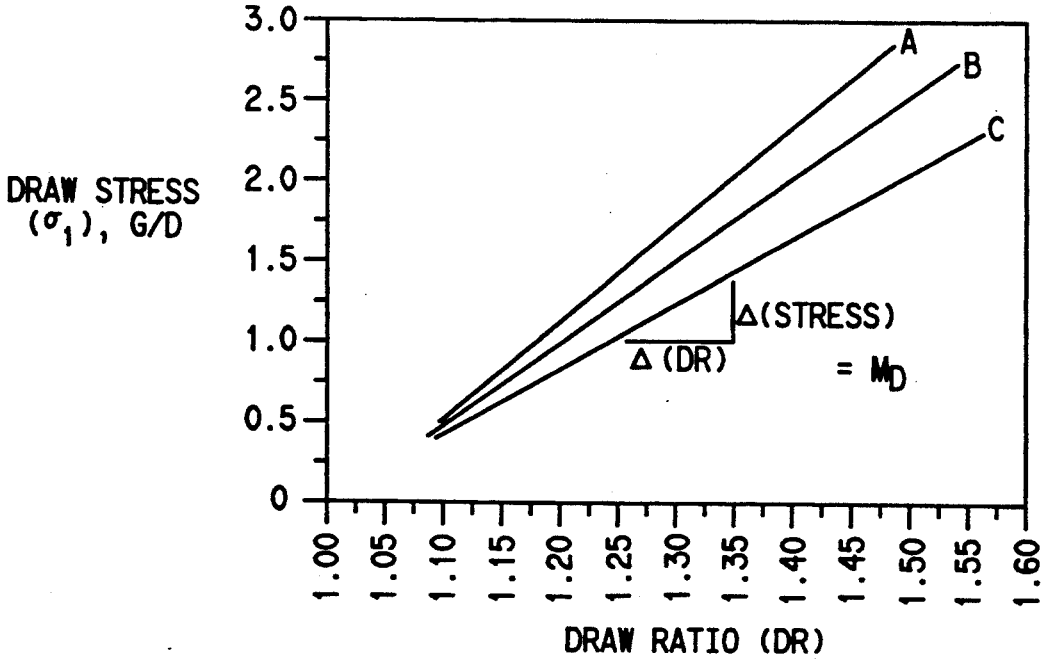

FIG. 16 compares the draw stress ($\sigma_D$) versus draw ratio (DR) at 75° C. for various feed yarns (A=nominal 65 RV nylon 66 homopolymer spun at 5300 mpm, Ex. I-11C; B=nominal 68 RV nylon 6,66 copolymer spun at 5300 mpm, Ex. II-9; C=nominal 45 RV nylon 66 homopolymer spun at about 3300 mpm). The desired level of draw stress ($\sigma_D$) and draw modulus ($M_D$) can be controlled by selection of feed yarn type and draw temperature ($T_D$). Preferred draw feed yarns have a draw stress ($\sigma_D$) of about 1.0 to about 1.9 g/d, and a draw modulus ($M_D$) of about 3.5 to about 6.5 g/d, as measured at 75° C. and at a 1.35 draw ratio (DR) taken from a best fit linear plot of draw stress ($\sigma_D$) versus draw ratio. The temperature of 75° C. is selected since it is found that most of nylon spin-oriented feed yarns have reached their maximum shrinkage tension and have not yet begun to undergo significant recrystallization (i.e., this is more indicative of the mechanical nature of the "as-spun" polymer chain network above it glass transition temperature, $T_g$, before the network has been modified by thermal recrystallization).

Figure 17:
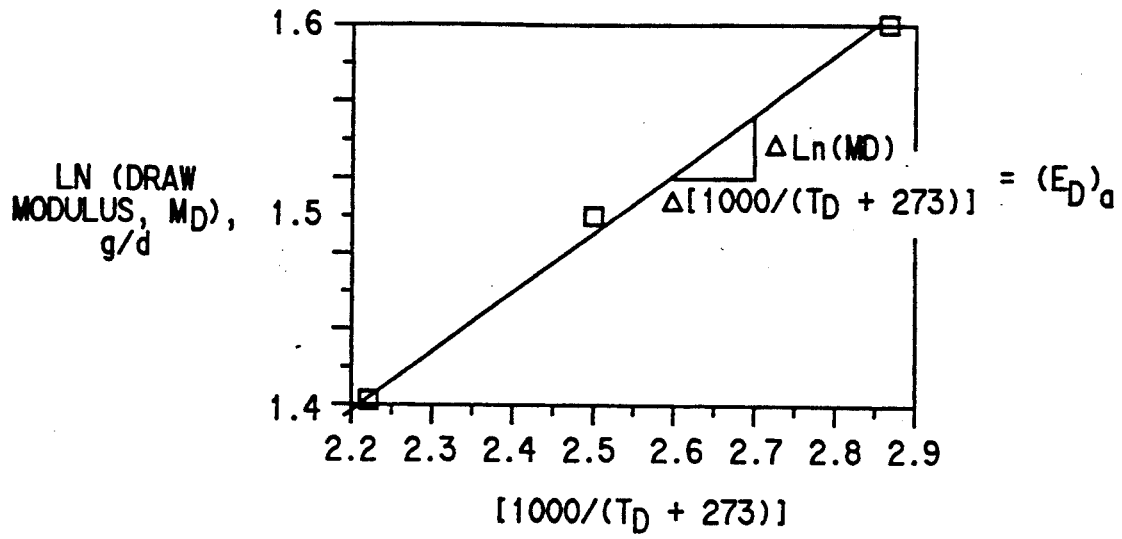

FIG. 17 is a representative plot of the logarithm of draw modulus, 1 n($M_D$), versus [1000/($T_D$, °C.+273)] for yarn B in FIG. 16. The slope of the best fit linear relation in FIG. 22, is taken as an apparent draw energies ($E_{D,A}$) assuming an Arrhenius type dependence of $M_D$ on temperature (i.e., $M_D = A\exp(E_D/RT)$, where T is temperature in degrees Kelvin, R is the universal gas constant, and "A" is a material constant). Preferred draw feed yarns have an apparent draw energy ($E_{D,A}$ [$E_D/R = \Delta(1\ nM_D)/\Delta(1000/T_D)$, where $T_D$ is in degrees Kelvin] between about 0.2 and about 0.5 (g/d)°K.

EXAMPLE 17

From Examples 1, 2, 3, and 15 it is found that the draw tension may be minimized for a given polymer RV and spin speed by independently carefully selecting and controlling the melt and extensional viscosities. It is obvious at this point to apply this improved process to the N66 high RV homopolymer and compare the improvements. In Table X the draw tension (DT) was determined for different process conditions, except spin speed being fixed at 5300 mpm. The response of DT for the N66 homopolymer is similar to that for the N6,66 copolymer as shown in Example 2. However, the draw tension (DT) at the optimum process conditions for the N66 homopolymer is 10-15% higher than for the N6,66 copolymer. If a N6,66 copolymer cannot be used because of some manufacturing limitations, then a N66 homopolymer feed yarn improved over that taught by Chamberlin et al can be made by carefully selecting and controlling the melt and extensional viscosities; i.e., the polymer extrusion temperature (Tp) between about 290° and 300° C., spinneret capillary diameter (D) smaller than about 0.30 mm, especially smaller than about 0.23 mm, with an L/D-ratio greater than about 2.0, especially greater than about 3, such that the $L/D^4$-ratio is greater than about 100 $mm^{-3}$, preferably, greater than about 150 $mm^{-3}$, especially greater than about 150 mm−3, with the number of filaments per spinneret extrusion area less than about 0.5 filaments/$mm^2$, and quenched with humidified air of at least 50% RH and less than 30C, typically of 75% RH and 21C, at a flow rate greater than about 10 mpm, preferably greater than about 15 mpm, over a distance of at least 75 cm, especially over a distance about 100 cm, and converged into a yarn bundle via a metered finish tip guide between about 75 and 150 cm, preferably between about 75 and about 125 cm. Further reductions in yarn draw tension can be made by increasing the RV from the starting polymer to the final yarn in steps; e.g., partially via SPP and completing the increase in RV in the subsequent melt extrusion system. An increase in RV of 5 to 15 in the melt extrusion system is found to provide a decrease in draw tension of about 5%. Combining these preferred process conditions will provide N66 homopolymer feed yarns having a draw tension less than 1.2 g/d at spin speeds between about 5000 and 6000 mpm.

Figure 21:
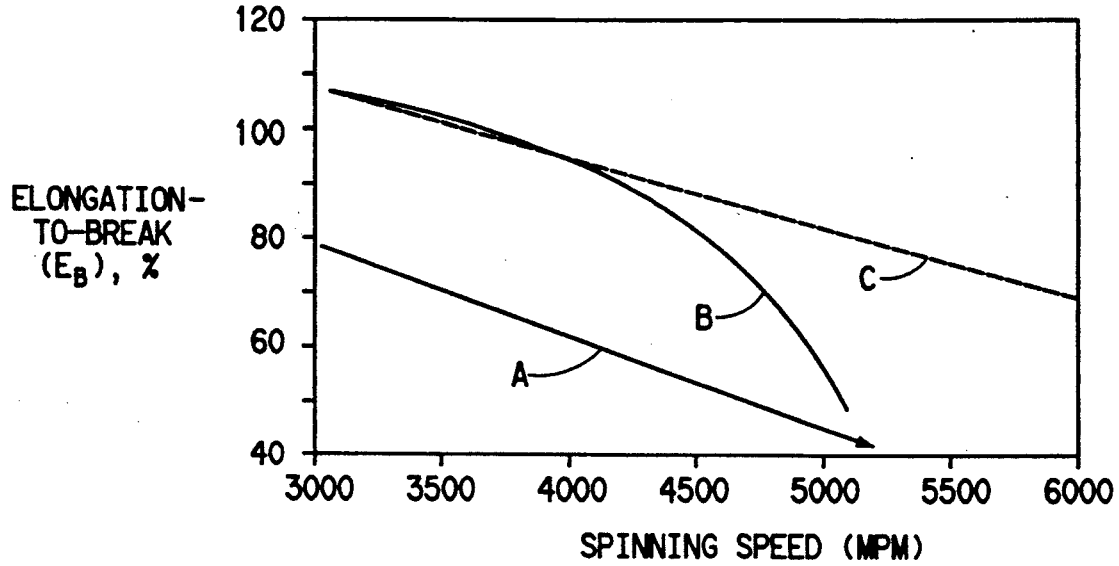

Further, this improved melt extrusion process, as applied to high RV nylon 66 homopolymer at high spin speeds, increases the spinning productivity ($P_s$) by providing increased elongation ($E_B$) for a given spin speed. This improvement over prior art is represented in FIG. 21 wherein Lines A and B are the comparative and test yarn results in Example II of Chamberlin et al, U.S. Pat. No. 4,583,357, at 40 and 80 RV, respectively. Line C is the improved process described herein and represents a significant improvement over Chamberlin et al.

EXAMPLE 18

Figure 18:
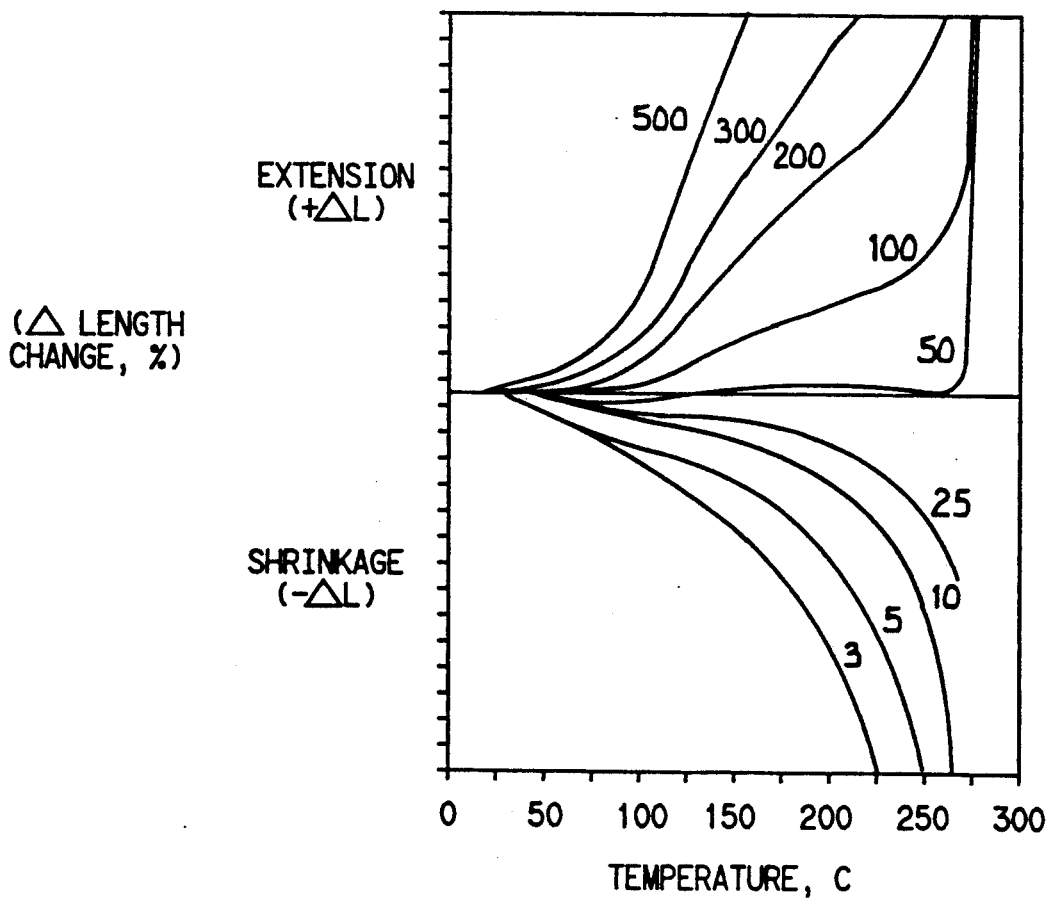
Figure 19:
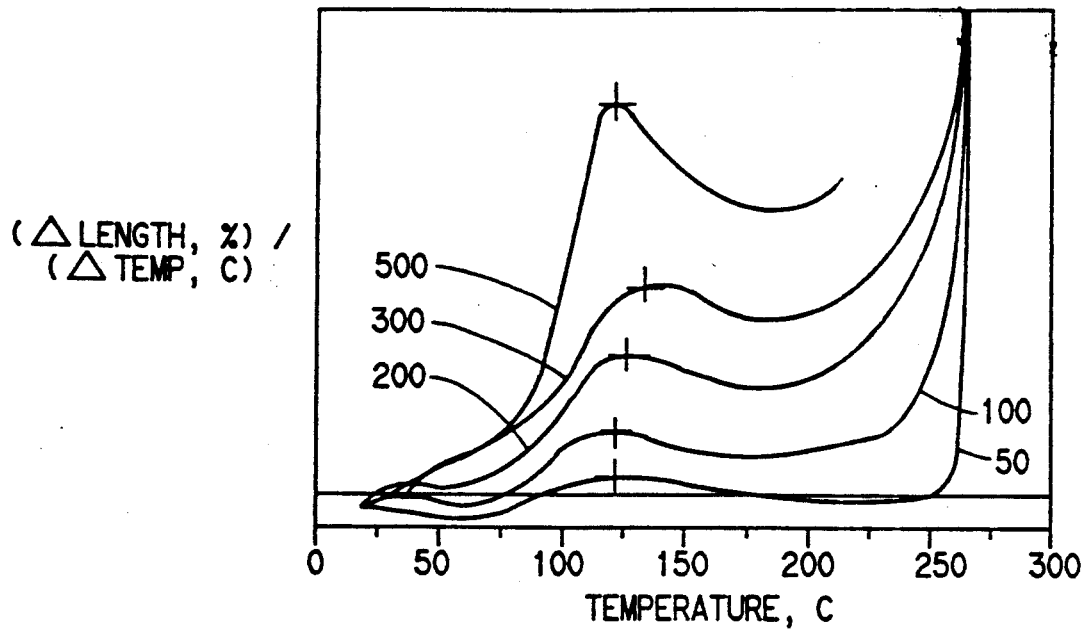
Figure 20:
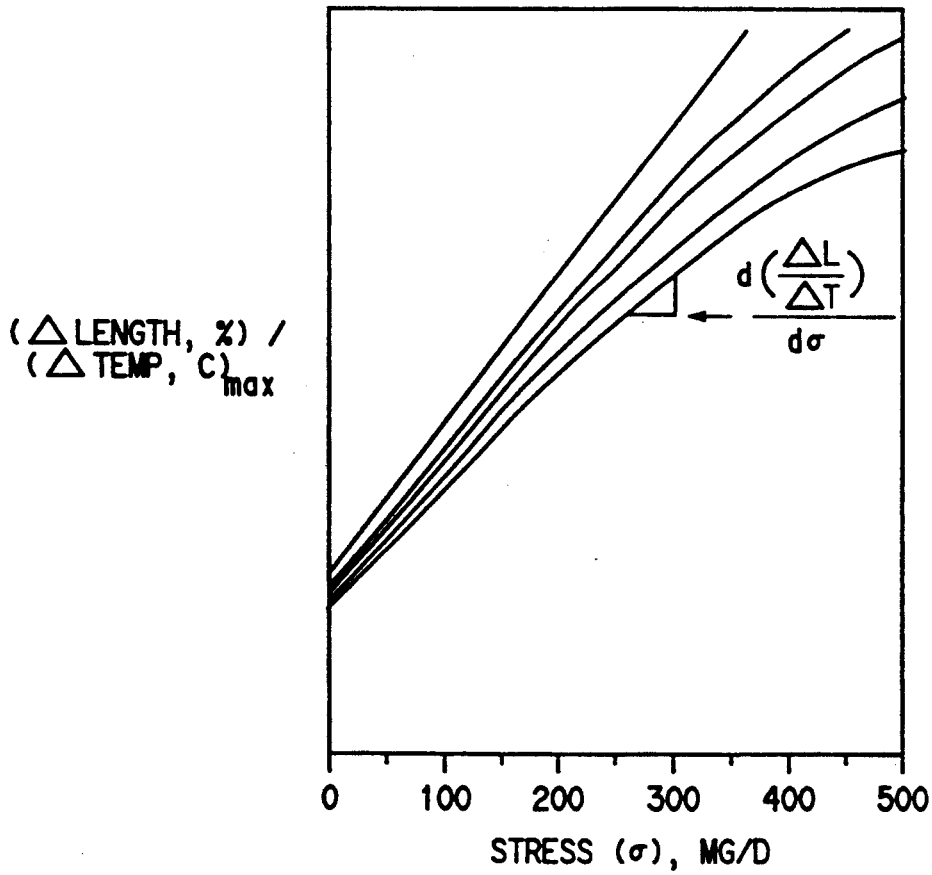

The thermalmechanical properties of feed yarns are characterized by their shrinkage and extension behavior versus temperature using a Du Pont Thermal Mechanical Analyzer (TMA) and representative behavior is illustrated by FIGS. 18 thru 20.

FIG. 18 (line A) is a typical plot of the percent change in length (Δ Length, %) of a nylon feed yarn versus temperature obtained using a constant heating rate of 50° C./min (±0.1 C) under constant tension of 300 milligrams per original denier. The onset of extension occurs at about the glass transition temperature (Tg) and increases sharply at a temperature TII,L which is believed to be related to the temperature at which the hydrogen bonds begin to break permitting extension of the polymer chains and movement of the crystal lamellae.

FIG. 18 (line B) is a plot of the corresponding dynamic extension rate to line A, herein defined by the instantaneous change in length per degree centigrade (Δ Length,%)/(Δ Temperature, °C.) of line A. The dynamic extension rate is relatively constant between $T_g$ and the $T_{II,L}$, and then rises to an initial maximum value at a temperature $T_{II,}$*, (i.e., typically between about 100°-150° C.) which is believed to be associated with the onset of crystallization. The dynamic extension rate remains essentially constant at the higher level over the temperature range $T_{II,}$* to $T_{II,U}$ and then rises sharply at $T_{II,U}$, which is associated with the onset of crystal melting and softening of the yarn, until the yarn breaks under tension at a temperature typically less than the melting point ($T_m$). $T_{II,U}$ is usually 20° to 40° C. less than $T_m$. Most aliphatic polyamides exhibit the dynamic extension rate versus temperature behavior of line B, wherein, there is a slight reduction in the dynamic extension rate, after the initial maximum at $T_{II,L}$, reaching a minimum at temperature $T_{II,}$**, which for nylon 66 polyamides is frequently referred to the Brill temperature and is associated with the transformation of the less thermally stable beta crystalline conformation to the thermally more stable alpha crystalline conformation.

FIG. 19 shows representative plots of percent change in length (Δ length, %) of a nylon feed yarn versus temperature obtained using a constant heating rate of 50° C. (±0.1° C.) and varying the tension (also referred to as stress, σ, expressed as milligrams per original denier) from 3 mg/denier to 500 mg/denier; wherein, the yarn extends under tensions greater than about 50 mg/d (FIG. 19 - top half) and shrinks under tensions less than about 50 mg/d (FIG. 19 - bottom half). The instantaneous length change response versus temperature for a given tension, [(Δ Length, %)/(Δ Temperature, °C.)], is herein referred to as the "dynamic shrinkage rate" under shrinkage conditions and as "dynamic extension rate" under extension conditions. The preferred feed yarns used in this invention shrink under an initial tension of 5 mg/d between 40° C. and 135° C., corresponding approximately to the glass transition temperature ($T_g$) and the onset of crystallization ($T_{II,}$*); and have a dynamic shrinkage rate less than zero under the same conditions (that is, shrinkage increases with temperature and does not exhibit any spontaneous extension after initial shrinkage).

FIG. 19 is a representative plot of the dynamic extension rate versus temperature for a nylon feed yarn under tensions of 50 to 500 mg/d. The initial maximum dynamic extension rate is taken, herein, as the onset of major crystallization and occurs a temperature $T_{II,}$*.

FIG. 20 is a representative plot of the initial maximum dynamic extension rates, (Δ Length,%)/(ΔTemperature, °C.)$_{max}$, versus initial stress (or tension) expressed as milligrams per original denier; wherein the $(\Delta L/\Delta T)_{max}$ increases with increasing stress as characterized by a positive slope, $d(\Delta L/\Delta T)_{max}/d\sigma$. The value of $d(\Delta L/\Delta T)/d\sigma$ decreases in general with increasing polymer RV, and increasing spin speed (i.e., decreasing $(RDR)_s$). Preferred feed yarns used in this invention are characterized by $(\Delta L/\Delta T)_{max}$ values of about 0.05 to about 0.15%/°C. at a stress of 300 mg/d and $d(\Delta L/\Delta T)/d\sigma$ values measured at 300 mg/d of to about $2\times10^{-4}$ to about $7\times10^{-4}$ (%/°C.)/(mg/d).

EXAMPLE 19

In Example 19, representative nylon 6,66 yarns of the invention (Ex. XI-1), nylon 66 homopolymer high speed spun yarns (EX. XI-2), and low RV slow speed spun yarns (EX. XI-3) are compared in Table XI. The yarns of the invention are typically less crystalline and have slightly smaller crystal sizes than corresponding nylon 66 homopolymer yarns. The crystalline phase of the yarns of the invention appears to be more uniform as characterized by a 50% higher melting rate (DSC) and 50% narrower NMR spectra. The lower average molecular orientation (Birefringence) and more uniform crystalline phase (DSC, NMR) may explain their lower sonic modulus. As expected the copolymer yarns of this invention have slightly less thermal dimensional stability than the nylon 66 homopolymer yarns, but have comparable dynamic shrinkage and extension rates as measured by TMA which is most likely indicative of the larger crystal sizes of high speed spun yarns. The yarns of the invention have comparable dyeing kinetics at 80° C., but are surprisingly slower in dye rate at 40° and 60° C. The overall dye pickup (MBB), however, is greater for the yarns of the invention. The above permits the yarns of the invention to be dyed with nylon 66 homopolymer yarns by adjusting the dyebath temperature. The yarns of this invention have greater extensionability as measured by a lower draw stress, draw modulus, and draw energy which when coupled with their lower torsional modulus may explain their surprisingly excellent texturability at 1000+ mpm versus prior art yarns.

MEASUREMENTS AND TEST METHODS

The relative viscosity (RV) of the polyamide is measured as described at col. 2, 1. 42–51, in Jennings U.S. Pat. No. 4,702,875.

The amount of nylon 6 monomer (N6% in Tables, herein) in 6 nylon 66 is determined as follows: A weighed nylon sample is hydrolyzed (by refluxing in 6N HCl), then 4-aminobutyric acid is added as an internal standard. The sample is dried and the carboxylic acid ends are methylated (with anhydrous methanolic 3N HCl), and the amine ends are trifluoroacylated with trifluoroacetic anhydride/$CH_2Cl_2$ at 1/1 volume ratio. After evaporation of solvent and excess reagents, the residue is taken up in MeOH and chromatographed using a gas chromatograph such as Hewlett Packard 5710A, commercially available from Hewlett Packard Co., Palo Alto, Calif., with Flame Ionization Detector, using for the column Supelco ® 6-foot×4 mm ID glass, packed with 10% SP2100 on 80/100 Supelcoport ®, commercially available from Supelco Co., Bellefonte, Pa. Many gas chromatographic instruments, columns, and supports are suitable for this measurement. The area ratio of the derivatized 6-aminocaproic acid peak to the derivatized 4-aminobutyric acid peak is converted to mg 6 nylon by a calibration curve, and wt. % 6 nylon is then calculated.

The amount of Me5–6 monomer is determined by heating two grams of the polymer in flake, film, fiber, or other form (surface materials such as finishes being removed) at 100° C. overnight in a solution containing 20 mls of concentrated hydrochloric acid and 5 mls of water. The solution is then cooled to room temperature, adipic acid precipitates out and may be removed. (If any TiO2 is present it should be removed by filtering or centrifuging.) One ml of this solution is neutralized with one ml of 33% sodium hydroxide in water. One ml of acetonitrile is added to the neutralized solution and the mixture is shaken. Two phases form. The diamines (MPMD AND HMD) are in the upper phase. One microliter of this upper phase is analyzed by Gas Chromatography such as a capillary Gas Chromatograph having a 30 meter DB 5 column (95% dimethylpolysiloxane/5% diphenylpolysiloxane) is used although other columns and supports are suitable for this measurement. A suitable temperature program is 100° C. for 4 minutes then heating at a rate of 8° C./min up to 250° C. The diamines elute from the column in about 5 minutes, the MPMD eluting first. The percentage Me5–6 is calculated from the ratio of the integrated areas under the peaks for the MPMD and HMD and is reported in this application as the weight percent of 2-methyl-pentamethylene adipamide units in the polymer.

Denier of the yarn is measured according to ASTM Designation D-1907-80. Denier may be measured by means of automatic cut-and-weigh apparatus such as that described by Goodrich et al in U.S. Pat. No. 4,084,434.

Tensile properties (Tenacity, Elongation ($E_b$ %), Modulus) are measured as described by Li in U.S. Pat. No. 4,521,484 at col. 2, 1. 61 to col. 3, 1. 6. The Modulus (M), often referred to as "Initial Modulus," is obtained from the slope of the first reasonably straight portion of a load-elongation curve, plotting tension on the y-axis against elongation on the x-axis. the Secant Modulus at 5% Extension (M5) is defined by the ratio of the (Tenacity/0.05)×100, wherein Tenacity is measured at 5% extension.

Draw Tension (DT 33%), expressed as grams per original denier, is measured while drawing the yarn to be tested while heating it. This is most conveniently done by passing the yarn from a set of nip rolls, rotating at approximately 180 meters/minute surface speed, through a cylindrical hot tube, at 185±2° C. (characteristic of the exit gain temperature in high speed texturing), having a 1.3 cm diameter, 1 meter long yarn passageway, then to a second set of nip rolls, which rotate faster than the first set so that the yarn is drawn between the sets of nip rolls at a draw ratio of 1.33 X. A conventional tensiometer placed between the hot tube and the first set of nip rolls measures yarn tension. The coefficient of variation is determined statistically from replicate readings. Freshly spun yarn is aged 24 hours before this measurement is done. Draw Tension @1.05 Draw Ratio (DT 5%) is measured in the same manner except that draw ratio is 1.05X instead of 1.33X and hot tube temperature is at 135° C. instead of 185° C. Using these settings, Average Secant Modulus ($M_5$) is calculated by the formula $$\frac{([M_5]/[\text{denier}])}{5} \times 100$$

(average values are denoted by brackets) % Coefficient of Variation of $M_5$ is also obtained in this manner.

Draw Tension @1.00 Draw Ratio (herein referred to as "along-end shrinkage tension") is measured in the same manner as DT 5% except that the draw ratio is 1.00X and the hot tube temperature is 75° C.

Draw Tension @1.20 Residual Draw Ratio (DT RDR=1.2) is obtained in the same manner as DT5 except that the draw ratio is based on residual draw ratio of 1.20 X; i.e., $$\text{Draw Ratio} = \frac{100 + E_B \text{ (in percent)}}{120}$$

% of Coefficient of Variation is also calculated using this data.

The Dynamic Shrinkage Tension (ST) is measured using the Kanebo Stress Tester, model KE-2L, made by Kanebo Engineering, LTD., Osaka, Japan, and distributed in the U.S. by Toyomenka America, Inc. of Charlotte, N.C. The tension in grams is measured versus temperature on a seven centimeter yarn sample tied into a loop and mounted between two loops under an initial preload of 5 milligrams per denier and heated at 30 degrees centigrade per minute from room temperature to 260 degrees centigrade. The maximum shrinkage tension (g/d) ($S_{Tmax}$) and the temperature at $S_{Tmax}$, denoted by $T_{STmax}$ are recorded. Other thermal transitions can be detected (see detailed discussion of FIG. 10).

The Dynamic Length Change (ΔL) of a yarn under a pretensioning load versus increasing temperature (ΔT) is measured using the Du Pont Thermomechanical Analyzer (TMA), model 2940, available from the E.I. Du Pont de Nemours and Co., Inc. of Wilmington, Del. The change in yarn length (ΔL, %) versus temperature (degrees centigrade) is measured on a 12.5 millimeter length of yarn which is: 1) mounted carefully between two press-fit aluminum balls while keeping all individual filaments straight and unstressed with the cut filament ends fused outside of the ball mounts using a micro soldering device to avoid slippage of individual filaments; 2) pre-stressed to an initial load of 5 mg/denier for measurement of shrinkage and to 300 mg/denier for measurement of extension; and 3) heated from room temperature to 300 degrees centigrade at 50 degrees per minute with the yarn length at 35 degrees centigrade defined as the initial length. The change in length (ΔL, %) is measured every two seconds (i.e., every 1.7 degrees) and recorded digitally and then plotted versus specimen temperature. An average relationship is defined from at least three representative plots. Preferred warp draw feed yarns have a negative length change (i.e, the yarns shrink) under a 5 mg/d tension over the temperature range of 40° C. to 135° C.

The instantaneous change in length versus temperature (ΔL,%)/(ΔT, °C.), herein called the Dynamic Shrinkage Rate under shrinkage conditions (5 mg/d) and the Dynamic Extension Rate under extension conditions (300 mg/d), is derived from the original data by a floating average computation and replotted versus specimen temperature. Preferred warp draw feed yarns have a negative dynamic shrinkage rate (i.e., the yarns do not elongate after initially shrinking) over the temperature range on 40° C. to 135° C. Under extension conditions (300 mg/d pre-tension load), the value of (ΔL/ΔT) is found to increase with increasing temperature, reaching an intermediate maximum value at about 110°-140° C., decreasing slightly in value at about 160°-200° C. and then increasing in value sharply as the yarn begins to soften prior to melting (see FIG. 7). The intermediate maximum in (ΔL/ΔT), occurring between about 110° C.-140° C., is herein called (ΔL/ΔT)max and is taken as a measure of the mobility of the polymer network under stress and high temperatures. Preferred warp draw feed yarns have a (ΔL/ΔT)max value, as measured at 300 mg/d, of less than about 0.2 (%/°C.), preferably less than about 0.15 (%/°C.) and greater than about 0.05 (%/°C.)

Another important characteristic of a polymer network is the sensitivity of its (ΔL/ΔT)max value with increasing stress which is defined as the tangent to the plot of (ΔL/ΔT)max versus $\sigma_D$ at a $\sigma_D$-value of 300 mg/d (denoted by $d(\Delta L/\Delta T)_{MAX}d/\sigma_D$) and determined on separate specimens pre-stressed from 3 mg/d to 500 mg/d (see FIGS. 5 and 6). A 300 mg/d stress value is selected for characterization since it approximates the nominal stress level in the warp draw relaxation zone (i.e., between rolls 17 and 18 in FIG. 2).

The Hot Draw Stress ($\sigma_D$) vs. Draw Ratio Curve is used to simulate the response of a draw feed yarn to increasing warp draw ratio (WDR) and draw temperature ($T_D$). The draw stress ($\sigma_D$) is measured the same as $DT_{33}$%, except that the yarn speed is reduced to 50 meters per minute, the measurement is taken over a length of 100 meters, and different temperatures and draw ratios are used as described herein. The draw stress ($\sigma_D$) is expressed as grams per drawn denier; that is, $\sigma_D = DT(g/d) \times DR$, and is plotted versus draw ratio (DR) at 75° C., 125° C., and 175° C. (see FIG. 20). The draw stress ($\sigma_D$), increases linearly with draw ratio for values of DR greater than about 1.05 (i.e., above the yield point) to the onset of strain-hardening (i.e., to a residual draw ratio $(RDR)_D$ of about 1.25), and the slope of the best fit linear plot of draw stress versus draw ratio is herein called the draw modulus ($M_D = \Delta\sigma_D/\Delta DR$). The values of draw stress ($\sigma_D$) and draw modulus ($M_D$) decrease with increasing draw temperature ($T_D$). The desired level of draw stress ($\sigma_D$) and draw modulus ($M_D$) can be controlled by selection of feed yarn type and draw temperature ($T_D$). Preferred draw feed yarns have a draw stress ($\sigma_D$) between about 1.0 and about 2.0 g/d, and a draw modulus ($M_D$) between about 3 to about 7 g/d, as measured at 75° C. and at a 1.35 draw ratio (DR) taken from a best fit linear plot of draw stress ($\sigma_D$) versus draw ratio (see FIGS. 20 and 21). The temperature of 75° C. is selected since it is found that most nylon spin-oriented feed yarns have reached their maximum shrinkage tension and have not yet begun to undergo significant recrystallization (i.e., this is more indicative of the mechanical nature of the "as-spun" polymer chain network above its glass transition temperature, $T_g$, before the network has been modified by thermal recrystallization).

Apparent Draw Energy $(E_D)_a$, is the rate of decrease of the draw modulus with increasing temperature (75° C., 125° C., 175° C.) and is defined as the slope of a plot of the logarithm of the draw modulus, 1 $n(M_D)$, versus $[1000/(T_D, °C. + 273)]$, assuming an Arrhenius type temperature dependence (i.e., $M_D = A\exp(E_D/RT)$, where T is temperature in degrees Kelvin, R is the universal gas constant, and "A" is a material constant). Preferred draw feed yarns have an apparent draw energy $(E_D)_a$ $[E_D/R = \Delta(1\ nM_D)/\Delta(1000/T_D)$, where $T_D$ is in degrees Kelvin] about 0.2 to about 0.6 (g/d)°K.

The Differential Dye Variance is a measure of the along-end dye uniformity of a warp drawn yarn and is defined by the difference in the variance of K/S measured in the axial and radial directions, respectively, on a lawson knit sock dyed according to the MBB dye procedures described herein. The LMDR of a warp knit fabric is found to vary inversely with the warp drawn yarn Differential Dye Variance (axial K/S variance−radial K/S variance). The warp draw process of the invention balances the draw temperature, extent of draw, relaxation temperature, and extent of relaxation so to minimize the Differential Dye Variance (DDV) of the warp drawn yarn product.

Boil-Off Shrinkage (BOS) is measured according to the method in U.S. Pat. No. 3,772,872 column 3, line 49 to column 3 line 66.

Heat Set Shrinkage After Boil Off (HSS/ABO) is measured by immersing a skein of the test yarn into boiling water and then placing it in a hot oven and measuring shrinkage. More specifically, a 500 gram weight is suspended from a 3000 denier skein of the test yarn (6000 denier loop) so that the force on the yarn is 83 mg./denier, and the skein length is measured (L1). The 500 gm. weight is then replaced with a 30 gm. weight and the weighted skein is immersed into boiling water for 20 minutes removed and allowed to air dry for 20 minutes. The skein is then hung in an oven at 175 degrees C. for 4 minutes, removed, the 30 gm. weight is replaced with a 500 gm. weight and skein length is measured (L2). "Heat set shrinkage after Boil Off" is calculated by the formula:

$$\text{Heat Set Shrinkage After Boil Off (\%)} = \frac{L1 - L2}{L1} \times 100$$

Heat set shrinkage after boil-off (HSS/ABO) is typically greater than BOS, that is, the yarns continue to shrink on DHS at 175° C. ABO which is preferred to achieve uniform dyeing and finishing.

Static Dry Heat Shrinkage (DHS90 and DHS135) are measured by the method described in U.S. Pat. No. 4,134,882, Col. 11, 11. 42–45 except that the oven temperatures are 90 degrees C., 135 degrees C., and 175 degrees C., respectively, instead of 160 degrees C.

24-Hour Retraction is a measure of the amount of retraction of a yarn after elapse of a 24-hour time period It is measured by conditioning a 150-cm length of sample yarn for 2 hours at 70±2° F. and 65±2% RH (Relative Humidity), forming a loop of the yarn suspending the loop from a suitable support, hanging a weight from the loop, the weight producing a tension on the loop of 0.1 gm/denier, measuring the loop length (L1), removing the weight, and allowing the yarn to age for 24-hours whereupon the same weight is hung from the loop and the loop length measured (L2).

$$\text{24 Hour Retraction (\%)} = \frac{L1 - L2}{L1} \times 100$$

Finish on yarn (FOY) is measured by placing a sample of the finish containing yarn in tetrachloroethylene which removes the finish from the yarn. The amount of finish removed from the yarn is determined by Infrared techniques at 3.4 (2940 cm−1) vs. perchloroethylene. The absorbance is a measure of all solvent soluble compounds in the finish. FOY is calculated by the formula:

$$FOY\,(\%) = \frac{\text{Weight Finish removed from the yarn}}{\text{Initial weight of finish-containing yarn}} \times 100$$

A suitable finish for the new yarns is a 7.5% aqueous emulsion of the following combination of finish ingredients: About 43 parts (all finish ingredients parts are parts by weight) coconut oil, about 22 parts of $C_{14}$ alcohol-$(PO)_x/(EO)_y(PO)_z$ copolymer wherein X may be 5–20 (preferably 10); Y may be 5–20 (preferably 10) and Z may be 1–10 (preferably 1.5), about 22 parts of a mixed ($C_{10}$) alcohol ethoxylate (>10 moles of ethylene oxide units) about 9 parts of an alkyl capped polyethylene glycol ester, about 4 parts of a potassium salt of a fatty acid, about 0.5 parts of (alkyl phenyl)$_3$ phosphite. The finish is applied to the yarn by known methods to a level of about 0.5% FOY.

Interlace level of the polyamide yarn is measured by the pin-insertion technique which, basically, involves insertion of a pin into a moving yarn and measures yarn length (in cm.) between the point on the yarn at which the pin has been inserted and a point on the yarn at which a predetermined force on the pin is reached For yarns of >39 denier the predetermined force is 15 grams; for yarns of ≦39 denier the predetermined force is 9 grams. Twenty readings are taken. For each length between points, the integer is retained, dropping the decimal, data of zero is dropped, and the log to the base 10 is taken of that integer and multiplied by 10. That result for each of the 20 readings is averaged and recorded as interlace level.

The Bulk (Crimp Out) and Shrinkage of textured yarns may be measured by the Lawson-Hemphill Textured Yarn Test System (TYT) as follows: A suitable Tester is the Model 30 available from Lawson-Hemphill Sales, Inc., P.O. Drawer 6388, Spartansburg, S.C. Four yarn length measurements are made in the sequence: (1) length under very slight tension (yarn crimp is present) ($L_1$); (2) length under just enough tension to straighten the yarn ($L_2$); (3) length upon heating to further develop crimp under very low tension (yarn crimp is present) $L_2$); (4) and the final yarn length ($L_4$) under just enough tension to straighten the yarn. Crimp out is calculated by the formula:

$$\text{Crimp Out (\%)} = \frac{L_2 - L_3}{L_2} \times 100$$

The shrinkage is calculated by the formula $$\text{Shrinkage (\%)} = \frac{L_2 - L_4}{L_2} \times 100$$

The following test conditions are used: 10 meter sample length; 100 meters per minute sample speed; 120° C. heater temperature; for calibration on the first zone sensor a 400 mg. weight is used for yarns of approximately 40 denier, a 200 mg. weight is used for yarns of approximately 20 denier, and the second zone feed roll speed is adjusted to produce approximately 2 grams threadline tension between the intermediate rollers and the second zone feed roll, and a 20 gram weight is used on the second zone sensor.

Texturing tensions pre-disc (T1) and post-disc (T2) tensions, expressed in terms of grams per original feed yarn denier, may be measured by use of the Rothschild Electronic Tensiometer. Model R-1192A operation conditions are: 0 to 100 gram head; range=25 (scale 0 to 40 grams on display); calibrated with Lawson-Hemphill Tensiometer Calibration Device. The Rothschild Tensiometer, and the Lawson-Hemphill Tensiometer Calibration Device are commercially available from: Lawson-Hemphill Sales, Inc., PO Drawer 6388, Spartansburg, S.C. The predisc tension (T1) may be also expressed as of stress, $\sigma_1$ where the pre-disc stress, $\sigma_1 = T_1 \times$ Texturing Draw Ratio, (TDR) and the post-disc stress, $\sigma_2 = \sigma_1 \times (T_2/T_1)$. Another important texturing parameter, the texturing draw modulus, ($M_{TD}$)is the change in the pre-disc stress ($\Delta\sigma_1$) divided by the change in the texturing draw ratio, ΔTDR (i.e., $M_{TD} + \Delta\sigma_1/\Delta TDR$).

Dynamic Draw Stress ($\sigma_{DD}$), expressed as a [Draw tension X draw ratio] is measured while drawing and heating the yarn to be tested while heating it. This is most conveniently done by passing the yarn from a set of nip rolls, rotating at approximately 50 meters per minute surface speed, through a cylindrical hot tube at 75°±2° C. having a 1.3 cm diameter, 1 meter long yarn passageway, then to a second set of nip rolls which rotate equal to and then faster than the first set, so that the yarn is drawn between the sets of nip rolls from an initial draw ratio of 1.0X to a final 1.60X, over a period of 20 seconds. The dynamic load (gms)-draw ratio curve is recorded using a strip chart recorder The dynamic draw stress ($\sigma_{DD}$), expressed in grams per drawn denier, is defined as the dynamic draw tension (DDT) expressed in grams per original denier, multiplied by the draw ratio DR (that is, $\sigma_{DD}$=DDT (g/d)×DR). The dynamic draw modulus ($M_{DD}$) is defined as the change in draw stress ($\Delta\sigma_{DD}$) per change in draw ratio (DR), (that is, $M_{DD} = \Delta\sigma_{DD}/\Delta DR$). The dynamic $\sigma_{DD}$ and $M_{DD}$ are measured at a 1.35X draw-ratio and at 75° C. The temperature of 75° C. was selected as the approximate temperature of maximum shrinkage tension just prior to the onset of crystal nucleation and is therefore more characteristic of the yarn above its glass transition temperature, but before undergoing significant change via recrystallization.

Torsional Modulus ($M_T$): The torsional properties of a fiber have considerable influence on the ability of the fiber to be twisted or textured. The yarns of this invention have a torsional modulus ($M_T$) 15+% lower than the homopolymer N66 yarns. The principle of this analysis is a torque balance method in which the specimen is twisted to a certain angle and the torque generated in it is made to balance against the torque provided by a rotating viscous liquid of known viscosity. The Torsional stress/strain curves are calculated from torque against twist curves determined using a Toray Torsional Rigidity Analyzer (Today Industries Inc., Otsu, Shiga 520, Japan) described by M Okabayashi et al in the Textile Research Journal vol. 46, pp. 429, (1976) using a 2.05 cm sample length, 60 turns, a two second sampling frequency, S-20 Viscosity Standard Oil, supplied by Cannon Instrument Co. State College, Pa. The data are corrected for changes in liquid viscosity with temperature and the torsional modulus calculated by the method shown by W. F. Knoff in The Journal of Material Science Letters, vol. 6, no. 12 p. 1392 (1987). Another suitable instrument for this measurement is the KES-Y-1-X Fiber Torsional Tester manufactured by Kato Tech. Co., Inc., Kyoto, Japan.

Density of the polyamide fiber is measured by use of the standard density gradient column technique using carbon tetrachloride and heptane liquids, at 25° C.

Melting Behavior, including initial melt rate, is measured by a Differential Scanning Calorimeter (DSC) or a Differential Thermal Analyzer (DTA). Several instruments are suitable for this measurement. One of these is the Du Pont Thermal Analyzer made by E.I. Du Pont de Nemours and Company of Wilmington, Del. Samples of 3.0±0.2 mg. are placed in aluminum capsules with caps and crimped in a crimping device all provided by the instrument manufacturer. The samples are heated at a rate of 20° per minute for measurement of the melting point ($T_M$) and a rate of 50° C. per minute is used to detect low temperature transitions which would normally not be seen because of rapid recrystallization during the heating of the yarn. Heating takes place under a nitrogen atmosphere (inlet flow 43 ml/min.) using the glass bell jar cover provided by the instrument manufacturer. After the sample is melted the cooling exotherm is determined by cooling the sample at 10° per minute under the nitrogen atmosphere. The Melting Point ($T_m$) of the yarn of the invention is depressed by about 1° C. for each weight percent comonomer in the copolymer as expected for a copolymer in relation to the homopolymer, however the melting rate, as indicated by the initial slope of the melting curve, measured as the height of the first derivative peak, is, unexpectedly, nearly 50% higher in the yarn of the invention than in the comparable yarn.

The Optical Parameters of the fibers are measured according to the method described in Frankfort and Knox U.S. Pat. No. 4,134,882, beginning at column 9, line 59 and ending at column 10, line 65 with the following exceptions and additions. First instead of Polaroid T-410 film and 1000×image magnification, high speed 35 mm film intended for recording oscilloscope traces and 300×magnification are used to record the interference patterns. Also suitable electronic image analysis methods which give the same result can be used. Second, the word "than" in column 10, line 26 is replaced by the word "and" to correct a typographical error. Because the fibers of this invention are different from those of 4,134,882, additional parameters, calculated from the same n || and n⊥ distributions at ±0.05. Here the + refers to opposite sides from the center of the fiber image. The isotropic refractive index (RISO) at ±0.05 is determined from the relationship:

$$RISO(0.05) = [(n\,||)(0.05) + 2(n\perp)(0.05)]/3$$

Finally the average value of any of the optical parameters is defined as the average of the two values at ±0.05, e.g.:

$$\langle RISO \rangle = (RISO(0.05) + RISO(-0.05))/2$$

and similarly for birefringence.

Crystal Perfection Index and Apparent Crystallite Size: Crystal perfection index and apparent crystallite size are derived from X-ray diffraction scans. The diffraction pattern of fibers of these compositions is characterized by two prominent equatorial X-ray reflections with peaks occurring at scattering angle approximately 20°-21° and 23°2θ.

X-ray diffraction patterns of these fibers are obtained with an X-ray diffractometer (Philips Electronic Instruments, Mahwah, N.J., cat. no. PW1075/00) in reflection mode, using a diffracted-beam mono-chromator and a scintillation detector. Intensity data are measured with a rate meter and recorded by a computerized data collection/reduction system. Diffraction patterns are obtained using the instrumental settings:

Scanning Speed 1° 2θ per minute;

Stepping Increment 0.025° 2θ;

Scan Range 6° to 38°, 2θ; and

Pulse Height Analyzer, "Differential".

For both Crystal Perfection Index and Apparent Crystallite Size measurements, the diffraction data are processed by a computer program that smoothes the data, determines the baseline, and measures peak locations and heights.

The X-ray diffraction measurement of crystallinity in 66 nylon, 6 nylon, and copolymers of 66 and 6 nylon is the Crystal Perfection Index (CPI) (as taught by P. F. Dismore and W. O. Statton, J. Polym. Sci. Part C, No. 13, pp. 133–148, 1966). The positions of the two peaks at 21° and 23° 2θ are observed to shift, and as the crystallinity increases, the peaks shift farther apart and approach the positions corresponding to the "ideal" positions based on the Bunn-Garner 66 nylon structure. This shift in peak location provides the basis of the measurement of Crystal Perfection Index in 66 nylon:

$$CPI = \frac{[d(\text{outer})/d(\text{inner})] - 1}{0.189} \times 100$$

where d(outer) and d(inner) are the Bragg 'd' spacings for the peaks at 23° and 21° respectively, and the denominator 0.189 is the value for d(100)/d(010) for well-crystallized 66 nylon as reported by Bunn and Garner (Proc. Royal Soc.(London), A189, 39, 1947). An equivalent and more useful equation, based on 2θ values, is:

$$CPI = [2\theta(\text{outer})/2\theta(\text{inner}) - 1] \times 546.7$$

Apparent Crystallite Size: Apparent crystallite size is calculated from measurements of the half-height peak width of the equatorial diffraction peaks. Because the two equatorial peaks overlap, the measurement of the half-height peak width is based on the half-width at half-height. For the 20°–21° peak, the position of the half-maximum peak height is calculated and the 2θ value for this intensity is measured on the low angle side. The difference between this 2θ value and the 2θ value at maximum peak height is multiplied by two to give the half-height peak (or "line") width. For the 23° peak, the position of the half-maximum peak height is calculated and the 2θ value for this intensity is measured on the high angle side; the difference between this 2θ value and the 2θ value at maximum peak height is multiplied by two to give the half-height peak width.

In this measurement, correction is made only for instrumental broadening; all other broadening effects are assumed to be a result of crystallite size. If 'B' is the measured line width of the sample, the corrected line width 'beta' is $$\beta = \sqrt{B^2 - b^2}$$

where 'b' is the instrumental broadening constant. 'b' is determined by measuring the line width of the peak located at approximately 28° 2θ in the diffraction pattern of a silicon crystal powder sample.

The Apparent Crystallite Size (ACS) is given by $$ACS = (K\lambda)/(\beta \cos \theta), \text{ wherein}$$

K is taken as one (unity);

λ is the X-ray wavelength (here 1.5418 Aϕ;

β is the corrected line breadth in radians; and θ is half the Bragg angle (half of the 2θ value of the selected peak, as obtained from the diffraction pattern).

X-ray Orientation Angle: A bundle of filaments about 0.5 mm in diameter is wrapped on a sample holder with care to keep the filaments essentially parallel. The filaments in the filled sample holder are exposed to an X-ray beam produced by a Philips X-ray generator (Model 12045B) available from Philips Electronic Instruments. The diffraction pattern from the sample filaments is recorded on Kodak DEF Diagnostic Direct Exposure X-ray film (Catalogue Number 154-2463), in a Warhus pinhole camera. Collimators in the camera are 0.64 mm in diameter. The exposure is continued for about fifteen to thirty minutes (or generally long enough so that the diffraction feature to be measured is recorded at an Optical Density of ~1.0). A digitized image of the diffraction pattern is recorded with a video camera. Transmitted intensities are calibrated using black and white references, and gray level (0–255) is converted into optical density. The diffraction pattern of 66 nylon, 6 nylon, and copolymers of 66 and 6 nylon has two prominent equatorial reflections at 2θ approximately 20°–21° and 23°; the outer (~23°) reflection is used for the measurement of Orientation Angle. A data array equivalent to an azimuthal trace through the two selected equatorial peaks (i.e. the outer reflection on each side of the pattern) is created by interpolation from the digital image data file; the array is constructed so that one data point equals one-third of one degree in arc.

The Orientation Angle (OA) is taken to be the arc length in degrees at the half-maximum optical density (angle subtending points of 50 percent of maximum density) of the equatorial peaks, corrected for background. This is computed from the number of data points between the half-height points on each side of the peak (with interpolation being used, this is not an integral number). Both peaks are measured and the Orientation Angle is taken as the average of the two measurements.

Long Period Spacing and Normalized Long Period Intensity: The long period spacing (LPS), and long period intensity (LPI), are measured with a Kratky small angle diffractometer manufactured by Anton Paar K. G., Graz, Austria. The diffractometer is installed at a line-focus port of a Philips XRG3100 x-ray generator equipped with a long fine focus X-ray tube operated at 45 KV and 40 ma. The X-ray focal spot is viewed at a 6 degree take-off angle and the beam width is defined with a 120 micrometer entrance slit. The copper K-alpha radiation from the X-ray tube is filtered with a 0.7 mil nickel filter and is detected with a NaI(Tl) Scintillation counter equipped with a pulse height analyzer set to pass 90% of the CuK-alpha radiation symmetrically.

The nylon samples are prepared by winding the fibers parallel to each other about a holder containing a 2 cm diameter hole. The area covered by the fibers is about 2 cm by 2.5 cm and a typical sample contains about 1 gram of nylon. The actual amount of sample is determined by measuring the attenuation by the sample of a strong CuK-alpha X-ray signal and adjusting the thickness of the sample until the transmission of the X-ray beam is near 1/e or 0.3678. To measure the transmission, a strong scatterer is put in the diffracting position and the nylon sample is inserted in front of it, immediately beyond the beam defining slits. If the measured intensity without attenuation is Io and the attenuated intensity is I, then the transmission T is I/(Io). A sample with a transmission of 1/e has an optimum thickness since the diffracted intensity from a sample of greater or less thickness than optimum will be less than that from a sample of optimum thickness.

The nylon sample is mounted such that the fiber axis is perpendicular to the beam length (or parallel to the direction of travel of the detector). For a Kratky diffractometer viewing a horizontal line focus, the fiber axis is perpendicular to the table top. A scan of 180 points is collected between 0.1 and 4.0 degrees $2\theta$, as follows: 81 points with step size 0.0125 degrees between 0.1 and 1.1 degrees; 80 points with step size 0.025 degrees between 1.1 and 3.1 degrees; 19 points with step size 0.05 degrees between 3.1 and 4.0 degrees. The time for each scan is 1 hour and the counting time for each point is 20 seconds. The resulting data are smoothed with a moving parabolic window and the instrumental background is subtracted. The instrumental background, i.e. the scan obtained in the absence of a sample, is multiplied by the transmission, T, and subtracted, point by point, from the scan obtained from the sample. The data points of the scan are then corrected for sample thickness by multiplying by a correction factor, $CF=-1.0/(eT\ 1\ n(T))$. Here e is the base of the natural logarithm and 1 n(T) is the natural logarithm of T. Since T is less than 1, 1 n(T) is always negative and CF is positive. Also, if $T=1/e$, then $CF=1$ for the sample of optimum thickness. Therefore, CF is always greater than 1 and corrects the intensity from a sample of other than optimum thickness to the intensity that would have been observed had the thickness been optimum. For sample thicknesses reasonably close to optimum, CF can generally be maintained to less than 1.01 so that the correction for sample thickness can be maintained to less than a percent which is within the uncertainty imposed by the counting statistics.

The measured intensities arise from reflections whose diffraction vectors are parallel to the fiber axis. For most nylon fibers, a reflection is observed in the vicinity of 1 degree $2\theta$. To determine the precise position and intensity of this reflection, a background line is first drawn underneath the peak, tangent to the diffraction curve at angles both higher and lower than the peak itself. A line parallel to the tangent background line is then drawn tangent to the peak near its apparent maximum but generally at a slightly higher $2\theta$ value. The $2\theta$ value at this point of tangency is taken to be the position since it is position of the maximum if the sample background were subtracted. The long period spacing, LPS, is calculated from the Bragg Law using the peak position thus derived. For small angles this reduces to:

$$LPS=\lambda/\sin(2\theta)$$

The intensity of the peak, LPI, is defined as the vertical distance, in counts per second, between the point of tangency of the curve and the background line beneath it.

The Kratky diffractometer is a single beam instrument and measured intensities are arbitrary until standardized. The measured intensities may vary from instrument to instrument and with time for a given instrument because of x-ray tube aging, variation in alignment, drift, and deterioration of the scintillation crystal. For quantitative comparison among samples, measured intensities were normalized by ratioing with a stable, standard reference sample. This reference was chosen to be a nylon 66 sample (T-717 yarn from E.I. du Pont Co., Wilmington, Del.) which was used as feed yarn in the first example of this patent (Feed yarn 1).

Sonic Modulus: Sonic Modulus is measured as reported in Pacofsky U.S. Pat. No. 3,748,844 at col. 5, lines 17 to 38, the disclosure of which is incorporated by reference except that the fibers are conditioned for 24 hours at 70° F. (21 ° C.) and 65% relative humidity prior to the test and the nylon fibers are run at a tension of 0.1 grams per denier rather than the 0.5–0.7 reported for the polyester fibers of the referenced patent.

Accelerated Aging Procedure for Oligomer Deposits: A package of yarn is placed in a controlled temperature (37.8° C.) and humidity (90% RH) environment for 168 hours and then conditioned at 20° C. and 50% RH for 24 hours. After conditioning, 18000 meters of yarn is pulled over a ceramic guide pretensioned to 0.1 g/d at 500 mpm. The deposits that form on the guide are dissolved using methanol into a preweighed aluminum pan. The methanol is allowed to evaporate, and the pan and deposits are weighed. The increase in pan weight is attributed to the deposits. The amount of deposits is expressed as gram of deposits per gram of fiber times $10^6$. The rate of deposition is found to generally increase with higher RV. Incorporation of MPMD in nylon 66 polymer permits use of lower RV polymer at high spin speeds to provide a balance of draw tension less than 1.2 g/d and acceptably low deposit rate.

Cross Polarization combined with "magic angle spinning" (CP/MAS) are Nuclear Magnetic Resonance (NMR) techniques used to collect spectral data which describe differences between the copolymer and homopolymer in both structure and composition. In particular solid state carbon-13 (C-13) and nitrogen-15(N-15) NMR data obtained using CP/MAS can be used to examine contributions from both crystalline and amorphous phases of the polymer. Such techniques are described by Schafer et. al. in Macromolecules 10, 384 (1977) and Schaefer et. al. in J. Magnetic Resonance 34, 443 (1979) and more recently by Veeman and coauthors in Macromolecules 22, 706(1989).

Structural information concerning the amorphous phases of the polymer is obtained by techniques described by Veeman in the above mentioned article and by VanderHart in Macromolecules 12, 1232 (1979) and Macromolecules 18, 1663 (1985).

Parameters governing molecular motion are obtained by a variety of techniques which include C-13 T1 and C-13 T1rho. The C-13 T1 was developed by Torchia and described in J. Magnetic Resonance, vol. 30, 613 (1978). The measurement of C-13 T1rho is described by Schafer in Macromolecules 10, 384 (1977).

Natural abundance nitrogen-15 NMR is used to provide complementary information in addition to that obtained from carbon-13 solid state NMR analysis. This analysis also provides information on the distribution of crystal structures with the polymer as illustrated by Mathias in Polymer Commun. 29, 192 (1988).

MBB Dyeability

For MBB dye testing a set of 42 yarn samples each sample weighing 1 gram is prepared, preferably by jetting the yarn onto small dishes. 9 samples are for control; the remainder are for test.

All samples are then dyed by immersing them into 54 liters of an aqueous dye solution comprised of 140 ml of a standard buffer solution and 80 ml of 1.22% Anthraquinone Milling Blue BL (abbreviated MBB) (C.I. Acid Blue 122). The final bath pH is 5.1. The solution temperature is increased at 3–10~/min. from room temperature to $T_{DYE}$ (dye transition temperature, which is that temperature at which there is a sharp increase in dye uptake rate) and held at that temperature for 3–5 minutes. The dyed samples are rinsed, dried, and measured for dye depth by reflecting colorimeter.

The dye values are determined by computing K/S values from reflectance readings. The equations are:

*MBB* dyeability =

$$\frac{K/S \text{ SAMPLE}}{K/S \text{ CONTROL}} \times 180 \text{ AND } K/S = \frac{(1-R)^2}{2R}$$

when R = the reflectance value. The 180 value is used to adjust and normalize the control sample dyeability to a known base.

ABB Dyeability

A set of samples is prepared in the same manner as for MBB Dyeability. All samples are then dyed by immersing them into 54 liters of an aqueous dye solution comprised of 140 ml of a standard buffer solution, 100 ml of 10% Merpol LFH (a liquid, nonionic detergent from E.I. du Pont de Nemours and Co.), and 80–500 ml of 0.56% ALIZARINE CYANINE BLUE SAP (abbreviated ABB) (C.I. Acid Blue 45). The final bath pH is 5.9. The solution temperature is increased at 3–10~/-min from room temperature to 120~ C., and held at that temperature for 3–5 minutes. The dyed samples are rinsed, dried, and measured for dye depth by reflecting colorimeter.

The dye values are determined by computing K/S values from reflectance readings. The equations are:

*ABB* dyeability =

$$\frac{K/S \text{ SAMPLE}}{K/S \text{ CONTROL}} \times 180 \text{ AND } K/S = \frac{(1-R)^2}{2R}$$

when R = the reflectance value. The 180 value is used to adjust and normalize the control sample dyeability to a known base.

% CV of K/S measured on fabrics provides an indication of LMDR. High LMDR corresponds to low K/S values. Low % CV of K/S values is desirable.

Dye Transition Temperature is that temperature during dyeing at which the fiber structure opens up sufficiently to allow a sudden increase in the rate of dye uptake. It is related to the polymer glass transition temperature, to the thermomechanical history of the fiber, and to the size and configuration of the dye molecule. Therefore it may be viewed as an indirect measure of the "pore" size of the fiber for a particular dye.

The dye transition temperature may be determined for C.I. acid blue 122 dye as follows: Prescour yarn in a bath containing 800 g of bath per g of yarn sample. Add 0.5 g/l of tetrasodium pyrophosphate (TSPP) and 0.5 g/l of Merpol(R) HCS. Raise bath temperature at a rate of 3° C./min. until the bath temperature is 60° C. Hold for 15 minutes at 60° C., then rinse. Note that the prescour temperature must not exceed the dye transition temperature of the fiber. If the dye transition temperature appears to be close to the scour temperature, the procedure should be repeated at a lower scour temperature. Set the bath at 30° C. and add 1% on weight of fabric of C.I. acid blue 122 and 5 g/l of monobasic sodium phosphate. Adjust pH to 5.0 using M.S.P. and acetic acid. Add yarn samples and raise bath temperature to 95° C. at a rate of 3° C./min.

With every 5° C. rise in bath temperature take a dye liquor sample of ~25 ml from the dye bath. Cool the samples to room temperature and measure the absorbance of each sample at the maximum absorbance of about 633 nm on a spectrophotometer using a water reference. Calculate the % dye exhaust and plot % dye exhaust vs dyebath temperature. Draw intersecting lines along each of the two straight portions of the curve. The temperature at the intersection is the dye transition temperature ($T_{DYE}$) which is a measure of the openness of the fiber structure and preferred values of $T_{DYE}$ for warp drawn yarns are less than about 65° C., especially less than about 60° C.

The denier variation analyzer (DVA) is a capacitance instrument, using the same principle as the Uster, for measuring along-end denier variation. The DVA measures the change in denier every ½ meter over a 240 meter sample length and reports % CV of these measurements. It also reports % denier spread, which is the average of the high minus low readings for eight 30 meter samples. Measurements in tables using the DVA are reported as coefficient of variation (DVA % CV).

Dynamic Mechanical Analysis tests are made according to the following procedure. A "Rheovibron" DDV-IIc equipped with an "Autovibron" computerization kit from Imass, Inc., Hingham Mass. and an IMC-1 furnace, also from Imass, Inc., are used. Standard, stainless steel specimen support rods and fiber clamps, also from Imass, Inc., are used. The computer program supplied with the Autovibron has been modified so that constant, selectable, heating rate and static tension on the specimen can be maintained over the temperature range −30 to 220 degrees C. It has also been modified to print the static tension, time and current specimen length whenever a data point is taken so that the constancy of tension and heating rate can be confirmed and that shrinkage vs. temperature can be measured at constant stress. This computer program contains no corrections for clamp mass and load-cell compliance, and all operations and calculations, except as described above, are as provided by Imass with the Autovibron.

For tests on specimens of this invention a static tension corresponding with 0.1 grams per denier (based on pre-test denier) is used. A heating rate of 1.4 ±0.1 degrees C/minute is used and the test frequency is 110 Hz. The computerization equipment makes one reading approximately every 1.5 minutes, but this is not constant because of variable time required for the computer to maintain the static tension constant by adjustment of specimen length. The initial specimen length is 2.0±0.1 cm. The test is run over the temperature range −30 to 230 degrees C. Specimen denier is adjusted to 400±30 by plying or dividing the yarn to assure that dynamic and static forces are in the middle of the load cell range.

The position (i.e., temperature) of tan delta and E″ peaks is determined by the following method. First the approximate position of a peak is estimated from a plot of the appropriate parameter vs. temperature. The final position of the peak is determined by least squares fitting a second order polynomial over a range of ±10–15 degrees with respect to this estimated position considering temperature to be the independent variable. The peak temperature is taken as the temperature of the maximum of this polynomial. Transition temperatures, i.e., the temperature of inflection points are determined similarly. The approximate inflection point is estimated from a plot. Then sufficient data points to cover the transition from one apparent plateau to the other are fitted to a third order polynomial considering temperature to be the independent variable. The transition temperature is taken as the inflection point of the resulting polynomial. The E" peak temperature ($T_{E''max}$) around 100° C. (see FIG. 12) is taken as the indicator of the alpha transition temperature ($T_A$) and it is important to have this a low value (i.e., less than 100° C., preferably less than 95° C., especially less than 90° C.) for uniform dyeability.

Dye Rate Methods

It is well known that the dye rate of nylon fibers is strongly dependent on the structure. The radial and axial diffusion coefficients of dyes in nylon fibers may be measured according to the procedures described in Textile Research Institute of Princeton, N.J., in Dye Transport Phenomena, Progress Report No. 15 and references therein.

The loss of dye from a dye bath and thus sorption of the dye by the fiber and calculation of a diffusion coefficient from the data may be carried out using the procedures described by H. Kobsa in a series of articles in Textile Research Journal, Vol. 55, No. 10, October 1985 beginning at page 573. A variation of this method is available at the Hanby Textile Institute of Carey, N.C.

In a modification of Kobsa's technique we take 2.5 gm of fiber as received and placed in a bath (Ahiba type Turbocolor-100 with a PC 091 controller Ahiba AG, Basel Switzerland) containing 700 ml of dye solution containing 0.125 gm of Milling Blue BL (C.I. Acid Blue 80, although C.I. Acid Blue 122 gives similar results). The dye solution is made by adding 50 ml from a stock solution containing 2.5 gm dye/liter deionized water, 0.5 gram sodium dihydrogen phosphate monohydrate, and 1 drop of Dow-Corning Antifoam "B" and making up to one liter with deionized water. Dyebath pH is 4.5±0.02, and the temperature is controlled to ±2° C. A probe from an Optical Waveguide Spectrum Analyzer Model 200 made by Guided Wave Inc. (El Dorado Hills, Calif.) is permanently inserted into the Ahiba dyebath to measure changes in absorbance and thus dye concentration in the bath, preferably using the wavelength of absorbance maximum in the dye spectrum. By this technique we measure both the time and temperature dependence of the dye rate of fibers. Fibers can be removed from the bath at various times before dyeing is complete and the dye concentration profile across the fiber can be measured as a measure of structure as described by the Textile Research Institute publications. The temperature dependence of dye rate and diffusional properties can also be used as a measure of changes in structure with temperature.

A second dye method involves treating the fiber as the stationary phase in a liquid chromatography system and the dye as a sorbing material in the mobile phase. A Hewlett Packard model 1084B liquid chromatograph with a UV detector supplied by the manufacturer, Hewlett Packard, Palo Alto, Calif., is used with one gram of fiber packed into a 20 cm. stainless steel column, ¼ inch inner diameter. Deionized water is pumped upward through the vertical column at a flow rate of two ml/minute. The water is replaced with a dye solution similar to that described above but omitting the antifoam. The temperature of the system is maintained at 30° C. although this can be varied to determine the temperature dependence of the effects. The dye content of the effluent water is measured by the detector measuring at a wavelength of 584 nanometers (nm) where the dye absorbance is near maximum with reference to the absorbance at 450 nm where the dye absorbance is low. At first the dye content of the effluent is near zero, then the dye content rises rapidly to a slowly rising plateau. After ½ hour, before the fiber has reached equilibrium dye content, the dye solution being pumped into the column is replaced with deionized water. When the water front passes through the column a front of dye is released by the fiber in which the dye concentration may surpass that of the dye solution. From the slopes and areas under the curve of effluent absorbance vs. volume we determine differences in surface characters and dye diffusional properties.

TABLE I

| Item | | Spin Speed | N6 | Relative Viscosity | | | Tp | DT | Eb |
|---|---|---|---|---|---|---|---|---|---|
| No. | Den. | MPM | % | Flake | Yarn | ΔRV | °C. | G/D | % |
| I-1C | 53.8 | 4500 | 0 | 40.0 | 39.6 | (0.4) | 288 | 1.10 | 67.0 |
| I-2C | 53.4 | 4500 | 0 | 40.0 | 44.0 | 4.0 | 288 | 1.06 | 70.6 |
| I-3C | 53.5 | 4500 | 0 | 40.0 | 50.1 | 10.1 | 288 | 0.93 | 78.8 |
| I-4C | 54.2 | 4500 | 0 | 42.0 | 58.0 | 16.0 | 288 | 0.87 | 89.7 |
| I-5C | 53.4 | 4500 | 0 | 40.0 | 68.2 | 28.2 | 288 | 0.93 | 86.9 |
| I-6C | 53.5 | 4500 | 0 | 40.0 | 72.2 | 32.2 | 288 | 0.96 | 82.4 |
| I-7C | 53.5 | 5300 | 0 | 40.0 | 39.6 | (0.4) | 288 | 1.47 | 57.3 |
| I-8C | 53.6 | 5300 | 0 | 40.0 | 44.0 | 4.0 | 288 | 1.38 | 62.9 |
| I-9C | 53.5 | 5300 | 0 | 40.0 | 50.1 | 10.1 | 288 | 1.30 | 66.1 |
| I-10C | 53.4 | 5300 | 0 | 40.0 | 52.8 | 12.8 | 288 | 1.34 | 66.1 |
| I-11C | 50.5 | 5300 | 0 | 40.0 | 66.0 | 26.0 | 288 | 1.28 | 77.0 |
| I-12C | 53.3 | 5300 | 0 | 40.0 | 72.2 | 32.2 | 288 | 1.19 | 76.2 |
| I-13 | 53.6 | 5000 | 5 | 41.6 | 64.1 | 22.5 | 288 | 0.96 | 79.5 |
| I-14 | 54.0 | 5000 | 5 | 41.6 | 55.0 | 13.4 | 288 | 1.10 | 68.0 |
| I-15 | 53.2 | 5300 | 5 | 41.5 | 73.9 | 22.4 | 288 | 1.04 | 80.3 |
| I-16 | 53.6 | 5300 | 5 | 41.6 | 64.1 | 22.5 | 288 | 1.05 | 73.2 |
| I-17 | 53.0 | 5300 | 5 | 41.6 | 55.0 | 13.4 | 288 | 1.21 | 71.2 |
| I-18 | 54.0 | 5300 | 5 | 41.6 | 63.9 | 22.3 | 288 | 1.13 | 74.6 |
| I-19 | 50.5 | 5300 | 5 | 40.0 | 63.0 | 23.0 | 290 | 1.23 | 77.0 |
| I-20 | 53.4 | 5300 | 5 | 41.6 | 66.4 | 24.8 | 293 | 1.09 | 80.9 |
| I-21 | 53.5 | 5300 | 5 | 40.0 | 63.9 | 23.9 | 293 | 1.06 | 79.9 |
| I-22C | 54.4 | 5300 | 5 | 41.1 | 40.5 | (0.6) | 288 | 1.50 | 63.5 |
| I-23C | 54.3 | 5300 | 5 | 42.6 | 45.6 | 3.0 | 288 | 1.60 | 61.6 |
| I-24 | 54.3 | 5300 | 5 | 42.8 | 47.4 | 4.6 | 288 | 1.15 | 67.0 |
| I-25 | 27.1 | 5000 | 2.5 | 42.0 | 66.3 | 14.3 | 291 | 0.92 | 80.7 |

TABLE I-continued

| Item No. | Den. | Spin Speed MPM | N6 % | Relative Viscosity Flake | Yarn | ΔRV | Tp °C. | DT G/D | Eb % |
|---|---|---|---|---|---|---|---|---|---|
| I-26 | 27.4 | 5000 | 2.5 | 42.0 | 70.5 | 28.5 | 291 | 0.97 | 80.9 |
| I-27 | 25.8 | 5300 | 2.5 | 42.0 | 66.3 | 24.3 | 291 | 1.00 | 79.0 |
| I-28 | 25.6 | 5300 | 2.5 | 42.0 | 70.5 | 28.5 | 291 | 1.06 | 76.9 |
| I-29 | 27.3 | 5000 | 5 | 48.0 | 49.6 | 1.6 | 291 | 0.87 | 77.8 |
| I-30 | 27.5 | 5000 | 5 | 48.0 | 51.7 | 3.7 | 291 | 0.89 | 78.1 |
| I-31 | 27.5 | 5000 | 5 | 48.0 | 59.0 | 11.0 | 291 | 0.87 | 82.7 |
| I-32 | 26.8 | 5000 | 5 | 48.0 | 66.6 | 18.6 | 291 | 0.94 | 81.6 |
| I-33 | 27.1 | 5000 | 5 | 48.0 | 72.9 | 24.9 | 291 | 0.93 | 77.8 |
| I-34 | 25.9 | 5300 | 5 | 48.0 | 43.4 | (4.6) | 291 | 0.92 | 72.5 |
| I-35 | 25.9 | 5300 | 5 | 48.0 | 51.7 | 3.7 | 291 | 0.98 | 76.3 |
| I-36 | 25.9 | 5300 | 5 | 48.0 | 59.0 | 11.0 | 291 | 0.96 | 79.5 |
| I-37 | 25.0 | 5300 | 5 | 43.0 | 64.0 | 21.0 | 290 | 1.00 | 79.0 |
| I-38 | 25.8 | 5300 | 5 | 48.0 | 66.6 | 18.6 | 291 | 0.99 | 78.7 |
| I-39C | 25.7 | 5000 | 0 | 42.0 | 48.0 | 6.0 | 288 | 1.07 | 71.4 |
| I-40C | 26.0 | 5000 | 0 | 42.0 | 53.0 | 5.0 | 288 | 0.98 | 76.0 |
| I-41C | 25.8 | 5000 | 0 | 42.0 | 58.0 | 16.0 | 288 | 0.96 | 78.9 |
| I-42C | 25.5 | 5000 | 0 | 42.0 | 68.0 | 26.0 | 288 | 1.01 | 80.9 |
| I-43C | 25.6 | 5300 | 0 | 42.0 | 48.0 | 6.0 | 288 | 1.19 | 67.8 |
| I-44C | 25.9 | 5300 | 0 | 42.0 | 58.0 | 16.0 | 288 | 1.05 | 72.5 |
| I-45C | 25.5 | 5300 | 0 | 42.0 | 68.0 | 26.0 | 288 | 1.13 | 73.6 |
| I-46C | 25.8 | 5300 | 0 | 42.0 | 64.4 | 22.4 | 291 | 1.19 | 73.7 |
| I-47 | 51.6 | 3500 | 5 | 39.0 | 71.1 | 32.1 | 290 | 0.85 | 86.8 |
| I-48 | 51.5 | 4000 | 5 | 39.0 | 69.1 | 30.1 | 290 | 1.02 | 80.1 |
| I-49 | 54.0 | 5000 | 5 | 41.6 | 55.0 | 13.4 | 288 | 1.10 | 68.0 |
| I-50 | 53.6 | 5000 | 5 | 41.6 | 64.1 | 22.5 | 288 | 0.96 | 79.5 |
| I-51 | 53.3 | 5000 | 5 | 41.6 | 73.9 | 32.3 | 288 | 0.96 | 83.8 |
| I-52C | 54.4 | 5300 | 5 | 39.0 | 40.5 | 1.5 | 288 | 1.50 | 63.5 |
| I-53C | 54.3 | 5300 | 5 | 39.0 | 45.0 | 6.0 | 288 | 1.39 | 66.8 |
| I-54C | 50.7 | 5300 | 5 | 39.0 | 51.1 | 12.1 | 288 | 1.32 | 66.3 |
| I-55 | 53.0 | 5300 | 5 | 41.6 | 55.0 | 13.4 | 288 | 1.21 | 71.2 |
| I-56 | 50.0 | 5300 | 5 | 39.0 | 58.9 | 19.9 | 288 | 1.17 | 75.6 |
| I-57 | 50.9 | 5300 | 5 | 41.6 | 64.1 | 22.5 | 288 | 1.05 | 72.0 |
| I-58 | 51.2 | 5300 | 5 | 39.0 | 67.0 | 28.0 | 290 | 1.14 | 78.1 |
| I-59C | 54.3 | 5600 | 5 | 39.0 | 45.5 | 6.5 | 288 | 1.53 | 63.3 |
| I-60C | 54.1 | 5600 | 5 | 41.6 | 55.0 | 13.4 | 288 | 1.34 | 61.8 |
| I-61 | 53.9 | 5600 | 5 | 41.6 | 64.1 | 22.5 | 288 | 1.14 | 72.0 |
| I-62 | 53.4 | 5600 | 5 | 41.6 | 73.9 | 32.2 | 288 | 1.11 | 79.0 |
| I-63C | 52.4 | 3500 | 0 | 40.0 | 39.6 | (0.6) | 288 | 0.62 | 76.6 |
| I-64C | 52.5 | 3500 | 0 | 40.0 | 39.6 | (0.6) | 288 | 0.76 | 75.4 |
| I-65C | 53.4 | 3500 | 0 | 40.0 | 50.1 | 10.1 | 288 | 0.59 | 91.5 |
| I-66C | 53.6 | 3500 | 0 | 40.0 | 68.2 | 28.2 | 288 | 0.67 | 99.8 |
| I-67C | 53.4 | 3500 | 0 | 40.0 | 72.2 | 32.2 | 288 | 0.72 | 100.2 |
| I-68C | 53.8 | 4500 | 0 | 40.0 | 39.6 | (0.4) | 288 | 1.10 | 67.0 |
| I-69C | 53.4 | 4500 | 0 | 40.0 | 44.0 | 4.0 | 288 | 1.06 | 70.6 |
| I-70C | 53.5 | 4500 | 0 | 40.0 | 50.1 | 10.1 | 288 | 0.93 | 78.8 |
| I-71C | 51.6 | 4500 | 0 | 40.0 | 62.9 | 22.9 | 288 | 1.29 | 70.8 |
| I-72C | 53.4 | 4500 | 0 | 40.0 | 68.2 | 28.9 | 288 | 0.93 | 86.9 |
| I-73C | 53.5 | 4500 | 0 | 40.0 | 72.2 | 32.2 | 288 | 0.96 | 82.4 |
| I-74C | 53.8 | 5000 | 0 | 40.0 | 39.6 | (0.4) | 288 | 1.31 | 61.9 |
| I-75C | 53.7 | 5000 | 0 | 40.0 | 44.0 | 4.0 | 288 | 1.28 | 63.4 |
| I-76C | 53.7 | 5000 | 0 | 40.0 | 50.1 | 10.0 | 288 | 1.14 | 72.2 |
| I-77C | 53.5 | 5000 | 0 | 40.0 | 68.2 | 28.9 | 288 | 1.07 | 81.2 |
| I-78C | 53.4 | 5000 | 0 | 40.0 | 72.2 | 32.2 | 288 | 1.10 | 79.6 |
| I-79C | 53.5 | 5300 | 0 | 40.0 | 39.6 | (0.4) | 288 | 1.47 | 57.3 |
| I-80C | 53.6 | 5300 | 0 | 40.0 | 44.0 | 4.0 | 288 | 1.38 | 62.9 |
| I-81C | 52.7 | 5300 | 0 | 43.5 | 49.7 | 6.2 | 288 | 1.24 | 70.0 |
| I-82C | 54.0 | 5300 | 0 | 43.5 | 50.3 | 6.8 | 288 | 1.20 | 71.5 |
| I-83C | 53.7 | 5300 | 0 | 43.5 | 52.3 | 8.8 | 288 | 1.15 | 74.4 |
| I-84C | 53.8 | 5300 | 0 | 40.0 | 64.7 | 24.7 | 288 | 1.15 | 76.2 |
| I-85C | 53.8 | 5300 | 0 | 40.0 | 68.5 | 28.5 | 288 | 1.15 | 75.7 |
| I-86C | 53.0 | 5300 | 0 | 40.0 | 71.8 | 31.8 | 288 | 1.19 | 75.6 |
| I-87C | 53.0 | 5300 | 0 | 40.0 | 74.2 | 34.2 | 288 | 1.18 | 77.4 |
| I-88C | 53.5 | 5600 | 0 | 40.0 | 39.6 | (0.4) | 288 | 1.55 | 57.1 |
| I-89C | 53.6 | 5600 | 0 | 40.0 | 44.0 | 4.0 | 288 | 1.57 | 60.0 |
| I-90C | 53.5 | 5600 | 0 | 40.0 | 50.1 | 10.1 | 288 | 1.41 | 64.8 |
| I-91C | 53.6 | 5600 | 0 | 40.0 | 68.2 | 28.2 | 288 | 1.26 | 75.0 |
| I-92C | 53.3 | 5600 | 0 | 40.0 | 72.2 | 32.2 | 288 | 1.26 | 73.5 |

TABLE II

| Item No. | Relative Viscosity Flake | Yarn | ΔRV | Tp °C. | D, MM | L/D | Quench MPM | Air °C. | Lc CM | DT G/D |
|---|---|---|---|---|---|---|---|---|---|---|
| II-1 | 41.6 | 63.9 | 22.3 | 283 | .254 | 1.9 | 18.3 | 21 | 122 | 1.13 |
| II-2 | 41.6 | 63.9 | 22.3 | 293 | .254 | 1.9 | 18.3 | 21 | 122 | 1.11 |
| II-3 | 41.6 | 63.9 | 22.3 | 293 | .254 | 1.9 | 6.1 | 21 | 122 | 1.17 |
| II-4 | 41.6 | 63.9 | 22.3 | 293 | .254 | 1.9 | 18.3 | 40 | 122 | 1.15 |
| II-5 | 40.4 | 62.4 | 22.0 | 288 | .229 | 1.9 | 18.3 | 21 | 135 | 1.04 |

TABLE II-continued

| Item No. | Relative Viscosity Flake | Yarn | ΔRV | Tp °C. | D, MM | L/D | Quench MPM | Air °C. | Lc CM | DT G/D |
|---|---|---|---|---|---|---|---|---|---|---|
| II-6 | 40.4 | 62.4 | 22.0 | 288 | .254 | 1.9 | 18.3 | 21 | 135 | 1.09 |
| II-7 | 41.6 | 63.9 | 22.3 | 283 | .254 | 4.0 | 18.3 | 21 | 122 | 1.16 |
| II-8 | 41.6 | 63.9 | 22.3 | 283 | .254 | 1.9 | 18.3 | 21 | 122 | 1.19 |
| II-9 | 40.4 | 67.5 | 27.1 | 293 | .203 | 1.9 | 18.3 | 21 | 122 | 1.00 |
| II-10 | 40.4 | 67.5 | 27.1 | 293 | .203 | 1.9 | 18.3 | 21 | 76 | 1.07 |
| II-11C | 40.4 | 54.2 | 13.8 | 293 | .254 | 1.9 | 6.1 | 21 | 122 | 1.27 |
| II-12 | 40.4 | 54.2 | 13.8 | 293 | .254 | 1.9 | 18.3 | 21 | 122 | 1.19 |
| II-13 | 40.4 | 54.2 | 13.8 | 293 | .254 | 1.9 | 30.3 | 21 | 122 | 1.17 |
| II-14 | 40.4 | 54.2 | 13.8 | 293 | .254 | 1.9 | 18.3 | 21 | 122 | 1.17 |
| II-15C | 40.4 | 54.2 | 13.8 | 293 | .254 | 1.9 | 18.3 | 40 | 122 | 1.26 |
| II-16C | 40.4 | 54.2 | 13.8 | 293 | .254 | 1.9 | 18.3 | 21 | 102 | 1.26 |
| II-17C | 40.4 | 54.2 | 13.8 | 293 | .254 | 1.9 | 18.3 | 21 | 102 | 1.40 |
| II-18 | 39.0 | 63.9 | 24.9 | 283 | .254 | 1.9 | 6.1 | 21 | 122 | 1.21 |
| II-19 | 39.0 | 63.9 | 24.9 | 293 | .203 | 4.0 | 18.3 | 21 | 122 | 1.12 |
| II-20 | 39.0 | 67.0 | 28.0 | 290 | .254 | 1.9 | 18.3 | 21 | 135 | 1.14 |
| II-21 | 39.0 | 67.3 | 28.3 | 290 | .254 | 1.9 | 18.3 | 21 | 135 | 1.11 |

TABLE III

| Item | Denier | DPF | D, mm | DT* gpd | Ten. gpd | $E_B$ % | BOS % |
|---|---|---|---|---|---|---|---|
| III-1 | 13.5 | 1.04 | 0.229 | 2.07 | 2.96 | 64 | 3.6 |
| III-2 | 17.1 | 1.32 | 0.254 | 1.99 | 3.22 | 80 | 6.2 |
| III-3 | 18.9 | 1.45 | 0.229 | 1.80 | 3.70 | 70 | 6.7 |
| III-4 | 20.7 | 1.59 | 0.254 | 1.80 | 3.14 | 82 | 4.2 |
| III-5 | 22.5 | 1.73 | 0.254 | 2.01 | 3.11 | 70 | 5.2 |
| III-6 | 26.1 | 2.01 | 0.229 | 1.57 | 3.45 | 90 | 4.4 |
| III-7 | 32.4 | 2.49 | 0.229 | 1.33 | 2.72 | 89 | 4.8 |
| III-8 | 92.7 | 7.13 | 0.339 | 1.56 | 2.55 | 77 | 4.6 |

*DT measured at room temperature (20 C.) insteat of 185 C.

TABLE IV

| Feed Yarn | D/Y Ratio | Avg. $T_2/T_2$ | Pre-disc Draw Stress ($\sigma_1$) vs. TDR 1.2727 | 1.2984 | 1.3333 | 1.3594 | 1.3781 | 1.3962 |
|---|---|---|---|---|---|---|---|---|
| I-46C | 2.04 | 1.35 | 0.484 | 0.519 | 0.611 | 0.680 | 0.717 | 0.754 |
| I-37 | 2.04 | 1.32 | 0.445 | 0.467 | 0.587 | 0.598 | 0.620 | 0.670 |
| I-46C | 2.62 | 1.14 | 0.560 | 0.597 | 0.667 | 0.775 | 0.827 | 0.894 |
| I-37 | 2.62 | 1.09 | 0.484 | 0.532 | 0.613 | 0.680 | 0.744 | 0.782 |

TABLE V

| ITEM NO. | $T_D$ C | Draw Stress ($\sigma$), g/d 1.05X | 1.10X | 1.15X | 1.20X | 1.25X | 1.30X | 1.33X | 1.35X | 1.40X | 1.45X | 1.55X |
|---|---|---|---|---|---|---|---|---|---|---|---|---|
| V-1-1 | 75 | 0.36 | 0.56 | 0.77 | 0.98 | 1.24 | 1.48 | 1.64 | 1.75 | 2.02 | 2.34 | 2.75 |
| V-1-2 | 125 | 0.26 | 0.41 | 0.59 | 0.78 | 0.99 | 1.21 | 1.35 | 1.44 | 1.68 | 1.97 | 2.33 |
| V-1-3 | 173 | 0.22 | 0.35 | 0.51 | 0.72 | 0.87 | 1.05 | 1.17 | 1.25 | 1.48 | 1.72 | 2.05 |
| V-2-1 | 75 | 0.40 | 0.63 | 0.88 | 1.13 | 1.40 | 1.70 | 1.89 | 2.02 | 2.33 | 2.71 | |
| V-2-2 | 125 | 0.26 | 0.45 | 0.66 | 0.89 | 1.11 | 1.38 | 1.54 | 1.65 | 1.94 | 2.23 | 2.93 |
| V-2-3 | 173 | 0.21 | 0.36 | 0.52 | 0.71 | 0.92 | 1.13 | 1.28 | 1.37 | 1.63 | 1.92 | 2.52 |
| V-3-1 | 75 | 0.35 | 0.54 | 0.73 | 0.91 | 1.09 | 1.28 | 1.40 | 1.47 | 1.67 | 1.91 | 2.25 |
| V-3-2 | 125 | 0.17 | 0.27 | 0.40 | 0.54 | 0.69 | 0.84 | 0.95 | 1.03 | 1.22 | 1.43 | 1.69 |
| V-3-3 | 173 | 0.11 | 0.19 | 0.28 | 0.37 | 0.49 | 0.62 | 0.70 | 0.76 | 0.92 | 1.10 | 1.34 |

TABLE VIA

| ITEM NO. | SPEED MPM | HEATER °C. | D/Y RATIO | TDR | STRESS $\sigma_1$, G/D | BULK % |
|---|---|---|---|---|---|---|
| VIA-1 | 800 | 220 | 2.455 | 1.348 | 0.319 | 12.5 |
| VIA-2 | 800 | 240 | 2.290 | 1.318 | 0.260 | 14.6 |
| VIA-3 | 800 | 2450 | 2.290 | 1.378 | 0.333 | 14.0 |
| VIA-4 | 800 | 240 | 2.620 | 1.318 | 0.240 | 13.7 |
| VIA-5 | 800 | 240 | 2.620 | 1.378 | 0.313 | 14.1 |
| VIA-6 | 900 | 200 | 2.455 | 1.348 | 0.346 | 10.8 |
| VIA-7 | 900 | 220 | 2.455 | 1.318 | 0.286 | 12.0 |
| VIA-8 | 900 | 220 | 2.455 | 1.348 | 0.332 | 12.5 |
| VIA-9 | 900 | 220 | 2.455 | 1.378 | 0.360 | 13.0 |
| VIA-10 | 900 | 240 | 2.455 | 1.348 | 0.292 | 13.8 |
| VIA-11 | 1000 | 200 | 2.290 | 1.318 | 0.331 | 9.2 |
| VIA-12 | 1000 | 200 | 2.620 | 1.318 | 0.351 | 10.4 |
| VIA-13 | 1000 | 220 | 2.455 | 1.348 | 0.339 | 11.6 |
| VIA-14 | 1000 | 240 | 2.290 | 1.318 | 0.312 | 10.7 |

TABLE VIA-continued

| ITEM NO. | SPEED MPM | HEATER °C. | D/Y RATIO | TDR | STRESS $\sigma_1$, G/D | BULK % |
|---|---|---|---|---|---|---|
| VIA-15 | 1000 | 240 | 2.290 | 1.378 | 0.340 | 13.1 |
| VIA-16 | 1000 | 240 | 2.620 | 1.318 | 0.312 | 10.5 |
| VIA-17 | 1000 | 240 | 2.620 | 1.378 | 0.374 | 13.0 |

TABLE VIB

| ITEM NO. | SPEED MPM | HEATER °C. | D/Y RATIO | TDR | STRESS $\sigma_1$, G/D | BULK % |
|---|---|---|---|---|---|---|
| VIB-1C | 800 | 220 | 2.455 | 1.348 | 0.367 | 12.1 |
| VIB-2C | 800 | 240 | 2.290 | 1.318 | 0.287 | 14.3 |
| VIB-3C | 800 | 240 | 2.290 | 1.378 | 0.348 | 15.4 |
| VIB-4C | 800 | 240 | 2.620 | 1.318 | 0.267 | 13.2 |
| VIB-5C | 800 | 240 | 2.620 | 1.378 | 0.355 | 13.4 |
| VIB-6C | 900 | 200 | 2.455 | 1.348 | 0.390 | 10.4 |
| VIB-7C | 900 | 220 | 2.455 | 1.318 | 0.320 | 11.4 |
| VIB-8C | 900 | 220 | 2.455 | 1.348 | 0.371 | 12.5 |
| VIB-9C | 900 | 220 | 2.455 | 1.378 | 0.362 | 12.9 |
| VIB-10C | 900 | 240 | 2.455 | 1.348 | 0.327 | 13.1 |
| VIB-11C | 1000 | 200 | 2.290 | 1.318 | 0.341 | 10.2 |
| VIB-12C | 1000 | 200 | 2.620 | 1.318 | 0.365 | 9.8 |
| VIB-13C | 1000 | 220 | 2.455 | 1.348 | 0.374 | 11.2 |
| VIB-14C | 1000 | 240 | 2.290 | 1.318 | 0.313 | 12.6 |
| VIB-15C | 1000 | 240 | 2.290 | 1.378 | 0.368 | 14.7 |
| VIB-16C | 1000 | 240 | 2.620 | 1.318 | 0.313 | 11.9 |
| VIB-17C | 1000 | 240 | 2.620 | 1.378 | 0.375 | 12.3 |

TABLE VII

| ITEM NO. | DEN | SPEED M/MIN | YARN RV | DT G/D | Eb % |
|---|---|---|---|---|---|
| VII-1C | 51.6 | 4300 | 47.9 | 1.19 | 69.5 |
| VII-2C | 51.8 | 4300 | 49.0 | 1.03 | 71.0 |
| VII-3C | 51.4 | 4300 | 52.2 | 0.91 | 77.9 |
| VII-4C | 51.5 | 4300 | 59.0 | 0.89 | 76.3 |
| VII-5C | 51.6 | 4300 | 64.2 | 0.88 | 81.7 |
| VII-6C | 51.9 | 4300 | 72.2 | 0.95 | 78.6 |
| VII-7C | 51.7 | 4800 | 47.9 | 1.36 | 64.0 |
| VII-8C | 52.0 | 4800 | 49.0 | 1.21 | 67.6 |
| VII-9C | 51.2 | 4800 | 52.2 | 1.08 | 71.4 |
| VII-10C | 51.7 | 4800 | 59.0 | 1.04 | 71.0 |
| VII-11C | 51.5 | 4800 | 64.2 | 1.08 | 72.4 |
| VII-12C | 52.1 | 4800 | 72.2 | 1.07 | 73.2 |

TABLE VII-continued

| ITEM NO. | DEN | SPEED M/MIN | YARN RV | DT G/D | Eb % |
|---|---|---|---|---|---|
| VII-13C | 51.8 | 5300 | 47.9 | 1.55 | 62.8 |
| VII-14C | 51.9 | 5300 | 49.0 | 1.41 | 65.0 |
| VII-15C | 51.3 | 5300 | 52.2 | 1.24 | 68.0 |
| VII-16C | 51.7 | 5300 | 59.0 | 1.21 | 68.6 |
| VII-17C | 52.1 | 5300 | 64.2 | 1.18 | 68.7 |
| VII-18C | 51.7 | 5300 | 72.2 | 1.21 | 68.3 |
| VII-19C | 52.0 | 5800 | 47.9 | 1.74 | 55.9 |
| VII-20C | 52.1 | 5800 | 49.0 | 1.61 | 63.3 |
| VII-21C | 51.6 | 5800 | 52.2 | 1.45 | 64.2 |
| VII-22C | 51.6 | 5800 | 59.0 | 1.38 | 65.1 |
| VII-23C | 51.9 | 5800 | 64.2 | 1.36 | 63.9 |
| VII-24C | 51.2 | 5800 | 72.2 | 1.34 | 65.1 |

TABLE VIII

| ITEM NO. | DEN | SPEED MPM | MPMD % | YARN RV | Tp c | DT G/D | EB % |
|---|---|---|---|---|---|---|---|
| VIII-1 | 51.3 | 4500 | 5 | 49.6 | 290 | 0.90 | 85.9 |
| VIII-2 | 50.8 | 4500 | 5 | 56.4 | 290 | 0.86 | 87.5 |
| VIII-3 | 51.1 | 4500 | 5 | 66.4 | 290 | 0.87 | 88.5 |
| VIII-4 | 51.5 | 5000 | 5 | 49.6 | 290 | 1.08 | 79.0 |
| VIII-5 | 51.1 | 5000 | 5 | 56.4 | 290 | 1.01 | 81.3 |
| VIII-6 | 50.5 | 5000 | 5 | 66.4 | 290 | 0.99 | 83.7 |
| VIII-7 | 51.3 | 5300 | 5 | 49.6 | 290 | 1.19 | 74.3 |
| VIII-8 | 50.7 | 5300 | 5 | 56.4 | 290 | 1.12 | 78.3 |
| VIII-9 | 50.7 | 5300 | 5 | 66.4 | 290 | 1.10 | 81.5 |
| VIII-10C | 51.5 | 5600 | 5 | 49.6 | 290 | 1.33 | 71.4 |
| VIII-11C | 51.4 | 5600 | 5 | 56.4 | 290 | 1.24 | 74.8 |
| VIII-12 | 50.9 | 5600 | 5 | 66.4 | 290 | 1.19 | 79.7 |
| VIII-13C | 56.9 | 5900 | 5 | 49.6 | 290 | 1.39 | 67.1 |
| VIII-14C | 50.9 | 5900 | 5 | 56.4 | 290 | 1.32 | 72.5 |
| VIII-15C | 51.0 | 5900 | 5 | 66.4 | 290 | 1.30 | 75.8 |
| VIII-16 | 50.7 | 4500 | 10 | 47.6 | 280 | 0.92 | 78.4 |
| VIII-17 | 51.9 | 4500 | 10 | 54.6 | 280 | 0.97 | 80.6 |
| VIII-18 | 51.3 | 4500 | 10 | 61.9 | 280 | 0.83 | 88.0 |
| VIII-19 | 52.0 | 5000 | 10 | 47.6 | 280 | 1.08 | 73.0 |
| VIII-20 | 51.1 | 5000 | 10 | 54.6 | 280 | 1.04 | 78.5 |
| VIII-21 | 51.8 | 5000 | 10 | 61.9 | 280 | 0.96 | 81.0 |
| VIII-22 | 51.9 | 5300 | 10 | 47.6 | 280 | 1.17 | 71.0 |
| VIII-23 | 51.7 | 5300 | 10 | 54.6 | 280 | 1.09 | 77.2 |
| VIII-24 | 51.7 | 5300 | 10 | 61.9 | 280 | 1.09 | 78.0 |
| VIII-25C | 52.0 | 5600 | 10 | 47.6 | 280 | 1.29 | 66.0 |
| VIII-26 | 51.9 | 5600 | 10 | 54.6 | 280 | 1.13 | 72.2 |
| VIII-27 | 51.1 | 5600 | 10 | 61.9 | 280 | 1.16 | 75.5 |
| VIII-28 | 51.9 | 5900 | 10 | 47.6 | 280 | 1.40 | 60.2 |
| VIII-29 | 51.6 | 5900 | 10 | 54.6 | 280 | 1.25 | 67.8 |
| VIII-30C | 51.5 | 5900 | 10 | 61.9 | 280 | 1.18 | 73.4 |
| VIII-31 | 52.5 | 4500 | 20 | 39.9 | 275 | 1.09 | 72.0 |
| VIII-32 | 51.9 | 4500 | 20 | 50.1 | 275 | 0.83 | 80.7 |
| VIII-33 | 51.0 | 4500 | 20 | 66.8 | 275 | 0.87 | 80.6 |
| VIII-34C | 52.3 | 5000 | 20 | 39.9 | 275 | 1.22 | 66.7 |
| VIII-35 | 52.0 | 5000 | 20 | 50.1 | 275 | 1.03 | 74.2 |
| VIII-36 | 51.7 | 5000 | 20 | 66.8 | 275 | 0.99 | 76.8 |
| VIII-37C | 53.4 | 5300 | 20 | 39.9 | 275 | 1.25 | 66.5 |
| VIII-38 | 51.8 | 5300 | 20 | 50.1 | 275 | 1.09 | 72.8 |
| VIII-39 | 50.5 | 5300 | 20 | 66.8 | 275 | 1.04 | 74.5 |
| VIII-40C | 52.1 | 5600 | 20 | 39.9 | 275 | 1.33 | 62.2 |
| VIII-41 | 51.9 | 5600 | 20 | 50.1 | 275 | 1.18 | 67.7 |
| VIII-42 | 51.4 | 5600 | 20 | 66.8 | 275 | 1.14 | 71.0 |
| VIII-43C | 52.1 | 5900 | 20 | 39.9 | 275 | 1.43 | 57.9 |
| VIII-44C | 52.0 | 5900 | 20 | 50.1 | 275 | 1.35 | 63.7 |
| VIII-45C | 51.7 | 5900 | 20 | 66.8 | 275 | 1.25 | 68.7 |
| VIII-46 | 52.2 | 4500 | 35 | 47.6 | 275 | 0.88 | 75.7 |
| VIII-47 | 51.9 | 4500 | 35 | 61.0 | 275 | 0.83 | 80.2 |
| VIII-48 | 51.7 | 4500 | 35 | 68.3 | 275 | 0.82 | 80.6 |
| VIII-49 | 52.5 | 5000 | 35 | 47.6 | 275 | 1.09 | 69.9 |
| VIII-50 | 51.9 | 5000 | 35 | 61.0 | 275 | 0.97 | 74.8 |
| VIII-51 | 51.8 | 5000 | 35 | 68.3 | 275 | 0.95 | 76.8 |
| VIII-52C | 52.5 | 5300 | 35 | 40.6 | 275 | 1.32 | 58.8 |
| VIII-53 | 52.1 | 5300 | 35 | 47.6 | 275 | 1.18 | 66.7 |
| VIII-54 | 52.2 | 5300 | 35 | 61.0 | 275 | 1.08 | 73.6 |
| VIII-55 | 52.3 | 5300 | 35 | 68.3 | 275 | 1.03 | 76.5 |
| VIII-56C | 52.6 | 5600 | 35 | 40.6 | 275 | 1.40 | 59.3 |
| VIII-57C | 52.7 | 5600 | 35 | 47.6 | 275 | 1.27 | 65.8 |
| VIII-58 | 52.1 | 5600 | 35 | 61.0 | 275 | 1.14 | 68.3 |
| VIII-59 | 52.0 | 5600 | 35 | 68.3 | 275 | 1.11 | 72.7 |
| VIII-60C | 52.5 | 5900 | 35 | 40.6 | 275 | 1.50 | 57.0 |
| VIII-61C | 50.2 | 5900 | 35 | 47.6 | 275 | 1.36 | 63.0 |

TABLE VIII-continued

| ITEM NO. | DEN | SPEED MPM | MPMD % | YARN RV | Tp c | DT G/D | EB % |
|---|---|---|---|---|---|---|---|
| VIII-62 | 54.7 | 5900 | 35 | 61.0 | 275 | 1.22 | 66.2 |
| VIII-63 | 51.7 | 5900 | 35 | 68.3 | 275 | 1.21 | 67.2 |

TABLE IX

| Item No. | Spin MPM | Yarn RV | N6 % | Tp C | Air MPM | Air C | Lc CM | Yarn Den. | No. Fils | DT G/D |
|---|---|---|---|---|---|---|---|---|---|---|
| IX-1 | 5300 | 64.0 | 5 | 290 | 18 | 21 | 135 | 25.0 | 7 | 0.96 |
| IX-2 | 5300 | 64.0 | 5 | 288 | 18 | 21 | 122 | 38.6 | 10 | 1.13 |
| IX-3 | 5300 | 65.4 | 5 | 290 | 18 | 21 | 135 | 62.5 | 17 | 1.19 |
| IX-4C | 5300 | 68.1 | 5 | 290 | 18 | 21 | 135 | 52.0 | 34 | 1.35 |
| IX-5C | 5300 | 64.4 | 0 | 291 | 18 | 21 | 135 | 25.8 | 7 | 1.19 |
| IX-6C | 5300 | 64.3 | 0 | 288 | 18 | 21 | 122 | 38.7 | 10 | 1.22 |
| IX-7C | 5300 | 64.6 | 0 | 293 | 18 | 21 | 122 | 61.9 | 17 | 1.24 |
| IX-8C | 5300 | 62.9 | 0 | 288 | 18 | 21 | 122 | 51.3 | 34 | 1.50 |

TABLE X

| Item No. | Yarn RV | Tp C | Capillary MM | Capillary L/D | Capillary $L/D^4$ | Quench MPM | Quench C | Lc CM | DT G/D |
|---|---|---|---|---|---|---|---|---|---|
| X-1 | 62.6 | 293 | 0.254 | 1.9 | 116 | 18 | 21 | 122 | 1.153 |
| X-2 | 62.6 | 293 | 0.254 | 1.9 | 116 | 18 | 40 | 122 | 1.171 |
| X-3 | 62.6 | 293 | 0.254 | 1.9 | 116 | 6 | 21 | 122 | 1.172 |
| X-4 | 62.6 | 293 | 0.254 | 1.9 | 116 | 6 | 40 | 122 | 1.188 |
| X-5 | 62.6 | 285 | 0.254 | 1.9 | 116 | 18 | 21 | 122 | 1.177 |
| X-6 | 62.6 | 285 | 0.254 | 4.0 | 244 | 18 | 21 | 122 | 1.158 |
| X-7 | 62.6 | 285 | 0.203 | 4.0 | 478 | 18 | 21 | 122 | 1.124 |
| X-8 | 64.3 | 288 | 0.254 | 1.9 | 116 | 18 | 21 | 122 | 1.220 |
| X-9 | 64.3 | 288 | 0.254 | 1.9 | 116 | 18 | 21 | 102 | 1.180 |
| X-10 | 67.8 | 288 | 0.254 | 1.9 | 116 | 18 | 21 | 122 | 1.195 |
| X-11 | 67.8 | 288 | 0.254 | 1.9 | 116 | 18 | 21 | 135 | 1.182 |
| X-12 | 66.6 | 290 | 0.457 | 1.0 | 10.5 | 18 | 21 | 135 | 1.260 |
| X-13 | 66.6 | 290 | 0.457 | 4.0 | 42 | 18 | 21 | 135 | 1.240 |
| X-14 | 66.6 | 290 | 0.330 | 1.0 | 28 | 18 | 21 | 135 | 1.230 |
| X-15 | 66.6 | 290 | 0.330 | 4.0 | 111 | 18 | 21 | 135 | 1.190 |
| X-16 | 66.6 | 290 | 0.254 | 1.9 | 116 | 18 | 21 | 135 | 1.180 |
| X-17 | 66.6 | 290 | 0.229 | 1.0 | 83 | 18 | 21 | 135 | 1.190 |

TABLE XI

| Structural Property | XI-1 | XI-2C | XI-3C |
|---|---|---|---|
| Polymer Relative Viscosity (RV) | 68 | 65 | 45 |
| Nylon 6 Copolymer, % wt. | 5 | 0 | 0 |
| Denier | 51.6 | 50.8 | 52.8 |
| Modulus, g/d | 19.7 | 12.5 | 16.7 |
| Tenacity, g/d | 4.29 | 3.99 | 3.96 |
| Elongation | 75.6 | 76.6 | 73.0 |
| Draw Tension (DT), g/d | 1.13 | 1.15 | 0.99 |
| Crystal Size, 100 (Å) | 54.0 | 61.2 | 43.0 |
| Crystal Size, 010 (Å) | 32.4 | 37.2 | 28.6 |
| Crystal Area ($A^2 \times 10^2$) | 17.5 | 22.8 | 12.3 |
| Crystal Orientation Angle, COA | NA | 20.0 | NA |
| Crystalline Perfection Index (CPI) | 53.0 | 66.3 | 62.1 |
| Long Period Spacing, LPS (A) | NA | 91 | NA |
| Density, $\rho$(g/cm3) | 1.1351 | 1.1389 | 1.1327 |
| Birefringence ($\Delta n$) | 0.0405 | 0.0422 | 0.0445 |
| Optical Density ($R_{ISO}$) | 1.5364 | 1.5376 | 1.5353 |
| S/C $(\Delta_N)_{0.95-0.05}$ | 0.0047 | 0.0008 | 0.0047 |
| S/C $(\Delta R_{ISO})_{0.95-0.05}$ | 0.0010 | 0.0008 | (0.0017) |
| Torsional Shear Modulus (Gpa) | .143 | .184 | .204 |
| Sonic Modulus | 43.8 | 50.1 | 46.7 |
| MAS C-13 NMR (Hz) | 150 | 200 | 200 |
| DSC Melting Point, $T_M$, (°C.) | 255 | 262 | 260 |
| DSC Melting rate (mwt/min) | 46.5 | 35.7 | 33.3 |
| Shrinkage Tension ($ST_{MAX}$), g/d | | | |
| 20° C./min | .081 | .092 | .099 |
| 30° C./min | .076 | .086 | .066 |
| T ($ST_{max}$), C. | | | |
| 20° C./min | 70 | 69 | 72 |

TABLE XI-continued

| Structural Property | XI-1 | XI-2C | XI-3C |
|---|---|---|---|
| 30° C./min | 67 | 69 | 69 |
| Draw Stress @ 75 C. ($\sigma_D$), g/d | 1.75 | 2.02 | 2.02 |
| Draw Modulus @ 75 C. ($M_D$), g/d | 3.70 | 6.00 | 5.2 |
| Draw Energy, $(E_D)_a$ | 0.32 | 0.40 | 0.37 |
| DMA Transition Temperatures | | | |
| $T_C$, °C. | 40.4 | 51.2 | 41.8 |
| T (alpha), °C. | 87.8 | 87.8 | 102.6 |
| Boil-Off Shrinkage, BOS (%) | 3.8 | 3.4 | NA |
| Dry Heat Shrinkage, ABO (%) | 4.5 | 4.6 | NA |
| TMA Dry Heat Shrinkage (%) | | | |
| −100° C. | 0.5 | 0.5 | 0.5 |
| −150° C. | 1 | 1 | 1 |
| −200° C. | 2 | 1.5 | 2 |
| −250° C. | 5 | 3 | 5 |
| TMA Dry Heat Extension (%) | | | |
| −100° C. | 2 | 2 | 1 |
| −150° C. | 6.5 | 6 | 8 |
| −200° C. | 12 | 10 | 13 |
| TMA, $(\Delta L/\Delta T)_{MAX, 300\ MG/D}$, %/C. | 0.13 | 0.12 | 0.17 |
| TMA, $d(\Delta L/\Delta T)_{MAX}/d(\sigma_D)$, $\times 10^{-4}$ | 5 | 4 | 8 |
| MBB Dye | 175 | 125 | 100 |
| Time (50% Exhaustion), min. | | | |
| −40° C. | 11 | 7 | 3.5 |
| −60° C. | 8 | 9 | 5 |
| −80° C. | 4 | 4 | 5.5 |

We claim:

1. A partially-oriented nylon 66 polymer multifilament yarn of denier about 15 to about 250 and of elongation ($E_b$) about 70 to about 100%, the polymer being of relative viscosity about 50 to about 80 and having been derived by adding to a nylon 66 end product precursor prior to isolating the end product, wherein a minor amount of a bifunctional polyamide comonomer or of a non-reactive additive capable of hydrogen bonding with the nylon 66 polymer, and that the yarn has a draw-tension (DT) in g/d of at least about 0.8 and less than about 1.2.

2. A partially-oriented yarn according to claim 1, wherein the polymer contains a minor amount of $\epsilon$-aminocaproic monomeric units as the bifunctional additive comonomer.

3. A partially-oriented yarn according to claim 1, wherein the polymer contains a minor amount of 2-methyl-pentamethylene adipamide units as the bifunctional additive comonomer.

4. A partially-oriented yarn according to claim 2, wherein the polymer contains by weight about 2 to about 8% of the ϵ-aminocaproic monomeric units as the bifunctional additive comonomer.

5. A partially-oriented yarn according to claim 3, wherein the polymer contains by weight about 2 to about 20% of 2-methyl-pentamethylene adipamide units as the bifunctional additive comonomer.

6. A partially-oriented yarn according to claim 5, wherein the polymer contains by weight about 20 to about 40% of 2-methyl-pentamethylene adipamide units as the bifunctional additive comonomer and the yarn has a boil-off shrinkage of greater than about 10%.

7. A partially-oriented yarn according to any one of claims 2–6, wherein the relative viscosity is about 60 to about 70.

8. A partially-oriented yarn according to any one of claims 3, 5 or 6, wherein the relative viscosity is about 50 to about 60.

9. A partially-oriented yarn according to any of claims 1 to 6, wherein the elongation ($E_b$) is about 75 to about 95% and a draw tension in g/d between about ($140/E_b-0.8$) and about 1.2.

10. A partially-oriented yarn according to any of claims 1 to 6, having a maximum dynamic extension rate $(\Delta L/\Delta T)_{max}$ of about 0.05 to about 0.15%/°C., and a sensitivity of $(\Delta L/\Delta T)_{max}$ to stress ($\sigma$) $d(\Delta L/\Delta T)_{max}/d\sigma$ of about $3\times10-4$ to $7\times10-4$ (%/°C.)/(mg/d).

11. A partially-oriented yarn according to any of claims 1 to 6, having a draw modulus ($M_D$) of about 3.5 to about 6.5 g/d and by a draw stress ($\sigma_D$) of about 1.0 to about 1.9 g/d, measured at 75° C. and a draw ratio of 1.35X, with apparent draw energy $(E_D)_a$ of about 0.2 to about 0.5 (g/d)°K.

12. A textured nylon 66 multifilament yarn having an elongation ($E_b$) less than about 35% by the yarn consisting essentially of nylon 66 polymer having a relative viscosity of about 50 to about 80 and having been derived by adding to a nylon 66 end product precursor prior to isolating the end product, minor amount of a bifunctional polyamide comonomer or of a non-reactive additive capable of hydrogen bonding with the nylon 66 polymer.

13. A textured yarn according to claim 12, wherein the polymer contains a minor amount of ϵ-aminocaproic monomeric units as the bifunctional additive comonomer.

14. A textured yarn according to claim 12, wherein the polymer contains a minor amount of 2-methyl-pentamethylene adipamide units as the bifunctional additive comonomer.

15. A textured yarn according to claim 13, wherein the polymer contains by weight about 2 to about 8% of the ϵ-aminocaproic monomeric units as the bifunctional additive comonomer.

16. A textured yarn according to claim 14, wherein the polymer contains by weight about 2 to about 20% of 2-methyl-pentamethylene adipamide units as the bifunctional additive comonomer.

17. A textured yarn according to claim 14, wherein the polymer contains by weight about 20 to about 40% of 2-methyl-pentamethylene adipamide units as the bifunctional additive comonomer and the yarn has a boil-off shrinkage of greater than about 8%.

18. A textured yarn according to any one of claims 13–17, wherein the relative viscosity is about 60 to about 70.

19. A textured yarn according to any one of claims 14, 16 or 17, wherein the relative viscosity is about 50 to about 60.

20. A textured yarn according to any one of claim 12 to 17, having an elongation ($E_b$) of less than about 30%.

21. A textured nylon 66 multifilament yarn having an elongation ($E_b$) less than about 35% and a boil-off shrinkage of greater than about 8% wherein at least a portion of the filaments have a boil-off shrinkage of less than about 6% and consists essentially of nylon 66 polymer having a relative viscosity of about 50 to about 80, said yarn having other of its filaments consisting essentially of nylon 66 polymer a relative viscosity of about 50 to about 80 and having been derived by adding to a nylon 66 end product precursor prior to isolating the end product 20 to about 40% by weight of 2-methyl-pentamethylene adipamide units as a bifunctional comonomer, said distinct filaments having a difference in % shrinkage of at least about 4%.

22. A partially-oriented nylon 66 polymer multifilament yarn of denier about 15 to about 250 and of elongation ($E_b$) about 70 to about 100%, the polymer being of relative viscosity about 50 to about 80 and having been derived by adding to a nylon 66 end product precursor prior to isolating the end product a minor amount of a bifunctional polyamide comonomer or of a non-reactive additive capable of hydrogen bonding with the nylon 66 polymer, and a 66 nylon polymer chain brancher in an amount between about 0.025 and 0.125 mole percent.

23. The partially-oriented yarn of claim 22 wherein said chain brancher is selected from the class consisting of trifunctional aliphatic amines.

24. The partially-oriented yarn of claim 23 characterized in that said chain brancher is tris 2-aminoethylamine (TREN).

25. The partially-oriented yarn of claim 22 characterized in that said bifunctional comonomer is selected from the class consisting of ϵ-aminocaproic monomeric units and 2-methyl-pentamethylene adipamide units.

26. A multifilament direct-use yarn suitable for critical dye end-uses, said polymer having a relative viscosity (RV) of about 40 to about 50 and having been derived by adding to a nylon 66 end product precursor prior to isolating the end product about 2% to about 8% by weight of ϵ-caproamide comonomer units nylon 66 polymer by weight of ϵ spun in a spinning process which imparts sufficient spin-orientation to the yarn that the yarn has a draw tension (DT) greater than about 1.4 grams per denier with an elongation-to-break (Eb) between about 45% and about 65%, a dynamic length change (Δ Length, %) and dynamic shrinkage rate (Δ Length, %)/(Δ Temperature, °C.) less than zero over the temperature range of 40° C. to 135° C., a maximum dynamic extension rate $[(\Delta \text{ Length, } \%)/(\Delta \text{ Temperature, } °C.)]_{MAX}$ less than about 0.15 (%/°C.) with sensitivity of $(\Delta L/\Delta T)_{MAX}$ with respect to stress, $\sigma$, $d(\Delta L/\Delta T)_{MAX}/d(\sigma)$, less than about $7\times10^{-4}$ (%/°C.)/(mg/d), and a boil-off shrinkage (BOS) between about 3% and about 8%.

27. A multifilament direct use yarn according to claim 26 having a dye transition temperature ($T_{DYE}$) less than about 65° C.

28. A multifilament direct use yarn according to claim 26 characterized by a dynamic mechanical peak temperature ($T_{E''MAX}$) less than about 95° C.

29. A multifilament direct use yarn according to claim 26 having the characteristic that, after boil-off, the yarn continues to shrink under dry heat at 175° C.

* * * * *